US007995945B2

(12) United States Patent
Kimoto et al.

(10) Patent No.: US 7,995,945 B2
(45) Date of Patent: Aug. 9, 2011

(54) IMAGE FORMING APPARATUS WHICH DISPLAYS A SETTING SCREEN

(75) Inventors: Yuko Kimoto, Yokohama (JP); Naoki Hoshino, Ageo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/814,402

(22) Filed: Jun. 11, 2010

(65) Prior Publication Data

US 2010/0253959 A1 Oct. 7, 2010

Related U.S. Application Data

(63) Continuation of application No. 11/373,799, filed on Mar. 9, 2006, now Pat. No. 7,747,185.

(51) Int. Cl.
*G03G 15/00* (2006.01)

(52) U.S. Cl. ..... 399/81

(58) Field of Classification Search ..... 399/81
See application file for complete search history.

(56) References Cited

U.S. PATENT DOCUMENTS 5,113,222 A * 5/1992 Wilson et al. ..... 399/81
6,285,842 B1 * 9/2001 Katamoto et al. ..... 399/81

* cited by examiner

*Primary Examiner* — David M Gray
*Assistant Examiner* — Erika Villaluna
(74) *Attorney, Agent, or Firm* — SoCal IP Law Group LLP; Steven C. Sereboff; John E. Gunther

(57) ABSTRACT

There is displayed, in a display section, a photocopy processing setting screen having a setting information display area to display information indicating various setting particulars of photocopy processing, a button display area to display various icons indicating the setting particulars of the photocopy processing, and a graphic to associate each setting particular displayed in the setting information display area with each icon to set the setting particular displayed in the setting information display area among the icons displayed in the button display area.

20 Claims, 24 Drawing Sheets

IMAGE FORMING APPARATUS WHICH DISPLAYS A SETTING SCREEN

CROSS-REFERENCE TO RELATED APPLICATION

This is a continuation of application Ser. No. 11/373,799 filed on Mar. 9, 2006, which is herein incorporated by reference.

BACKGROUND OF THE INVENTION

1. Field of the Invention

The present invention relates to an operation device for a user to set photocopy processing, and an image forming apparatus which performs photocopy processing based on user's designated setting of the photocopy processing.

2. Description of the Related Art

Heretofore, an image forming apparatus such as a photocopier is provided with an operation panel to perform various settings. However, in the conventional operation panel, an operation for setting predetermined photocopy processing is complicated or is not easy to understand. Therefore, in the image forming apparatus provided with the operation panel, it is difficult to set the desired photocopy processing, and a result of the photocopy processing becomes different from that intended by a user in many cases.

For example, in the photocopier, it is sometimes difficult to intuitively recognize information indicating set contents, an operation key for changing the corresponding setting particular and the like displayed in a display section disposed in the operation panel. Especially, in recent years, functions of the photocopier have been multiplied, and various pieces of information are displayed in the display section of the operation panel. Therefore, the conventional photocopier has a problem that a correspondence between the information indicating the set contents and the operation key corresponding to each of the set contents is not easily seen.

BRIEF SUMMARY OF THE INVENTION

In an aspect of the present invention, an object is to provide an operation device and an image forming apparatus in which operability in setting photocopy processing has been improved.

An image forming apparatus of one aspect of the present invention has: a scanner which reads an image of a draft; a printer which prints the image on an image forming medium; a display unit which displays a setting screen of photocopy processing to print, on the image forming medium by the printer, the draft image read by the scanner; an operation unit to input setting information on the photocopy processing in a state in which the setting screen of the photocopy processing is displayed in the display unit; a display control unit which displays, in the display unit, a setting screen having a setting information display area to display information indicating a plurality of setting particulars of the photocopy processing, a button display area to display a plurality of icons indicating the setting particulars of the photocopy processing, and a graphic to associate each setting particular displayed in the setting information display area with each icon to set the setting particular displayed in the setting information display area among the icons displayed in the button display area; and a photocopy setting unit to set the photocopy processing in accordance with the icon indicated by the operation unit with respect to the setting screen in which the icons are displayed by the display control unit.

In another aspect of the present invention, a method of setting an image forming apparatus is a method of setting an image forming apparatus having: a scanner which reads an image of a draft; a printer which prints the image on an image forming medium; a display unit which displays a setting screen of photocopy processing to print, on the image forming medium by the printer, the draft image read by the scanner; and an operation unit to input setting information on the photocopy processing in a state in which the setting screen of the photocopy processing is displayed in the display unit, the method comprising: displaying, in a setting information display area of one setting screen, information indicating a plurality of setting particulars of the photocopy processing; displaying, in a button display area of the setting screen, a plurality of icons indicating the setting particulars of the photocopy processing; displaying, in the setting screen, a graphic which associates each setting particular displayed in the setting information display area with each icon to set the setting particular displayed in the setting information display area among the icons displayed in the button display area; and setting the photocopy processing in accordance with the icon indicated by the operation unit with respect to the setting screen in which the icons are displayed.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

An embodiment of the present invention will be described hereinafter with reference to the drawings.

Figure 1:
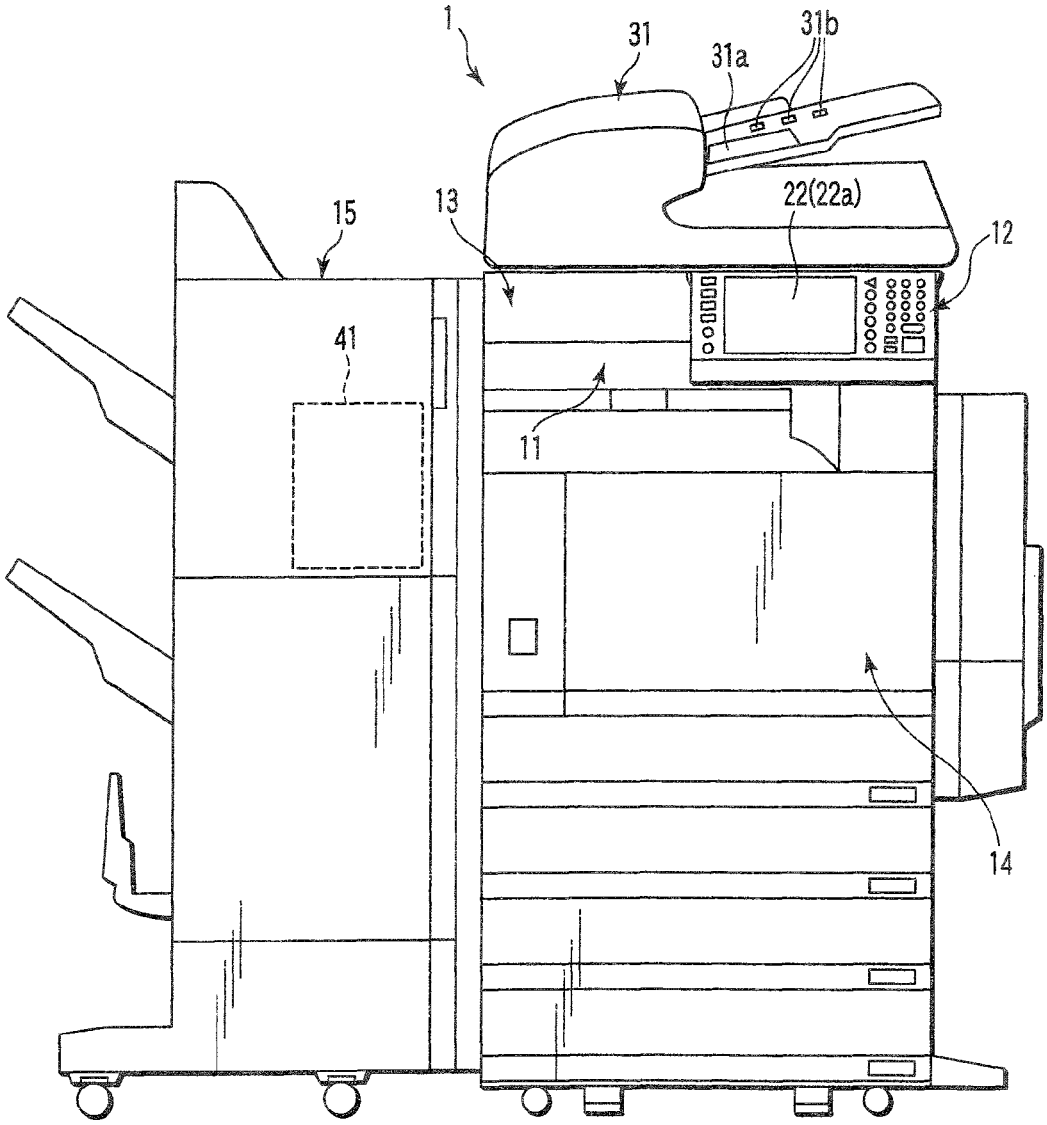
FIG. 1 is a diagram showing an appearance constitution of a digital multifunction peripherals 1 as an image forming apparatus in an embodiment of the present invention.

FIG. 1 is a diagram showing an appearance constitution of a digital multifunction peripherals 1 as an image forming apparatus in the embodiment of the present invention.

As shown in FIG. 1, this digital multifunction peripherals 1 is constituted of a system control unit 11, an operation panel 12, a scanner unit 13, a printer unit 14, a finisher unit 15 and the like.

The system control unit 11 controls the whole digital multifunction peripherals 1. The system control unit 11 is disposed in a main body of the digital multifunction peripherals 1. The system control unit 11 is connected to the operation panel 12, the scanner unit 13, the printer unit 14, the finisher unit 15 and the like. Accordingly, the system control unit 11 performs various controls with respect to the respective units.

The operation panel 12 is disposed on a front surface of the digital multifunction peripherals main body. The operation panel 12 is a user interface. An operation surface of the operation panel 12 is provided with hardware keys 21 as an operating section, a display section 22 in which a touch panel 22*a* is built and the like.

The scanner unit 13 functions as an image reading unit which reads an image of a draft. The scanner unit 13 is disposed in an upper part of the digital multifunction peripherals main body. The scanner unit 13 main body is constituted of: a scanning section (not shown) which optically scans a draft surface; a photoelectric converting section (not shown) such as a CCD line sensor which converts, into an electric signal, light reflected by the draft surface optically scanned by the scanning section and the like.

Moreover, the scanner unit 13 has an auto document feeder (ADF) 31. The ADF 31 conveys the surface of the draft to be read to an image reading position of the scanner unit 13 main body. That is, the image of the draft conveyed by the ADF 31 is read by the scanner unit 13 main body. The ADF 31 has: a draft table on which the draft is to be set; a conveying mechanism which conveys the drafts set on the draft table one by one; and a draft discharge section to which the draft conveyed by the conveying mechanism is discharged. The draft table of the ADF 31 is provided with a guide section 31*a* which guides the conveyed drafts and a plurality of sensors 31*b* for detecting a size of the draft. The guide section 31*a* and each sensor 31*b* function as a detector for detecting the size of the draft on the draft table.

The printer unit 14 forms an image on a sheet (photocopy sheet) as an image forming medium. The printer unit 14 is constituted of, for example, a conveying section which conveys the sheet, an image forming section which forms an image on the sheet conveyed by the conveying section and the like.

The finisher unit 15 performs various types of finish processing with respect to the sheet as the image forming medium printed by the printer unit 14. The finisher unit 15 has finishing functions such as: a stapling function of stapling together a plurality of sheets printed by the printer unit 14; a sorting function of sorting the sheets printed by the printer unit 14 based on a set sorting method; and a stacking function of discharging the sheet printed by the printer unit 14 based on a set sheet discharging order or a set sheet discharging method. The finisher unit 15 has finishing functions realized by a control similar to that of the stapling function, such as: a hole punching function of making a hole in a predetermined position in the sheet printed by the printer unit 14; and a saddle stitching function of folding back a plurality of sheets printed by the printer unit 14 along the center line of each sheet to staple together the sheets.

The finisher unit 15 has a stapler 41 or the like as a mechanism for performing the stapling function. For example, the stapler 41 staples together the plurality of sheets sorted by the sorting function. The stapler 41 has a function of stapling together the sheets by multi-positions thereof. Therefore, the stapling function staples together the positions to be stapled, selected by the user, with respect to the plurality of sheets sorted by the sorting function.

Figure 2:
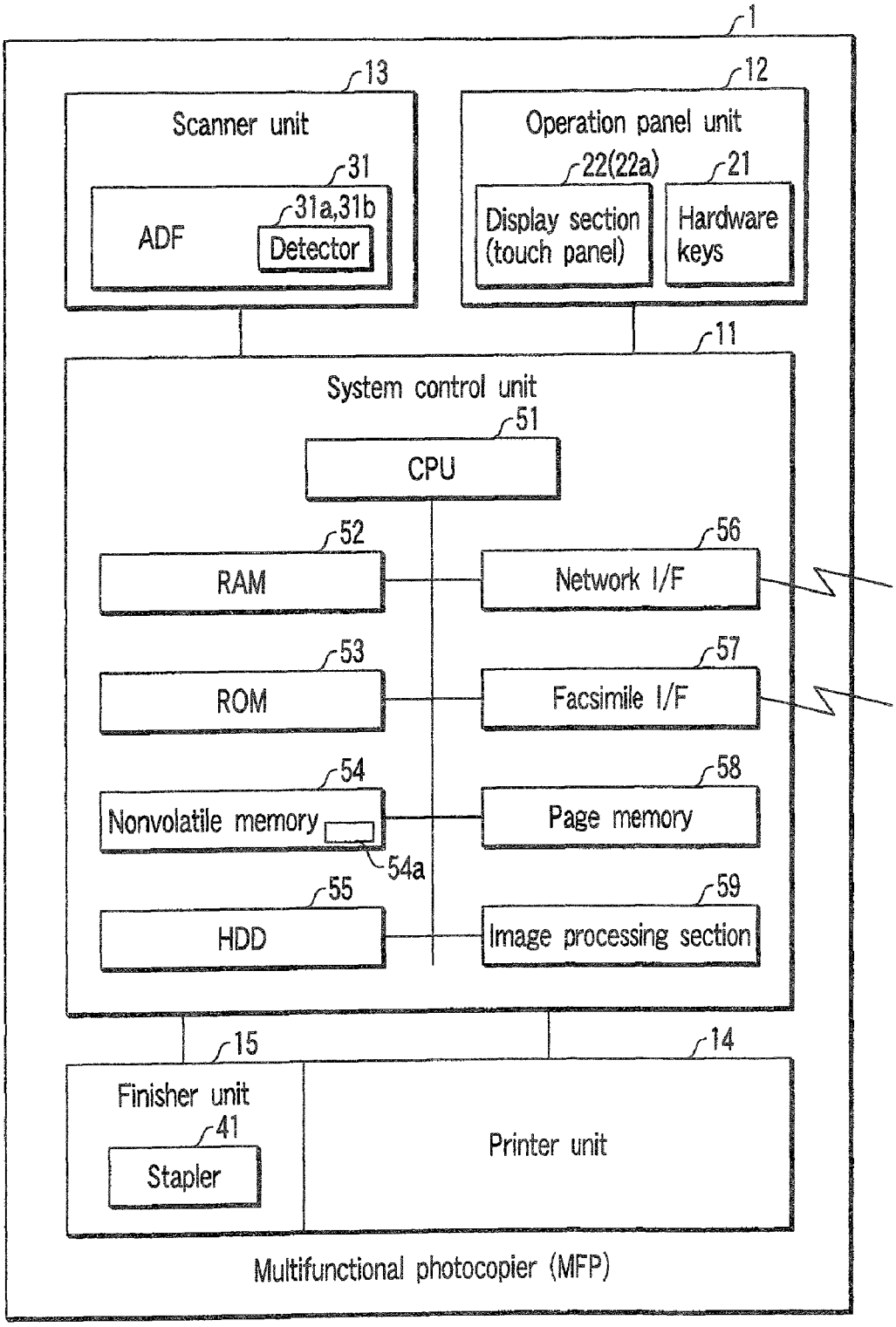
FIG. 2 is a block diagram showing a constitution of a control system of the digital multifunction peripherals 1 as the image forming apparatus in the embodiment of the present invention.

FIG. 2 is a block diagram showing a constitution of a control system of the digital multifunction peripherals 1 as an image forming apparatus in the embodiment of the present invention.

As shown in FIG. 2, in this digital multifunction peripherals 1, the system control unit 11 is connected to the operation panel 12, the scanner unit 13, the printer unit 14, and the finisher unit 15.

The system control unit 11 controls the operation panel 12, the scanner unit 13, the printer unit 14, the finisher unit 15 and the like. The system control unit 11 has various functions of performing various types of processing based on signals supplied from the operation panel 12, the scanner unit 13, the printer unit 14 and the finisher unit 15.

The operation panel 12 has the hardware keys 21, the display section 22 in which the touch panel 22*a* is built and the like. In the display section 22, there are displayed an operation guidance, keys (icons) selectable by the touch panel 22*a* and the like under a display control of the system control unit 11. In the operation panel 12, the user operates the hardware keys 21, or inputs the icon selectable by the touch panel 22*a*. The operation panel 12 supplies, to the system control unit 11, information input by the user (the information indicating the hardware key 21 pressed by the user or the icon selectable by the touch panel 22*a* touched by the user).

The scanner unit 13 converts the image of the draft into image data under the control of the system control unit 11.

The scanner unit 13 converts the draft image into color or monochromatic digital image data. The scanner unit 13 supplies the digital image data as the read draft image to the system control unit 11.

Moreover, the scanner unit 13 has the ADF 31 provided with the detectors 31*a*, 31*b*. Detection signals of the detectors 31*a*, 31*b* of the ADF 31 are supplied to the system control unit 11. The system control unit 11 realizes an ADF draft size detecting function of detecting a size of the draft set in the ADF 31 based on the detection signals of the detectors 31*a*, 31*b*.

The printer unit 14 prints the image on the sheet as the image forming medium under the control of the system control unit 11. A result of the print processing performed by the printer unit 14 and the like are notified to the system control unit 11. The printer unit 14 performs color printing to form a color image on the image forming medium based on the color image data, or monochromatic printing to form a monochromatic image on the image forming medium based on the monochromatic image data. The printer unit 14 is constituted of: for example, the conveying section (not shown) which conveys the image forming medium; the image forming section (not shown) which forms the color image or the monochromatic image on the image forming medium conveyed by the conveying section and the like.

The finisher unit 15 performs various types of processing with respect to the sheet as the image forming medium printed by the printer unit 14 under the control of the system control unit 11. The processing result and the like of the finisher unit 15 are notified to the system control unit 11. The finisher unit 15 executes a finishing function such as the stapling function, the sorting function, or the stacking function based on the control by the system control unit 11.

Moreover, as shown in FIG. 1, the system control unit 11 is constituted of: a central processing unit (CPU) 51; a random access memory (RAM) 52; a read only memory (ROM) 53; a nonvolatile memory 54; a hard disk drive (HDD) 55; a network interface (I/F) 56; a facsimile interface (I/F) 57; a page memory 58; an image processing section 59 and the like.

The CPU 51 controls the whole system control unit 11. The CPU 51 executes a program stored in the ROM 53, the nonvolatile memory 54 or the HDD 55 to thereby perform various types of processing. For example, the CPU 51 executes the control program to thereby realize the ADF draft size detecting function. A display control of the display section 22 of the operation panel 12 is executed by the CPU 51 based on the program and control data stored in the ROM 53, the nonvolatile memory 54, or the HDD 55.

The RAM 52 is a memory which temporarily stores data for working or which stores data to be referred to. The RAM 52 is used as a main memory for executing various types of processing based on various control programs. In the RAM 52, there is held information indicating various set contents during an operation of the digital multifunction peripherals. For example, the information indicating the set contents of the photocopy processing is also held by the RAM 52.

It is to be noted that the set contents of the photocopy processing include set particulars such as a photocopy magnification, the number of sheets to be photocopied and a finishing mode (position to be stapled, etc.) in addition to a draft setting and a sheet setting. The draft setting includes a size of a draft, a draft setting direction, a direction of the image in the draft, the surface of the draft to be read (a draft reading mode is single-sided or double-sided) and the like. The sheet setting includes a size of the sheet, a direction of the sheet, a direction of the image in the sheet, the surface of the sheet to be printed (a sheet printing mode is single-sided or double-sided) and the like.

The ROM 53 is a nonvolatile memory. In the ROM 53, there are stored, for example, a control program, control data and the like for controlling the digital multifunction peripherals 1. In the ROM 53, there may be stored display data and the like to be displayed in the display section 22 of the operation panel 12.

The nonvolatile memory 54 is a rewritable nonvolatile memory. In the nonvolatile memory 54, there is stored data such as system setting information. The nonvolatile memory 54 may store display data and the like to be displayed in the display section 22 of the operation panel 12.

Moreover, the nonvolatile memory 54 is provided with a default setting storage section 54*a*. In the default setting storage section 54*a*, there are stored default setting information on setting particulars of photocopy processing. It is to be noted that the default setting storage section 54*a* may be disposed in a nonvolatile memory such as the HDD 55.

The HDD 55 is a large-capacity storage device. In the HDD 55, there are stored various data such as various setting data, management data, control program and control data. In the HDD 55, there are also stored display data and the like to be displayed in the display section 22 of the operation panel 12. In the HDD 55, there are also stored image data and the like read by the scanner unit 13. Furthermore, the HDD 55 may be used as a backup memory for various memories.

The network interface 56 performs data communication via the network. The network interface 56 is constituted of, for example, a network interface card (NIC) and the like. The digital multifunction peripherals 1 realizes a network printing function of printing, on the sheet, print data from an external device connected to the network interface 56 via the network.

The facsimile interface 57 transmits and receives facsimile data. In the digital multifunction peripherals 1, a facsimile function is realized using the facsimile interface 57. For example, facsimile reception processing is realized by monochromatically printing, by the printer unit 14, the facsimile data received by the facsimile interface 57. Moreover, the facsimile interface 57 realizes facsimile transmission processing by transferring, to a destination, the facsimile data converted from the image data of the draft read by the scanner unit 13.

The page memory 58 is a memory in which the image data to be printed by the printer unit 14 and the like are stored. The page memory 58 is controlled by a page memory controller (not shown). For example, in a case where the printer unit 14 performs the print processing, in the page memory 58 there is developed (stored) the color image data or the monochromatic image data of each page to be printed by the printer unit 14.

The image processing section 59 subjects the image data to various types of image processing. The image processing section 59 is constituted of an image processing circuit and the like. The image processing section 59 performs image processing such as correction, compression, or extension of the image data.

Next, there will be described a constitution of the operation panel 12.

Figure 3:
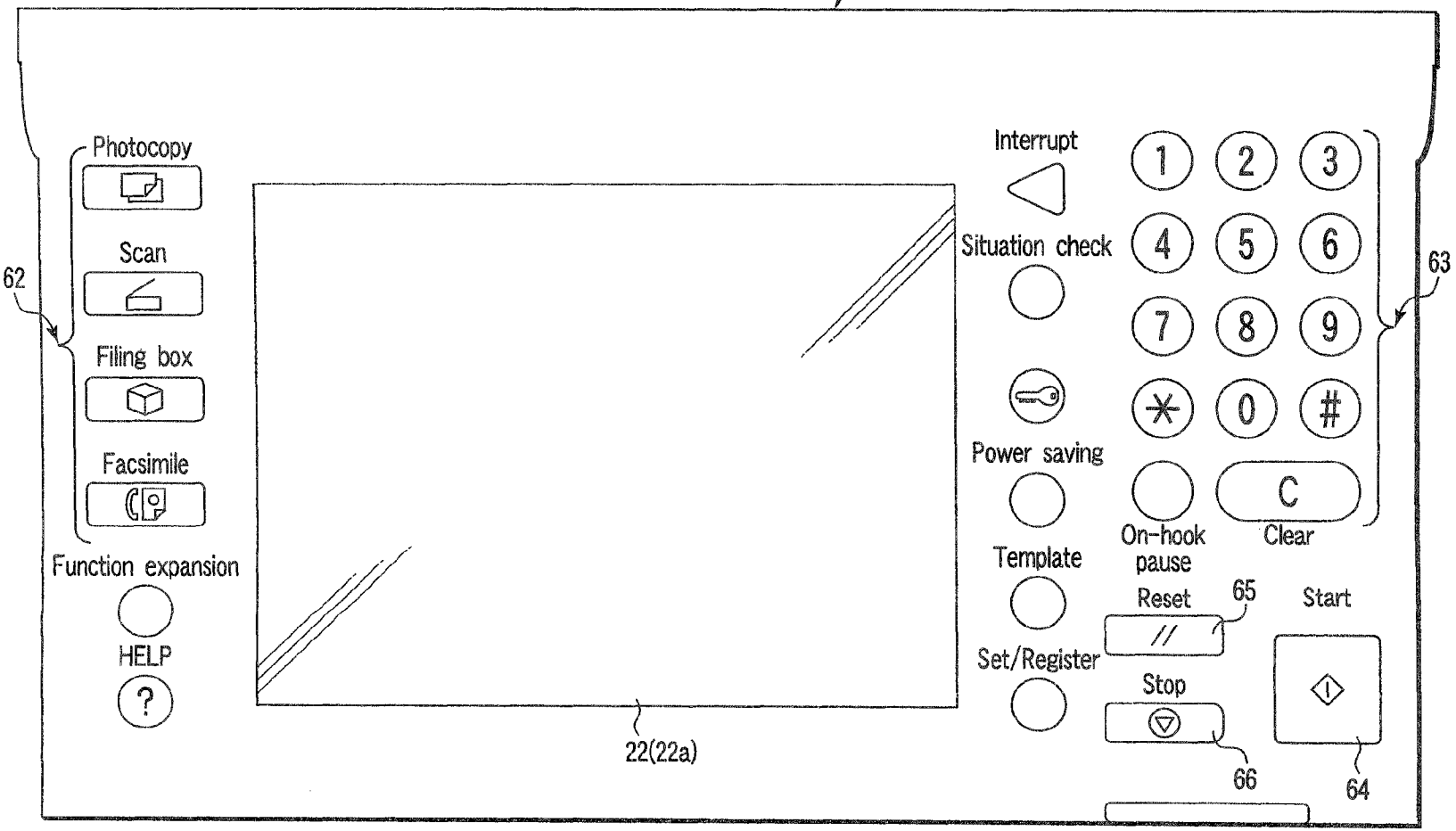
FIG. 3 is an appearance diagram showing a constitution example of an operation panel.

FIG. 3 is an appearance diagram showing a constitution example of the operation panel 12.

As shown in FIG. 3, the operation panel 12 is provided with various hardware keys 21, the display section 22 in which the touch panel 22*a* is built and the like. Examples of the hardware keys 21 include function selecting keys 62, ten keys 63, a start key 64, a reset key 65 and a stop key 66.

The function selecting keys 62 are hardware keys for selecting various functions. Examples of the function selecting keys 62 include a scanning function selecting key for selecting a scanning function, a photocopy function selecting key for selecting a photocopy function and a FAX function selecting key for selecting a facsimile function.

The ten keys 63 are hardware keys for inputting numerals and the like. The ten keys 63 are used in inputting information such as the number of sheets to be photocopied, a photocopy magnification and a personal identification number for management. The start key 64 is a hardware key for instruction start of an operation. For example, in the photocopy function, a photocopy operation is started in response to an instruction of the start key 64. The reset key 65 is a hardware key for instructing reset of the set contents and the like. For example, when the reset key 65 is input, the set contents and the like designated by the user are reset, and changed into a default set value. The stop key 66 is a hardware key for instructing discontinuation of the operation being executed by the digital multifunction peripherals. For example, when the stop key 66 is indicated during the photocopy operation of the digital multifunction peripherals, the photocopy operation is stopped.

Moreover, in addition to the above-described keys, the operation panel 12 shown in FIG. 3 includes, as the hardware keys 21: a help (HELP) key to instruct display of a user guidance; a set/register key to instruct execution of setting or registering; a template key to select a template as data registered beforehand; an interrupt key to demand an interrupt of an operation; a situation check key to confirm a state of the digital multifunction peripherals; a key to perform security setting or the like; a power saving key for switching a power saving operation mode to reduce power consumption and a usual operation mode; an on-hook/pause key to bring a phone function into an on-hook state; a clear key to clear numerals and the like input by the ten keys and the like. Furthermore, the operation panel 12 shown in FIG. 3 also includes an alarm display to notify an abnormality of the digital multifunction peripherals and the like.

The display section 22 is constituted of a liquid crystal display in which the touch panel 22*a* is built. In the display section 22, various operation screens are displayed. Each operation screen displayed in the display section 22 displays a key (icon) selectable by the touch panel 22*a* in addition to the operation guidance and the like. An example of a screen displayed in the display section 22 will be described later in detail.

The display contents displayed in the display section 22 are controlled by, for example, the system control unit 11. The display data to be displayed in the display section 22 is stored in a storage device of the system control unit 11, such as the HDD 55, the nonvolatile memory 54 or the ROM 53. That is, the storage device (the HDD 55, the nonvolatile memory 54 or the ROM 53) of the system control unit 11 stores data such as the screen, guidance, icon or graphical image to be displayed in the display section 22.

The CPU 51 of the system control unit 11 judges user's operation contents or display contents in accordance with an operation situation of each component. Based on this judgment, the CPU 51 of the system control unit 11 executes a control in reading the display data to be displayed in the display section 22 from the HDD 55, the nonvolatile memory 54 or the ROM 53 to display the data in the display section 22. That is, the CPU 51 of the system control unit 11 controls the display of the display section 22 in accordance with the user's operation contents or the operation situation of each component. The guidance, the icon, the graphical image and the like displayed in the screen of the display section 22 are controlled by the CPU 51 of the system control unit 11 in accordance with the user's operation contents or the operation situation of each component.

Next, there will be described various operation screens to be displayed in the display section 22 of the operation panel 12, and processing in a state in which each operation screen is displayed.

First, there will be described a display example of a basic screen 70 displayed in the display section 22 of the operation panel 12, and a processing example in a state in which the basic screen 70 is displayed.

Figure 4:
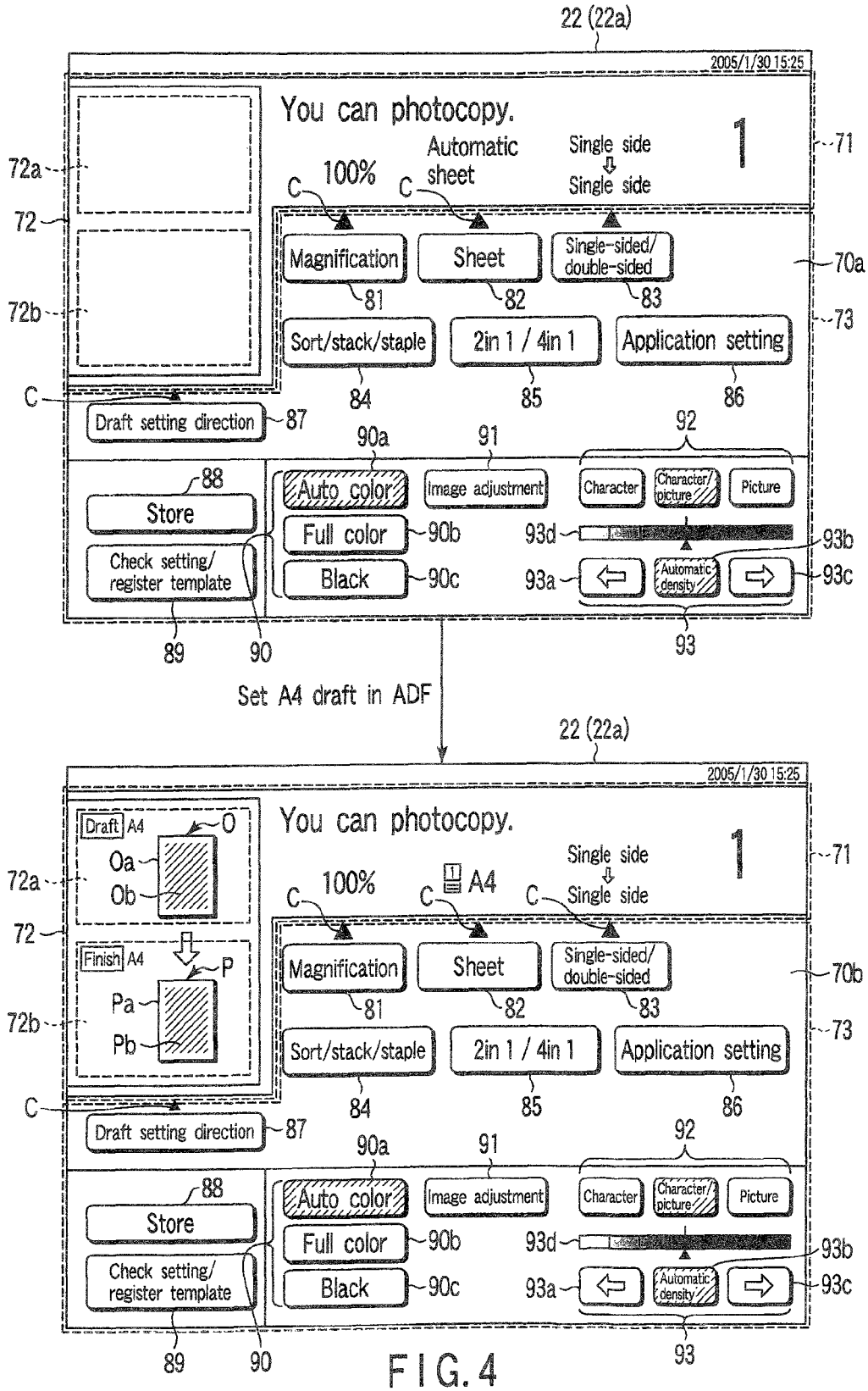
FIG. 4 is a diagram showing a display example of a basic screen in a photocopy mode.
Figure 5:
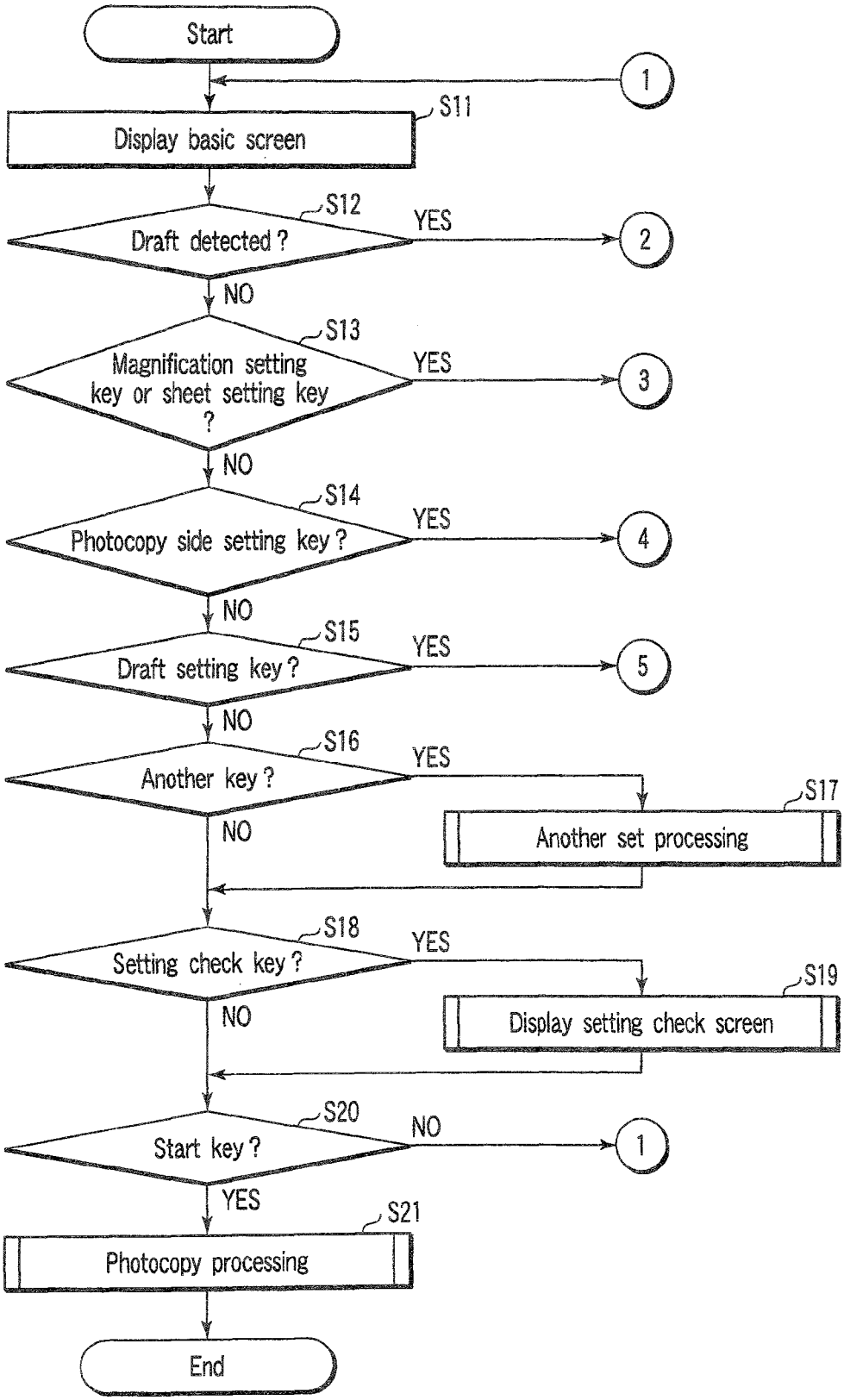
FIG. 5 is a flowchart showing a processing example in a state in which the basic screen is displayed.

FIG. 4 is a diagram showing a display example of the basic screen 70 (70*a*, 70*b*) in a photocopy mode. FIG. 5 is a flowchart showing a processing example in a state in which the basic screen 70 is displayed. It is to be noted that in the following description, there is assumed a case where the draft is set in the ADF 31.

The basic screen 70 is displayed in the display section 22 in a case where the digital multifunction peripherals has a photocopy mode. Even in a case where various set contents are set in the photocopy mode, the basic screen 70 is displayed in a state in which the set contents are reflected. The basic screen 70*a* shown in FIG. 4 shows a display example of the basic screen displayed in the display section 22 in a case where the digital multifunction peripherals is brought into a standby state in the photocopy mode (i.e., a case where various settings are brought into default set states). The basic screen 70*b* shown in FIG. 4 shows a display example of the basic screen displayed in the display section 22 in a case where an "A3" draft is set in the ADF 31 of the digital multifunction peripherals brought into the standby state.

First, in a case where the digital multifunction peripherals is brought into the photocopy mode, the CPU 51 of the system control unit 11 displays the basic screen 70*a* shown in FIG. 4 in the display section 22 of the operation panel 12 in the standby state (step S11). When the draft is set on the ADF 31 in this state (step S12, YES), the CPU 51 of the system control unit 11 performs draft size detection processing by the ADF draft size detecting function, and performs draft set processing and sheet set processing based on a detection result of the draft size. There will be described later in detail the draft set processing and the sheet set processing based on the detection result of this draft size.

In FIG. 4, each of the basic screens 70*a*, 70*b* has a display area 71 of setting information and a button display area 73 in which various icons (keys) as setting buttons are displayed. Furthermore, as shown in FIG. 4, the display area 71 of the setting information is provided with a display area 72 for displaying graphical images indicating a draft setting and a sheet setting.

In the display area 71, there are displayed a message, a magnification, a sheet size, a photocopy side (single-sided/double-sided), the number of sheets to be photocopied and the like. As the message, a present state of the digital multifunction peripherals or the like is displayed. As the magnification, the presently set magnification is displayed. As the sheet size, the presently set sheet size is displayed. As the photocopy side, the presently set mode is displayed: a mode (single-sided/single-sided mode) to photocopy a single side of the draft on a single side of the sheet; a mode (single-sided/double-sided mode) to photocopy the single side of the draft on double sides of the sheet; a mode (double-sided/single-sided mode) to photocopy the double sides of the draft on the single side of the sheet; or a mode (double-sided/double-sided mode) to photocopy the double sides of the draft on the double sides of the sheet. As the number of the sheets to be photocopied, the presently set print number (photocopy number) is displayed.

The display area 72 is provided with a first display area 72*a* and a second display area 72*b*.

In the first display area 72*a*, there is displayed information indicating the presently set draft. For example, in the first display area 72*a*, a draft graphical image O is displayed together with character information indicating the draft size. The draft graphical image O displayed in the first display area 72*a* shows the draft size, the draft disposing direction (setting direction), the direction of the image in the draft (portrait or landscape), the surface of the draft to be read (one surface or both surfaces), a state of a special setting (staple setting or the like) and the like.

The draft graphical image O is an image obtained by superimposing (synthesizing), on a graphical image (draft state image) Oa indicating the whole draft state as a draft setting, an area image (draft image area image) Ob indicating an area of the draft image on the draft and a mark (image direction mark) Oc (see, e.g., FIGS. 10 and 11) indicating the direction of the image on the draft. For example, in the basic screen 70*b* of FIG. 4, in the draft graphical image O, the draft image area image Ob is synthesized with the draft state image Oa indicating that the draft setting is "A4, vertically disposed, and single-sided".

According to such draft graphical image O, the user can visually, intuitively, and easily recognize the present draft setting.

The second display area 72*b* displays information indicating finish (sheet as a photocopy result), in a case where the sheet is printed with the present set contents. The second display area 72*b* displays a graphical image P of the finish together with the character information indicating a finish size (photocopy sheet size). The finished graphical image P displayed in the second display area 72*b* shows the size of the sheet (photocopy sheet) on which the draft image is to be printed, the direction of the sheet, the direction of the image (portrait or landscape) to be printed on the sheet, the side of the sheet to be printed (single-sided/double-sided) and the like.

The finished graphical image P is an image obtained by superimposing (synthesizing), on a graphical image (finished state image) Pa indicating the whole finish (sheet) state as a sheet setting, a graphical image (printed image area image) Pb indicating an area (printed region) of the draft image to be printed on the sheet and a mark (image direction mark) Pc (see, e.g., FIG. 10 or 11) indicating the direction of the image to be printed on the sheet. For example, in the basic screen 70*b* of FIG. 4, in the finished graphical image P, the printed image area image Pb is synthesized with the finished state image Pa indicating that the sheet setting is "A4, vertically disposed, and single-sided".

According to such finished graphical image P, the user can visually, intuitively, and easily recognize the present sheet setting, and can further easily predict the finished state.

Moreover, as shown in FIG. 4, the first display area is adjacent to the second display area. Furthermore, the draft graphical image O displayed in the first display area is associated with the finished graphical image P displayed in the second display area by a mark such as an arrow. Therefore, the user can visually and intuitively associate the set contents of the draft with those of the sheet (finish) to confirm them.

In the display area 73, there are displayed keys for setting various functions selectable by the touch panel 22*a*. The various keys displayed in the display area 73 are keys for performing various settings. The various keys displayed in the display area 73 are characters indicating the set contents and the like and icons in which patterns, graphics or the like are displayed.

The display area 73 displays: a magnification key 81; a sheet key 82; a photocopy side (single-sided/double-sided) key 83; a finishing setting (sort/stack/staple) key 84; an Nin1 (2 in1/4 in1) key 85; an application setting key 86; a draft setting (draft setting direction) key 87; a store key 88; a setting check key 89; a color mode setting portion (an auto color key 90*a*, a full color key 90*b*, and a black key 90*c*) 90, an image adjustment key 91; a draft mode setting portion (a character key 92*a*, a character picture key 92*b*, and a picture key 92*c*) 92; a density adjustment portion (a density down key 93*a*, a density up key 93*b*, an automatic density key 93*c*, and a density display portion 93*d*) 93 and the like.

The magnification key 81 is constituted of an icon in which "magnification" is displayed. The magnification key 81 is a key to be touched by the user in setting the magnification of the image to be printed on the sheet with respect to the image on the draft. When the magnification key 81 is touched (step S13, YES), the CPU 51 of the system control unit 11 displays a setting screen (magnification setting screen) for setting the magnification in the display section 22. In this case, the CPU 51 performs magnification set processing in response to the key input by the user in a state in which the magnification setting screen is displayed. It is to be noted that there will be described later in detail the magnification setting screen and the magnification set processing.

The sheet key 82 is constituted of an icon in which "sheet" is displayed. The sheet key 82 is a key to be touched by the user in setting the sheet size or the draft size. When the sheet key 82 is touched (step S13, YES), the CPU 51 of the system control unit 11 displays, in the display section 22, a setting screen (sheet setting screen) for setting the photocopy sheet size or the draft size. In this case, the CPU 51 performs the sheet set processing in response to the key input in a state in which the sheet setting screen is displayed. It is to be noted that there will be described later in detail the sheet setting screen and the sheet set processing.

The photocopy side key 83 is constituted of an icon in which "single-sided/double-sided" is displayed. The photocopy side key 83 is a key to be touched by the user in setting the photocopy side. When the photocopy side key 83 is touched (step S14, YES), the CPU 51 of the system control unit 11 displays, in the display section 22, a setting screen (photocopy side setting screen) for setting one of the single-sided/single-sided mode, the single-sided/double-sided mode, the double-sided/single-sided mode and the double-sided/double-sided mode as a photocopy side mode. In this case, the CPU 51 performs the photocopy side set processing in response to the key input in a state in which the photocopy side setting screen is displayed. It is to be noted that there will be described later in detail the photocopy side setting screen and the photocopy side set processing.

Moreover, the magnification key 81, the sheet key 82 and the photocopy side key 83 are disposed in the vicinity of the setting information display area 71. A magnification setting, a sheet setting, and a photocopy side setting are basic setting particulars having a high setting frequency among settings of the photocopy processing. Therefore, setting information such as the magnification, the sheet and the photocopy side (single-sided/double-sided) are constantly displayed in the setting information display area 71.

Moreover, the setting information display area 71 is disposed in an upper area of the display screen of the display section 22, and the button display area 73 is adjacent to the setting information display area, and is disposed in a lower area of the display screen of the display section 22. Among the setting information displayed in the setting information display area 71, the magnification, the sheet and the photocopy side (single-sided/double-sided) are disposed in positions close to the magnification key 81, the sheet key 82 and the photocopy side key 83 displayed in the button display area 73, respectively. Furthermore, the magnification key 81, the sheet key 82 and the photocopy side key 83 are associated with the magnification, the sheet and the photocopy side displayed in the setting information display area 71 by triangular graphics C, respectively.

In consequence, various types of setting information and the keys for setting the information are displayed together in the display areas, respectively, and various types of setting information displayed in the setting information display area 71 can be associated and displayed with various keys (icons) displayed in the button display area 73 so that they are easily seen.

According to such setting screen, the user can exactly and intuitively recognize the setting information displayed in the setting information display area 71 and the keys for performing the settings. In a case where, for example, the user who has seen one piece of setting information displayed in the setting information display area 71 is to change the setting, the user can immediately find the key for changing (setting) the setting information by the graphic C. Conversely, the user who is to touch the key can intuitively confirm the present setting situation of the set contents corresponding to the touched key, even unless the user consciously confirms the present setting information. Therefore, the present set contents can be prevented from being wrongly recognized or overlooked by the user. That is, such setting screen reduces operational and cognitive burdens imposed on the user in confirming the present setting situation or searching for the key to change the setting. The user can efficiently confirm or change the setting information.

The draft setting key 87 is constituted of an icon in which "draft setting direction" is displayed. The draft setting key 87 is a key to be touched in setting a direction in which the draft is to be set. When the draft setting key 87 is touched (step S15, YES), the CPU 51 of the system control unit 11 displays, in the display section 22, a draft direction setting screen for setting the draft setting direction. In this case, the CPU 51 performs the draft set processing in response to the key input in a state in which the draft direction setting screen is displayed.

It is to be noted that in a case where the ADF draft size detecting function is invalid, the draft setting key 87 is constituted of an icon in which "draft size/setting direction" is displayed. In this case, when the draft setting key 87 is touched, the CPU 51 of the system control unit 11 displays, in the display section 22, the draft setting screen (draft direction setting screen) for setting the draft size and the direction of the draft set in the ADF. In this case, the CPU 51 performs the draft set processing in response to the key input in a state in which the draft setting screen is displayed.

Moreover, as shown in FIG. 4, in the button display area 73, the draft setting key (icon) 87 is disposed in a position close to the display area 72 in which the draft graphical image and the finished graphical image are displayed. Furthermore, the draft setting key 87 is associated with the display area 72 by the triangular graphic C.

Accordingly, the draft graphical image and the finished graphical image are displayed in the display area 72 of the setting information display area 71, and the draft setting key (icon) 87 for performing the draft setting is displayed in the button display area. Moreover, the draft graphical image and the finished graphical image can be associated and displayed with the draft setting key 87 so that they are easily seen.

According to such setting screen, the user can exactly and intuitively recognize the present draft and sheet settings and the key for performing the draft setting. For example, when the user sees the draft graphical image or the finished graphical image displayed in the setting information display area 71, the user can immediately find the key for changing (setting) the image direction by the graphic C. Conversely, the user who is to touch the draft setting key 87 can visually and intuitively confirm the present draft setting and sheet setting, even unless the user consciously confirm the present setting information. That is, such setting screen reduces the user's operations in confirming the present setting situation or searching for the key to change the setting. The user can efficiently confirm or change the setting information.

The finishing (sort/stack/staple) setting key 84 is constituted of an icon in which the "sort/stack/staple" is displayed. The finishing (sort/stack/staple) setting key 84 is a key to be touched by the user in setting contents of finishing processing performed by the finisher unit 15.

In a case where the finishing setting key 84 is touched (step S16, YES), the CPU 51 of the system control unit 11 displays, in the display section 22, a setting screen (finishing setting screen) for setting the finishing (sort/stack/staple). In this case, the CPU 51 performs the finishing set processing in response to the key input in a state in which the finishing setting screen is displayed (step S17).

The Nin1 (2 in1/4in1) key 85 is constituted of an icon in which "2 in1/4 in1" is displayed. The Nin1 key 85 is a key to be touched by the user in setting photocopy in an Nin mode in which an image for N (e.g., 2 or 4) pages of the draft is to be printed on one sheet. When the Nin1 key 85 is touched (step S16, YES), the CPU 51 of the system control unit 11 displays, in the display section 22, an Nin1 setting screen for setting an Nin1 mode. In this case, the CPU 51 performs Nin1 set processing in response to the key input in a state in which the Nin1 setting screen is displayed (step S17).

The application setting key 86 is constituted of an icon in which "application setting" is displayed. The application setting key 86 is a key to be touched by the user in setting contents other than those set by each key displayed in the display area 73 or the hardware key 21. When the application setting key 86 is touched (step S16, YES), the CPU 51 of the system control unit 11 displays, in the display section 22, an application setting screen for setting application. In this case, the CPU 51 performs application set processing in response to the key input in a state in which the application setting screen is displayed (step S17).

The store key 88 is constituted of an icon in which "store" is displayed. The store key 88 is a key to be touched by the user in storing the present set contents. The setting check key 89 is constituted of an icon in which "check setting/register template" is displayed. The setting check key 89 is a key to be touched in a case where the present set contents are checked, or registered as a template. When the setting check key 89 is touched (step S18, YES), the CPU 51 of the system control unit 11 displays, in the display section 22, a setting check screen displaying the present set contents (step S19). It is to be noted that a display example of the setting check screen be described later in detail.

The color mode setting portion 90 is constituted of keys for designating a color mode. The color mode setting portion 90 is constituted of the auto color key 90*a*, the full color key 90*b*, and the black key 90*c*. The auto color key 90*a* is constituted of an icon in which "auto color" is displayed. The full color key 90*b* is constituted of an icon in which "full color" is displayed. The black key 90*c* is constituted of an icon in which "monochromatic photocopy" is displayed.

The auto color key 90*a* is a key for judging whether the draft is chromatic or monochromatic, and setting color photocopy or monochromatic photocopy in accordance with the judgment result. The full color key 90*b* is a key for setting the color photocopy. The black key 90*c* is a key for setting the monochromatic photocopy.

The image adjustment key 91 is constituted of an icon in which "image adjustment" is displayed. The image adjustment key 91 is a key to be touched in performing setting to adjust the image. In a case where the image adjustment key 91 is touched (step S19, YES), the CPU 51 displays, in the display section 22, a setting screen for setting color balance, RGB adjustment, image quality adjustment, substrate adjustment, sharpness, two-color photocopy and the like (step S17).

The draft mode setting portion 92 is a key for selecting a type of the image to be photocopied. The draft mode setting portion 92 is constituted of the character key 92*a*, the character picture key 92*b*, and the picture key 92*c*. The character key 92*a* is constituted of an icon in which "character" is displayed. The character picture key 92*b* is constituted of an icon in which "character picture" is displayed. The picture key 92*c* is constituted of an icon in which "picture" is displayed.

The character key 92*a* is a key to be selected in a case where the image to be photocopied is a binary image (image constituted of white or black pixels) or an image to be processed as the binary image. For example, since the image constituted of characters has less grey-level pixels, the image is preferably photocopied as the binary image. Therefore, in a case where the image to be photocopied is constituted of the characters, the character key 92*a* is selected.

The picture key 92*c* is a key to be selected in a case where the image to be photocopied is an image having multiple tones. For example, since an image such as a picture has many grey-level pixels, the image is preferably photocopied as the multiple-tone image. Therefore, when the image to be photocopied is constituted of the picture, the picture key 92*c* is selected.

The character picture key 92*b* is a key to be selected in a case where the image to be photocopied is an image mixed with the binary image and the multiple-tone image. For example, the character picture key 92*b* is selected, in a case where the image to be photocopied is an image mixed with the characters and the picture.

The density adjustment portion 93 is constituted of keys for setting a photocopy density. The density adjustment portion 93 is constituted of the density down key 93*a*, the density up key 93*b*, the automatic density key 93*c*, the density display portion 93*d* and the like. The density down key 93*a* is constituted of an icon in which "←" is displayed. The density up key 93*b* is constituted of an icon in which "→" is displayed. The automatic density key 93*c* is constituted of an icon in which "automatic density" is displayed. In the density display portion 93*d*, the presently set photocopy density is displayed.

The density down key 93*a* is a key to be touched in a case where the photocopy density is reduced. Every time the density down key 93*a* is touched, the photocopy density is set to gradually decrease from the presently set photocopy density. The density up key 93*b* is a key to be touched in a case where the photocopy density is increased. Every time the density up key 93*b* is touched, the photocopy density is set to gradually increase from the presently set photocopy density. The automatic density key 93*c* is a key to be touched in a case where the photocopy density is set based on a predetermined reference value.

Moreover, in a case where any key of the color mode setting portion 90, the image adjustment key 91, the draft mode setting portion 92 and the density adjustment portion 93 is touched (step S16, YES), the CPU 51 of the system control unit 11 performs processing to change the set contents in response to the input key (step S17), and the set contents are reflected in the basic screen 70.

Furthermore, in a case where the start key as the hardware key 21 is input in a state in which the basic screen 70 is displayed (step S20, YES), the CPU 51 of the system control unit 11 executes photocopy processing based on the set contents displayed in the basic screen 70 (step S21). It is to be noted that the set contents concerning the photocopy processing are held as information set in the RAM 52 as described above.

Next, there will be described a processing example of automatic draft set processing based on a detection result of the ADF draft size detecting function.

Figure 6:
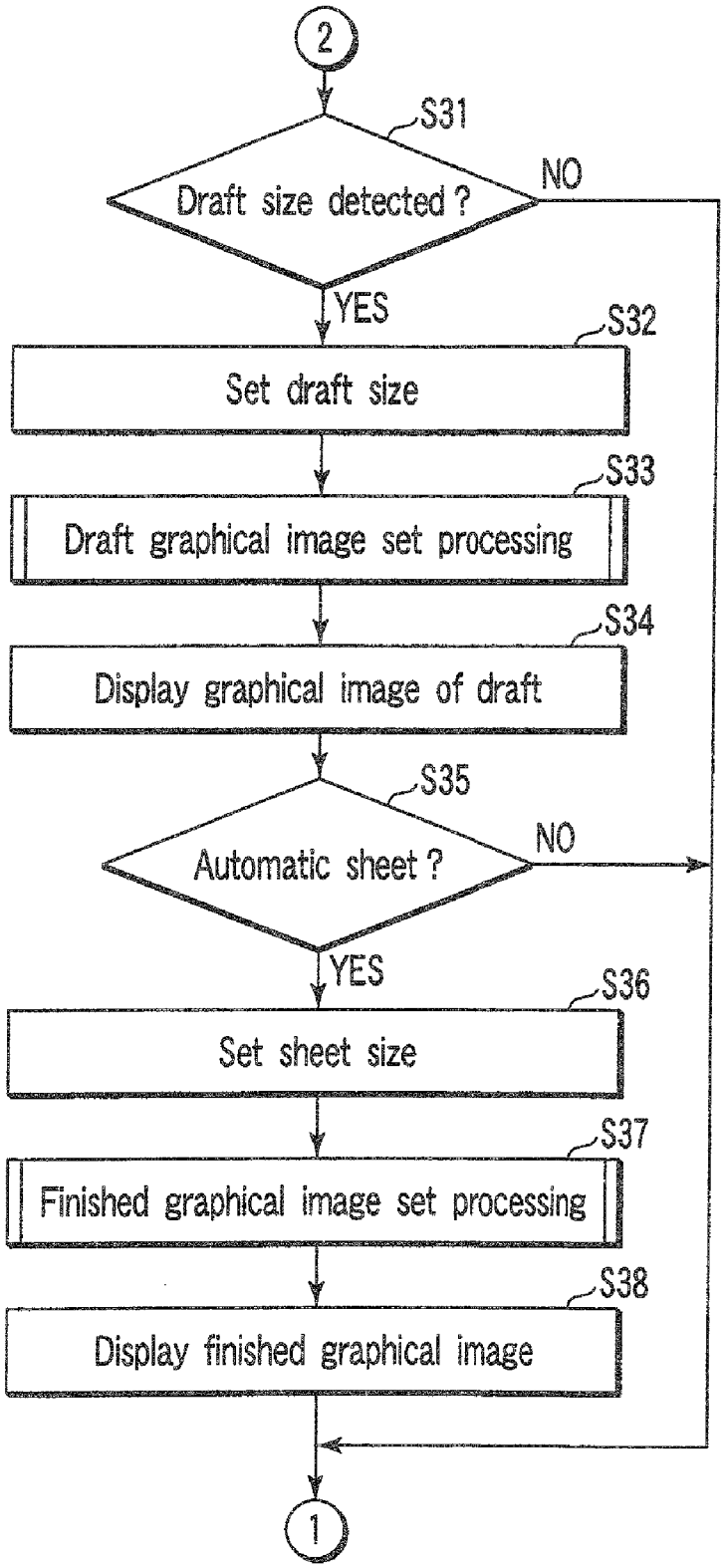
FIG. 6 is a flowchart showing a processing example of automatic draft set processing.

FIG. 6 is a flowchart showing a processing example of the automatic draft set processing. Here, it is assumed that the ADF draft size detecting function is valid. In the following description, it is assumed that the basic screen 70 is displayed in the display section 22 of the operation panel 12.

In a case where the draft is set on the draft table of the ADF 31, when the ADF draft size detecting function is effective, the CPU 51 of the system control unit 11 performs the automatic draft set processing.

First, when the draft is set on the draft table of the ADF 31, among a plurality of sensors 31*b* disposed on the draft table of the ADF 31, the sensor 31*b* corresponding to a position where the draft has been set supplies a detection signal indicating that the draft has been detected to the CPU 51 of the system control unit 11. On receiving, from any sensor 31*b*, the detection signal indicating that the draft has been detected, the CPU 51 of the system control unit 11 judges that the draft has been set on the draft table.

When it is judged that the draft has been set on the draft table of the ADF 31, the CPU 51 judges whether or not the ADF draft size detecting function is valid (step S31). In a case where the ADF draft size detecting function is invalid (step S31, NO), processing of steps S32 to S38 described later is cancelled. When the ADF draft size detecting function is valid (step S31, YES), the CPU 51 detects the size of the draft set on the draft table based on a signal indicating a position of the guide section 31*a* functioning as a draft size detector and a detection signal of each sensor 31*b* indicating whether or not the draft exists.

For example, the ADF draft size detecting function judges a length of the draft in a direction perpendicular to a direction in which the draft is conveyed by the ADF 31 based on a signal indicating the position of the guide section 31*a*. Furthermore, the ADF draft size detecting function judges a length of the draft in a direction parallel to the direction in which the draft is conveyed by the ADF 31 based on the detection signal of each sensor 31*b* indicating the presence of the draft. Therefore, the CPU 51 of the system control unit 11 judges the draft size and the draft direction based on the length of the draft in the direction perpendicular to the direction of the draft conveyed by the ADF 31 and that in the direction parallel to the direction of the draft conveyed by the ADF 31.

On judging the size and the disposing direction of the draft set in the ADF 31, the CPU 51 sets the draft size and a draft setting method as draft settings based on the judgment result (step S32). When the draft size and the draft setting direction are set, the CPU 51 performs draft graphical image set processing to set the draft graphical image O in accordance with the set draft size and setting method (step S33). When the draft graphical image O is set, the CPU 51 displays the draft graphical image O in the first display area 72*a* (step S34).

In this automatic draft set processing, there are set the draft size and the draft setting direction which are judged by the ADF draft size detecting function. Therefore, in the draft graphical image set processing, as the draft graphical image O, the draft state image Oa is set which indicates at least the draft size and the draft setting direction. The draft graphical image set processing will be described later in detail.

Moreover, when the draft size is judged by the ADF draft size detecting function, the CPU 51 judges whether or not the sheet setting mode is set to "automatic sheet" (step S35). Here, the "automatic sheet" as the sheet setting mode is a mode to set the sheet size matched with the draft size as the sheet setting. For example, when the magnification is 100%, the sheet having a size equal to that of the draft is set. It is to be noted that when the sheet setting mode is not the "automatic sheet" (step S35, NO), the CPU 51 cancels processing of steps S35 to S37 described later.

When the sheet setting mode is the "automatic sheet" (step S35, YES), the CPU 51 sets the sheet size as the sheet setting to the size (magnitude and direction) in accordance with the draft size (step S36). After setting the sheet size, the CPU 51 determines the finished graphical image P in accordance with the set sheet size (step S37).

The finished graphical image P shows a graphical image of the sheet (finish) printed based on the present set contents. Here, the sheet size (magnitude and direction) is set. Therefore, as the finished graphical image P, the graphical image is determined which indicates at least the sheet size (magnitude and direction).

As the finished graphical image P, the image matched with the sheet size is selected from a plurality of types of graphical images stored beforehand in the HDD 55, the nonvolatile memory 54, or the ROM 53. In a case where sizes such as A3, A4, A4-R, and B4 are presumed as the sheet sizes, graphical images of various sizes corresponding to the presumed sheet sizes are stored beforehand in the HDD 55, the nonvolatile memory 54, or the ROM 53. The finished graphical image P may be prepared by the CPU 51 every time the sheet size setting is changed.

In a case where the image is determined which is to be displayed as the finished graphical image P, the CPU 51 displays the determined image as the finished graphical image P in the second display area 72*b* (step S38).

According to the above-described automatic draft set processing, the size judged by the ADF draft size detecting function is set as the draft size, and the draft graphical image indicating the draft size is displayed in the first display area. Accordingly, the user can visually and intuitively confirm the draft size (magnitude and direction) judged by the ADF draft size detecting function.

Furthermore, in a case where the "automatic sheet" is set as the sheet setting mode, the size judged by the ADF draft size detecting function in accordance with the draft size is set as the sheet size, and the finished graphical image indicating the sheet size is displayed in the second display area. Accordingly, the user can visually confirm the size of the photocopy sheet (finish) together with the draft size (magnitude and direction).

Next, there will be described photocopy magnification and sheet set processing.

Here, there will be described a display example of the magnification and sheet setting screen (magnification/sheet setting screen) and processing examples of the magnification set processing and the sheet set processing in a state in which the magnification/sheet setting screen is displayed.

Figure 7:
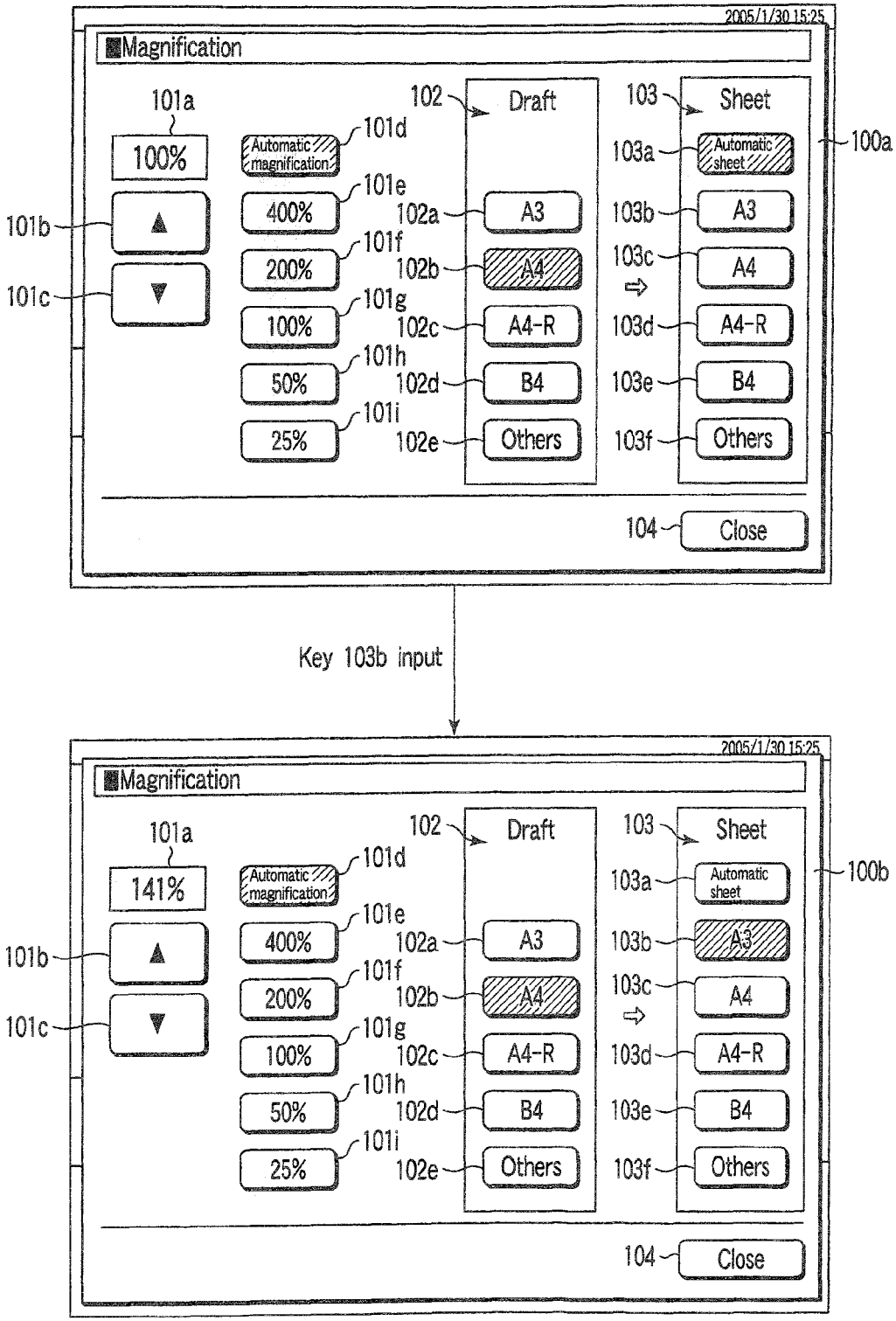
FIG. 7 is a diagram showing a first display example of a magnification/sheet setting screen.
Figure 8:
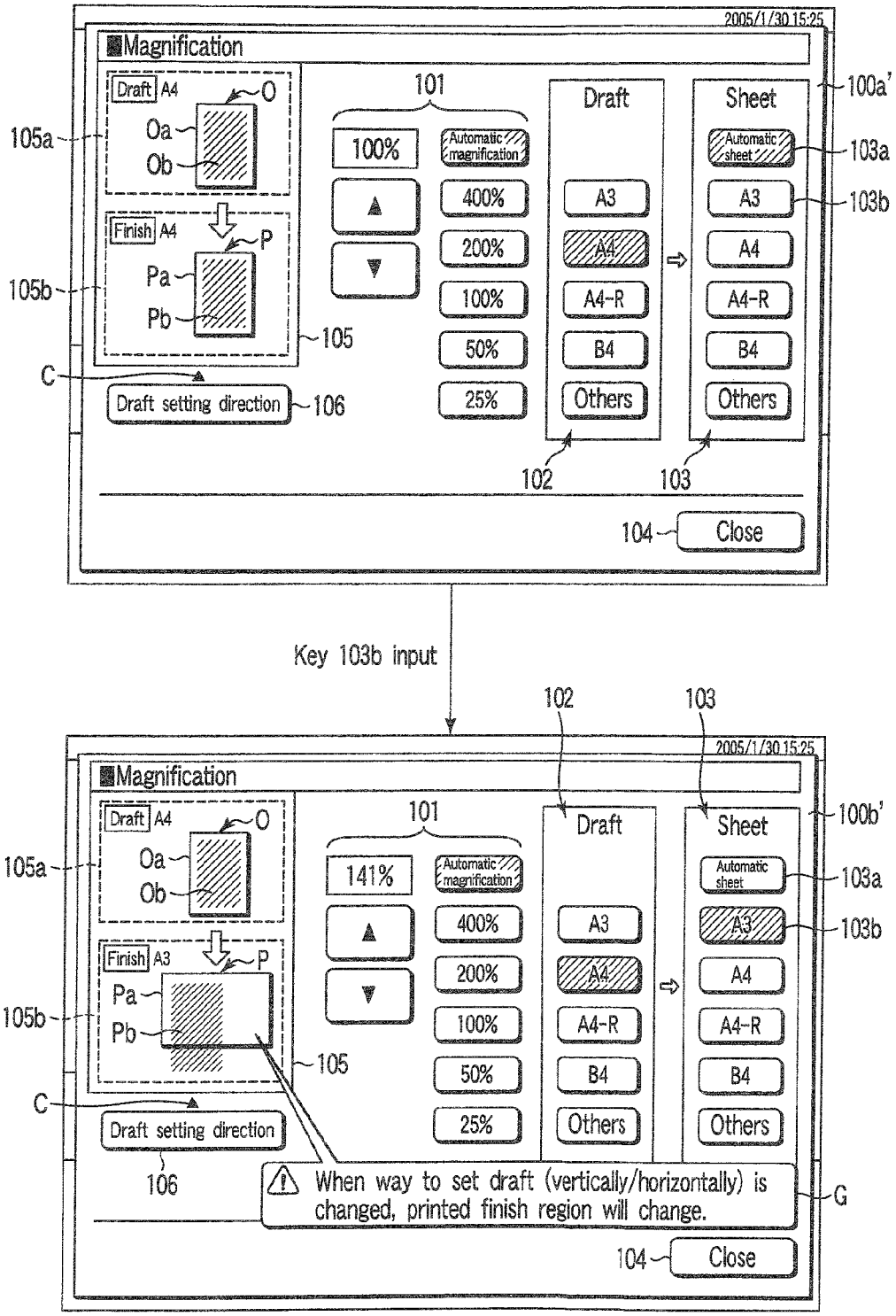
FIG. 8 is a diagram showing a second display example of the magnification/sheet setting screen.

FIG. 7 is a diagram showing a first display example of a magnification/sheet setting screen 100. FIG. 8 is a diagram showing a second display example of a magnification/sheet setting screen 100'. FIG. 7 shows, as first display examples, display examples of a magnification/sheet setting screen 100*a* in a case where the draft setting is "A4 and vertical" and the sheet setting is the "automatic sheet" and a magnification/sheet setting screen 100*b* in a case where the sheet setting is changed to "A3 and horizontal". FIG. 8 shows, as second display examples, display examples of a magnification/sheet setting screen 100*a'* in a case where the draft setting is "A4 and vertical" and the sheet setting is the "automatic sheet" and a magnification/sheet setting screen 100*b'* in a case where the sheet setting is changed to "A3 and horizontal".

It is to be noted that in the magnification/sheet setting screen 100' shown in FIG. 8, display contents of the magnification/sheet setting screen 100 shown in FIG. 7 further include a display area 105 having a first display area 105*a* and a second display area 105*b*, and a draft setting key 106. The first display area 105*a* and the second display area 105*b* are areas where contents are displayed which are similar to those of the first display area 72*a* and the second display area 72*b* displayed in the basic screen 70, respectively. That is, the draft graphical image O is displayed in the first display area 72*a*, and the finished graphical image P is displayed in the second display area 72*b*. The draft setting key 106 is a key to be touched in a case where the direction of the image in the draft is set in the same manner as in the draft setting key 87 of the basic screen 70*b*.

In the display examples shown in FIGS. 7 and 8, the same setting screen (magnification/sheet setting screen) is used as a photocopy magnification setting screen and a sheet size and draft size setting screen. This is because, for example, in a case where the draft size and the sheet size are determined, a photocopy magnification (optimum photocopy magnification) is determined at which the whole draft image just fits the photocopy sheet. Conversely, in a case where the draft size and the photocopy magnification are determined, a sheet size (optimum sheet size) is determined in which the whole draft image can be printed. Since the photocopy magnification setting is closely related to the photocopy sheet setting in this manner, the photocopy magnification and the sheet size can be set in the same screen.

In the magnification/sheet setting screen 100 shown in FIG. 7 or the magnification/sheet setting screen 100' shown in FIG. 8, there are displayed a magnification setting section 101, a draft size setting section 102, a sheet setting section 103, and a close key 104.

The magnification setting section 101 is constituted of a magnification display portion 101*a*, a magnification up key 101*b*, a magnification down key 101*c*, an automatic magnification key 101*d*, a 400% key 101*e*, a 200% key 101*f*, a 100% key 101*g*, a 50% key 101*h*, a 25% key 101*i* and the like. In the magnification display portion 101*a*, the presently set photocopy magnification is displayed. The magnification up key 101*b* is touched when increasing the photocopy magnification every percentage. The magnification down key 101*c* is touched when decreasing the photocopy magnification every percentage. The automatic magnification key 101*d* is a key brought into a selected state, in a case where the magnification is set in accordance with the draft size and the sheet size. The 400% key 101*e*, the 200% key 101*f*, the 100% key 101*g*, the 50% key 101*h*, and the 25% key 101*i* are touched in a case where the photocopy magnification is set to 400%, 200%, 100%, 50%, and 25%, respectively.

The draft size setting section 102 is constituted of an A3 key 102*a*, an A4 key 102*b*, an A4-R key 102*c*, a B4 key 102*d*, another key 102*e* and the like. The A3 key 102*a*, the A4 key 102*b*, the A4-R key 102*c*, and the B4 key 102*d* are keys to be touched in a case where the draft setting is set to A3 (A3 and horizontal), A4 (A4 and vertical), A4-R (A4 and horizontal), and B4 (B4 and vertical), respectively. The other key 102*e* is a key to be touched in a case where the draft size is set to a size other than A3, A4, A4-R, and B4. In a case where the draft size detecting function is valid, in an initial state, the key is brought into the selected state in the draft size setting section 102, the key corresponding to the draft having a size and a direction (setting direction) detected by the draft size detecting function.

The sheet size setting section 103 is constituted of an automatic sheet setting key 103*a*, an A3 key 103*b*, an A4 key 103*c*, an A4-R key 103*d*, a B4 key 103*e*, another key 103*f* and the like. The automatic sheet setting key 103*a* is a key brought into the selected state in a case where the sheet is set in accordance with the draft size and the photocopy magnification. For example, in a case where the automatic sheet setting key 103*a* is brought into the selected state, when the photocopy magnification is 100%, a sheet is selected which has a size equal to that of the draft. The A3 key 103*b*, the A4 key 103*c*, the A4-R key 103*d*, and the B4 key 103*e* are keys to be touched in a case where the sheet size is set to A3 (A3 and horizontal), A4 (A4 and vertical), A4-R (A4 and horizontal), and B4 (B4 and vertical), respectively. The other key 103*f* is a key to be touched in a case where the sheet having a size other than A3, A4, A4-R, and B4 is set.

The close key 104 is a key to be touched in a case where the settings of the magnification and the sheet have been completed. When the close key 104 is touched, the display section 22 displays the basic screen 70 in which the settings of the magnification and the sheet set in the magnification/sheet setting screen have been reflected.

Next, there will be described processing examples of the magnification set processing and the sheet set processing.

Figure 9:
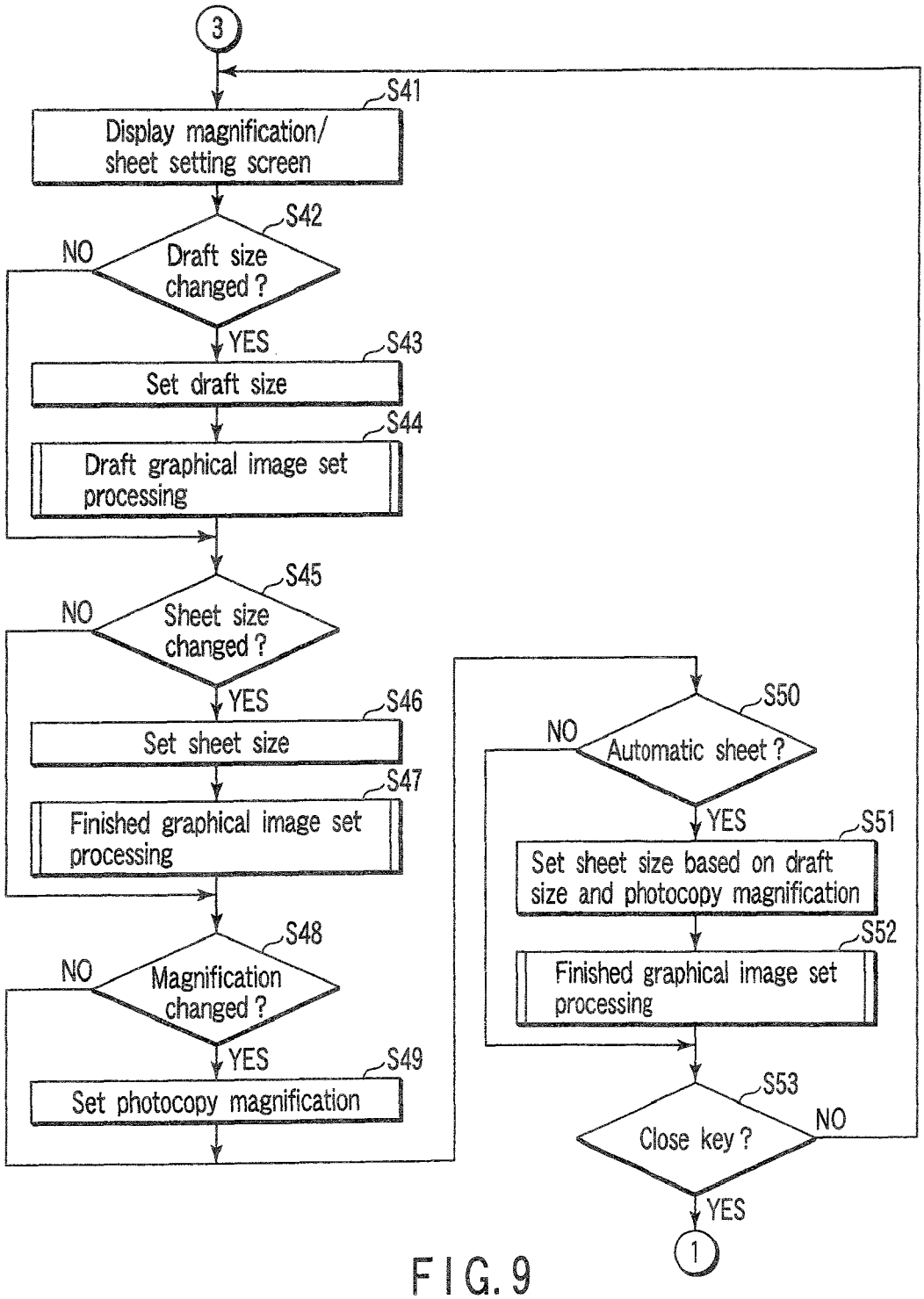
FIG. 9 is a flowchart showing processing examples of magnification set processing and sheet set processing.

FIG. 9 is a flowchart showing the processing examples of the magnification set processing and the sheet set processing in a state in which the magnification/sheet setting screen 100 shown in FIG. 7 or the magnification/sheet setting screen 100' shown in FIG. 8 is displayed.

When the magnification key 81 or the sheet key 82 is touched in the basic screen 70, the CPU 51 of the system control unit 11 displays, in the display section 22, the magnification/sheet setting screen 100 in which the present set contents have been reflected (step S41). For example, when the magnification is "100%", the draft setting is "A4 and vertical", and the sheet setting (sheet setting mode) is "automatic sheet", as shown in FIG. 7, the display section 22 displays the magnification/sheet setting screen 100 in which the magnification is "100%", the draft setting is "A4 (A4 vertical)", and the sheet is "automatic sheet".

In a case where any key (102*a* to 102*e*) of the draft setting section 102 is input in a state in which the magnification/sheet setting screen 100 is displayed, the CPU 51 brings the input key into the selected state (a display color of the key is changed), and judges that the draft setting has been changed (step S42, YES). When it is judged that the draft setting has been changed, the CPU 51 sets the draft setting (magnitude or setting direction) corresponding to the input key (step S43). Furthermore, when the draft setting is changed, the CPU 51 sets the draft graphical image O in accordance with the draft setting (step S44).

For example, as shown in FIGS. 7 and 8, in a case where the "A4" key 102*b* is brought into the selected state, the CPU 51 sets the draft setting to be "A4 and vertical". When the draft is set to be "A4 and vertical", the CPU 51 sets the graphical image corresponding to "A4 and vertical" as the draft state image Oa of the draft graphical image O. The CPU 51 sets the image of the draft image area in the "A4 and vertical" draft as the draft image area image Ob of the draft graphical image O.

It is to be noted that as shown in FIG. 8, in a case where the magnification/sheet setting screen 100' is provided with the first display area 105*a*, the CPU 51 displays the set draft graphical image O in the first display area 105*a*.

Moreover, when any key (103*b* to 102*f*) of the sheet setting section 103 is input, the CPU 51 brings the input key into the selected state (changes the display color of the key), and judges that the sheet setting (finished sheet setting) has been changed (step S45, YES). When it is judged that the sheet setting has been changed, the CPU 51 changes the sheet setting to the set contents corresponding to the input key (step S46). It is to be noted that when the "automatic sheet" key 103*a* is input, the CPU 51 performs the sheet setting as described later in steps S51, S52. When the sheet size setting is changed, the CPU 51 sets the finished graphical image P in accordance with the sheet setting (step S47).

For example, in a case where the user touches the "A3" key 103*b* in the magnification/sheet setting screen 100 in which the "automatic magnification" key 103*a* is brought into the selected state, the CPU 51 brings the "A3" key 103*b* into the selected state, and sets the sheet setting to be "A3 and horizontal". When the sheet setting is set to be "A3 and horizontal", the CPU 51 sets the graphical image indicating "A3 and horizontal" as the finished state image Pa of the finished graphical image P.

Moreover, in this case, since the magnification setting (magnification setting mode) is set to the "automatic magnification", the photocopy magnification is set to "141%" based on the draft size "A4" and the sheet size "A3". Therefore, the CPU 51 sets an image area image obtained by enlarging the draft image area image Ob to 141% as the printed image area image Pb of the finished graphical image P.

It is to be noted that in the finished graphical image P, the printed image area image Pb is superimposed on the finished state image Pa in a state in which an upper left portion of the printed image area image is aligned with that of the finished state image. For example, when the magnification/sheet setting screen 100' is provided with the second display area 105*b* as shown in FIG. 8, the CPU 51 displays the set finished graphical image P in the second display area 105*b*.

Moreover, in the example shown in FIG. 8, the printed image area image Pb of the finished graphical image P protrudes from a region of the finished state image Pa. In such case, as shown in FIG. 8, there is displayed the guidance display section G associated with the finished graphical image P. In the example shown in FIG. 8, the guidance display section G displays a guidance indicating "when a way (vertical/horizontal) to set the draft is changed, a printed region of the finish changes". Such guidance display section G is set together with the finished graphical image P in the set processing of the finished graphical image as described later.

Furthermore, when any key (101*b* to 101*i*) of the magnification setting section 101 is input, the CPU 51 of the system control unit 11 judges that the photocopy magnification has been changed (step S48, YES). When it is judged that the photocopy magnification has been changed, the CPU 51 of the system control unit 11 displays the magnification in response to the input key in the magnification display portion 101*a*, and sets the photocopy magnification in response to the input key (step S49). When the "automatic magnification" key 101*d* is input, the CPU 51 calculates an optimum magnification in accordance with the draft size and the sheet size.

This calculated magnification is displayed in the magnification display portion 101*a*, and set as the photocopy magnification.

Moreover, in a case where the draft size or the photocopy magnification is changed in a state in which the "automatic sheet" is set as the sheet setting mode (step S50, YES), the CPU 51 performs the processing (automatic sheet set processing) to set the sheet in accordance with the draft size and the photocopy magnification. Even in a case where the "automatic sheet" key 103*a* is input in a state in which a specific sheet is set (step S50, YES), the CPU 51 performs the processing (automatic sheet set processing) to set the sheet in accordance with the draft size and direction and the photocopy magnification.

In the automatic sheet set processing, the CPU 51 judges an optimum sheet (size and direction) based on the draft size, the draft setting direction, and the photocopy magnification. On judging the optimum sheet, the CPU 51 sets the judged sheet (step S51). Furthermore, when the sheet setting is changed, the CPU 51 sets the finished graphical image P in accordance with the set sheet setting (step S52).

It is to be noted that when the magnification/sheet setting screen 100' is provided with the second display area 105*b* as shown in FIG. 8, the CPU 51 displays the set finished graphical image P in the second display area 105*b*.

Moreover, when the close key 104 is input, the CPU 51 ends the magnification and sheet set processing. In this case, the CPU 51 changes, to the basic screen 70, the set screen displayed in the display section 22. It is to be noted that in the basic screen 70, the first display area 72*a* displays the draft graphical image O set in the magnification and sheet set processing, and the second display area 72*b* displays the finished graphical image P set in the magnification and sheet set processing.

Moreover, in a case where the above-described magnification set processing sets the magnification to a setting which is different from the default setting, the CPU 51 displays, in the basic screen 70, the magnification key 81 in a specific color different from that of the default setting. For example, when the magnification has a default setting state, the magnification key 81 is displayed in white. When the setting has a state different from that of the default setting, the magnification key 81 is displayed in blue.

Similarly, in a case where the above-described sheet set processing sets the sheet to a setting which is different from the default setting, the CPU 51 displays, in the basic screen 70, the sheet key 82 in a color different from that of the default setting. For example, when the sheet has a default setting state, the sheet key 82 is displayed in white. When the setting has a state different from that of the default setting, the sheet key 82 is displayed in blue.

As described above, as to a particular having a setting which is different from the default setting, the basic screen 70 displays the setting key corresponding to the setting particular is displayed in a specific color. In consequence, the user can easily recognize the setting particular (particular whose setting has been changed in a lower-layer setting screen) brought into a setting different from the default setting in the basic screen (uppermost setting screen) 70. Furthermore, the user can easily recognize the present set contents by referring to the setting information (magnification or sheet) in the setting information display area 71, because the information is associated with each key by the graphic C.

Next, draft setting will be described.

The draft setting includes the draft size, the draft direction (setting direction), and the direction of the image (portrait or landscape) in the draft. The draft size and direction are detectable by the ADF draft size detecting function. That is, when the ADF draft size detecting function is valid, the size and setting direction of the draft set in the ADF 31 are judged by the ADF draft size detecting function. Therefore, as to the draft setting, there will be described a case where the ADF draft size detecting function is valid and a case where the ADF draft size detecting function is invalid.

First, there will be described the draft setting in a case where the ADF draft size detecting function is valid.

Figure 10:
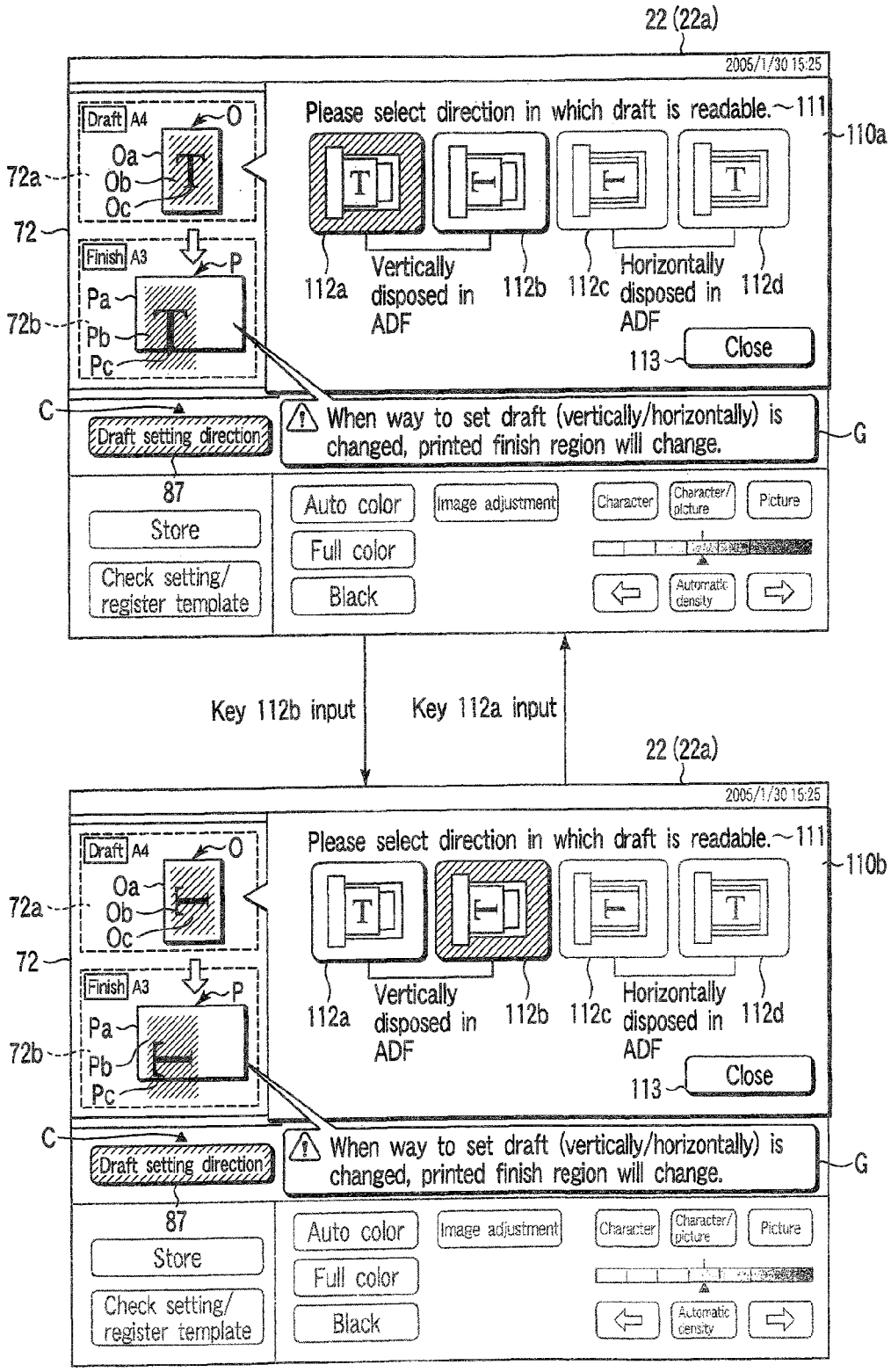
FIG. 10 is a diagram showing a display example of a draft direction setting screen in a case where a draft vertically set in an ADF is detected.
Figure 11:
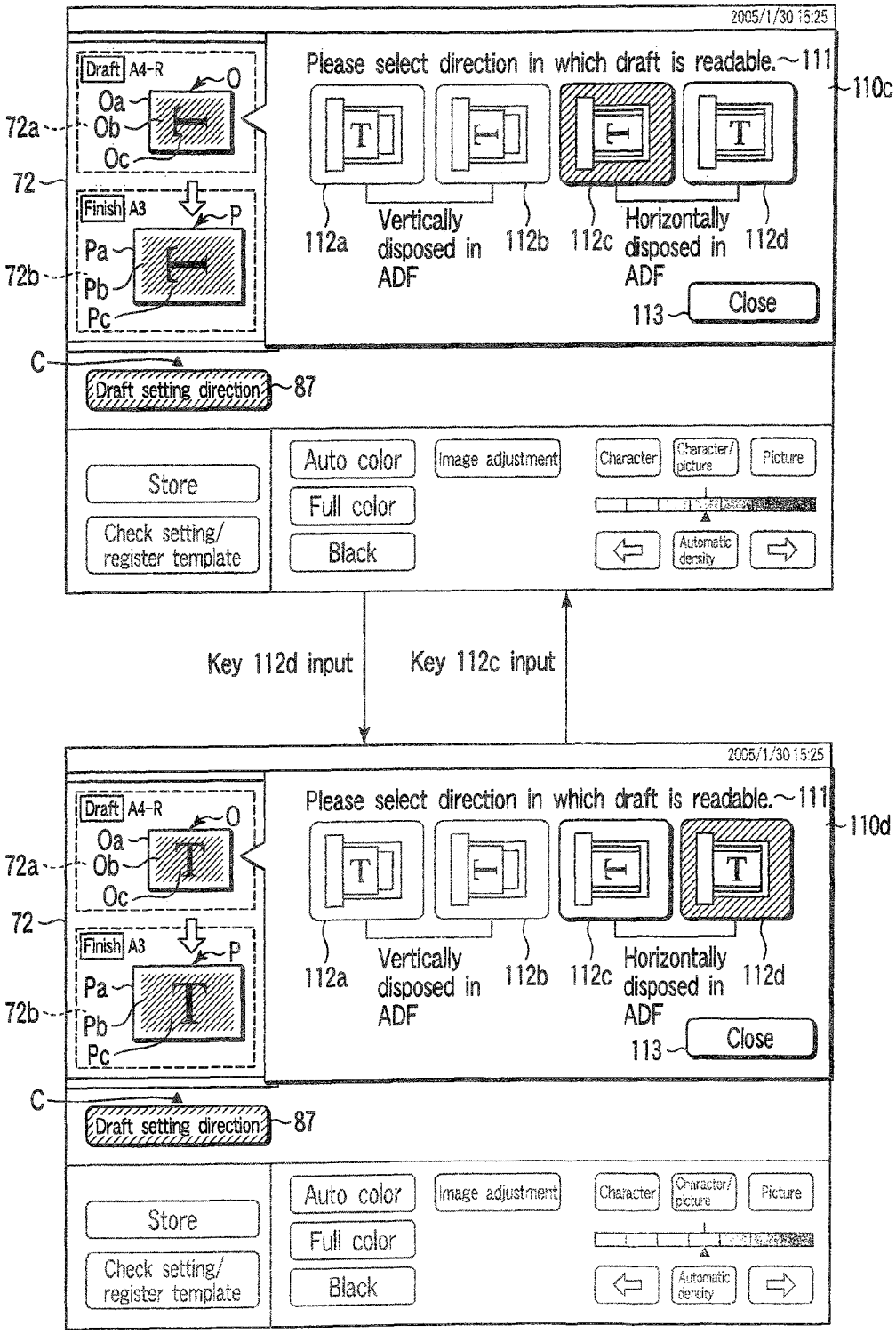
FIG. 11 is a diagram showing a display example of a draft direction setting screen in a case where a draft horizontally set in the ADF is detected.

FIGS. 10 and 11 are diagrams showing display examples of a draft direction setting screen 110 in a case where the ADF draft size detecting function is valid.

FIG. 10 is a diagram showing a display example of the draft direction setting screen 110 (110*a*, 110*b*) in a case where the draft setting as the detection result of the ADF draft size detecting function is "A4 and vertical (vertically disposed)" and the sheet setting is "A3 and horizontal". Here, it is assumed that the vertically disposing means a state in which the draft is set in the ADF 31 so that the direction of the draft conveyed by the ADF 31 is perpendicular to a longitudinal direction of the draft.

Moreover, FIG. 11 is a diagram showing a display example of the draft direction setting screen 110 (110*c*, 110*d*) in a case where the draft setting is "A4 and horizontal (horizontal disposed)" which is the detection result of the ADF draft size detecting function and the sheet setting is "A3 and horizontal". Here, it is assumed that the horizontally disposing means a state in which the draft is set in the ADF 31 so that the direction of the draft conveyed by the ADF 31 is parallel to the longitudinal direction of the draft.

The draft direction setting screen 110 (110*a*, 110*b*, 110*c*, and 110*d*) is displayed as a popup window in a partial area of the basic screen 70 as shown in FIGS. 10 and 11. The draft direction setting screen 110 displays a guidance display area 111, a vertically disposed portrait key 112*a*, a vertically disposed landscape key 112*b*, a horizontally disposed portrait key 112*c*, a horizontally disposed landscape key 112*d*, and a close key 113.

The draft direction setting screen 110 is displayed as the popup window in a state in which the first display area 72*a*, the second display area 72*b* and the draft setting key 87 of the basic screen 70 remain to be displayed. Furthermore, the draft direction setting screen 110 is associated with the first display area 72*a* by symbols, graphics or the like. In the first display area 72*a*, the draft graphical image O is displayed in accordance with the draft setting described later. In the second display area 72*b*, the finished graphical image P is displayed in accordance with the sheet setting.

The guidance display area 111 displays a guidance indicating that the direction of the image in the draft be selected. The close key 113 is touched in a case where the setting is ended. When the close key 113 is touched, in the display section 22, the draft direction setting screen 110 is closed, and the basic screen 70 is displayed in which the set contents are reflected.

It is to be noted that in a case where the draft direction setting screen 110 is displayed, the storage key, color mode setting section, image adjustment key, draft mode setting section, density setting portion and the like in the basic screen 70*b* are displayed to be thin, and displayed in a state (whiteout) in which they cannot be selected.

Moreover, in the display example shown in FIGS. 10 and 11, the sheet setting is set to be "A3 and horizontal". Therefore, in a case where the draft is set to be "A4 and vertical", that is, the draft having the size "A4" is "vertically disposed", as shown in FIG. 10, the printed image area image Pb protrudes from a region of the finished state image Pa in the finished graphical image P displayed in the second display area 72*b*.

On the other hand, in a case where the draft is set to be "A4 and horizontal", that is, the draft having the size "A4" is "horizontally disposed", as shown in FIG. 11, the printed image area image Pb falls in a region of the finished state image Pa in the finished graphical image P displayed in the second display area 72*b*.

To notify the user of the finished state with respect to such draft setting direction, in a case where the printed image area image Pb protrudes from the region of the finished state image Pa, the CPU 51 displays the guidance display section G as shown in FIG. 10. As shown in FIG. 10, the guidance display section G displays an operation guidance so that the whole draft image falls in the sheet. In the example shown in FIG. 10, the guidance display section G displays a guidance indicating "when the way (vertical/horizontal) to set the draft is changed, the finished print region changes". This guidance is an operation guidance to change the draft setting direction so that the whole draft image is printed on the sheet.

It is to be noted that there will be described later in detail the set processing of the draft graphical image O and the set processing of the finished graphical image including the guidance display section G.

Moreover, in a case where the ADF draft size detecting function is valid in the draft direction setting screen 110, as shown in FIG. 10 or 11, a selectable key is limited based on the draft setting direction detected by the ADF draft size detecting function.

For example, as shown in FIG. 10, in a case where the draft vertically set in the ADF 31 is detected, the vertically disposed portrait key 112*a* and the vertically disposed landscape key 112*b* are displayed in selectable states (become valid) in the draft direction setting screen 110 (110*a*, 110*b*). In this case, the horizontally disposed portrait key 112*c* and the horizontally disposed landscape key 112*d* are displayed to be thin, and displayed in non-selectable states (whiteout).

Moreover, as shown in FIG. 11, in a case where the draft horizontally set in the ADF 31 is detected, the horizontally disposed portrait key 112*c* and the horizontally disposed landscape key 112*d* are displayed in the selectable states (become valid) in the draft direction setting screen 110 (110*c*, 110*d*). In this case, the vertically disposed portrait key 112*a* and the vertically disposed landscape key 112*b* are displayed to be thin, and displayed in non-selectable states (whiteout).

The vertically disposed portrait key 112*a* is a key to be selected in a case where the direction of the image in the draft vertically disposed in the ADF 31 is that of the portrait. When the vertically disposed portrait key 112*a* is touched, the draft (set in the ADF 31) is set to the vertically disposed portrait. In this case, the draft graphical image O displayed in the display area 72*a* indicates "the draft size and the vertically disposed portrait". It is to be noted that in the draft graphical image O, the draft size and setting direction are indicated by the draft state image Oa, and the direction of the image in the draft is indicated by the draft image area image Ob and the image direction mark Oc.

For example, in the draft direction setting screen 110*a* shown in FIG. 10, the vertically disposed portrait key 112*a* is brought into the selected state. In this draft direction setting screen 110*a*, the first display area 72*a* displays the draft graphical image O indicating "A4, vertically disposed, and portrait", and the second display area 72*b* displays the finished graphical image P indicating "A3, horizontal, and portrait" and corresponding to the draft graphical image O. Furthermore, in the finished graphical image P of the draft direction setting screen 110*a*, the printed image area image Pb protrudes from the finished state image Pa, and the guidance display section G is displayed.

The vertically disposed landscape key 112*b* is a key to be selected in a case where the direction of the image in the draft vertically disposed in the ADF 31 is that of the landscape. When the vertically disposed landscape key 112*b* is touched, the draft (set in the ADF 31) is set to the vertically disposed landscape draft. In this case, the draft graphical image O displayed in the display area 72*a* indicates "draft size, the vertically disposed, and landscape".

For example, in the draft direction setting screen 110*b* shown in FIG. 10, the vertically disposed landscape key 112*b* is brought into the selected state. In this draft direction setting screen 110*b*, the first display area 72*a* displays the draft graphical image O indicating "A4, vertically disposed, and landscape", and the second display area 72*b* displays the finished graphical image P indicating "A3, horizontal, and landscape (corresponding to draft)" and corresponding to the draft graphical image O. Furthermore, in the finished graphical image P of the draft direction setting screen 110*b*, the printed image area image Pb protrudes from the finished state image Pa, and the guidance display section G is displayed.

The horizontally disposed portrait key 112*c* is a key to be selected in a case where the direction of the image in the draft horizontally disposed in the ADF 31 is that of the portrait. When the horizontally disposed portrait key 112*c* is touched, the draft (set in the ADF 31) is set to a horizontally disposed portrait draft. In this case, the draft graphical image displayed in the display area 72*a* indicates "draft size, horizontally disposed, and portrait".

For example, in the draft direction setting screen 110*c* shown in FIG. 11, the horizontally disposed portrait key 112*c* is brought into the selected state. In this draft direction setting screen 110*c*, the first display area 72*a* displays the draft graphical image O indicating "A4, horizontally disposed, and portrait", and the second display area 72*b* displays the finished graphical image P indicating "A3, horizontal, and portrait" and corresponding to the draft graphical image O. In the finished graphical image P of the draft direction setting screen 110*c*, the printed image area image Pb is displayed in the finished state image Pa. Therefore, the guidance display section G is not displayed.

The horizontally disposed landscape key 112*d* is a key to be selected in a case where the direction of the image in the draft horizontally disposed in the ADF 31 is that of the landscape. When the horizontally disposed landscape key 112*d* is touched, the draft (set in the ADF 31) is set to the horizontally disposed landscape draft. In this case, the draft graphical image O displayed in the display area 72*a* indicates "draft size, horizontally disposed, and landscape".

For example, in the draft direction setting screen 110*d* shown in FIG. 11, the horizontally disposed landscape key 112*d* is brought into the selected state. In this draft direction setting screen 110*d*, the first display area 72*a* displays the draft graphical image O indicating "A4, horizontally disposed, and landscape", and the second display area 72*b* displays the finished graphical image P indicating "A3, horizontal, and landscape (corresponding to the draft)" and corresponding to the draft graphical image O. In the finished graphical image P of the draft direction setting screen 110*d*, the printed image area image Pb is displayed in the finished state image Pa. Therefore, the guidance display section G is not displayed.

It is to be noted that as to the direction of the image in the draft, a default may be set to the portrait or the landscape. For example, in a case where the direction of the image in the draft is set as the default to the portrait, when the ADF draft size detecting function detects the vertically disposed draft, the draft setting is set as default setting to the vertically disposed portrait draft.

Next, there will be described draft setting in a case where the ADF draft size detecting function is invalid.

Figure 12:
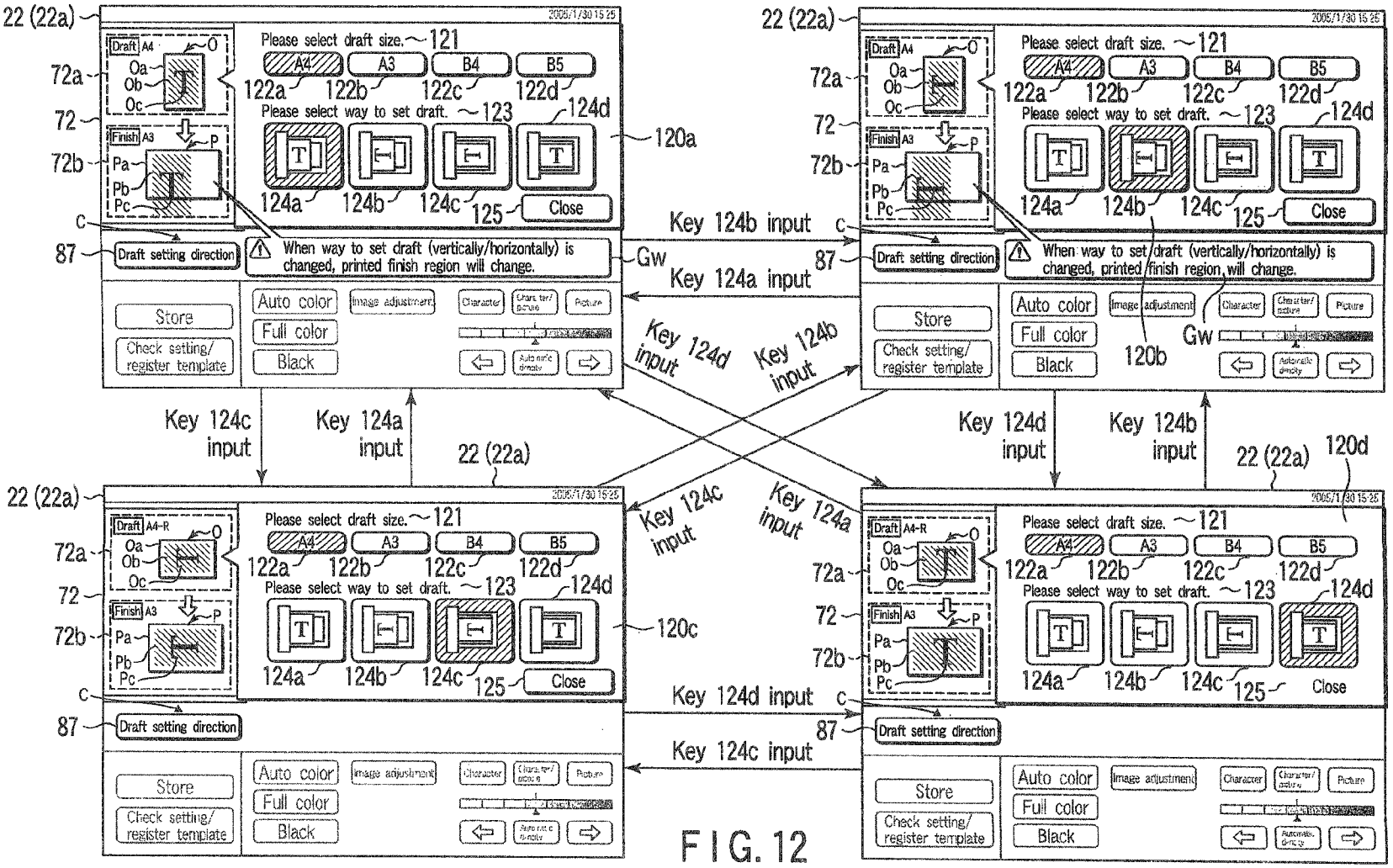
FIG. 12 is a diagram showing a display example of a draft setting screen in a case where an ADF draft size detecting function is invalid.

FIG. 12 is a diagram showing display examples of a draft direction setting screen 120 (120*a*, 120*b*, 120*c*, and 120*d*) in a case where a draft size detecting function is invalid which detects the size of the draft set in the ADF 31. When the draft size detecting function of detecting the size of the draft set in the ADF is invalid, the size and the direction of the draft set in the ADF 31 are set in the draft direction setting screens 120 (120*a*, 120*b*, 120*c*, and 120*d*) shown in FIG. 12.

As shown in FIG. 12, the draft direction setting screen 120 is displayed as a popup window in the basic screen 70. The draft direction setting screen 120 displays: a guidance display area 121; a draft size selection key 122 (an "A4" key 122*a*, an "A3" key 122*b*, a "B4" key 122*c*, and a "B5" key 122*d*); a guidance display area 123; a draft setting direction key 124 (a vertically disposed portrait key 124*a*, a vertically disposed landscape key 124*b*, a horizontally disposed portrait key 124*c*, and a horizontally disposed landscape key 124*d*); and a close key 125.

Moreover, the draft direction setting screen 120 is displayed as the popup window so that the first display area 72*a*, the second display area 72*b* and the draft setting key 87 in the basic screen 70 remain to be displayed. Furthermore, the draft direction setting screen 120 is displayed in association with the first display area 72*a* by marks, graphics or the like. It is to be noted that when the draft direction setting screen 120 is displayed, the ADF draft size detecting function is invalid. Therefore, the draft setting key 87 is constituted of an icon in which "draft size/direction" is displayed.

It is to be noted that in a state in which the draft direction setting screen 120 is displayed, keys, guidance displays and the like other than the first display area 72*a*, the second display area 72*b* and the draft setting key 87 in the basic screen 70 are displayed to be thin, and they are displayed in a state in which they cannot be selected (whiteout).

The guidance display area 121 displays a guidance indicating that the draft size be selected. The draft size selection key 122 is constituted of the "A4" key 122*a*, the "A3" key 122*b*, the "B4" key 122*c*, and the "B5" key 122*d*. The "A4" key 122*a*, the "A3" key 122*b*, the "B4" key 122*c* and the "B5" key 122*d* are keys for selecting "A4", "A3", "B4", and "B5" as the draft sizes, respectively.

The draft setting direction key 124 is constituted of the vertically disposed portrait key 124*a*, the vertically disposed landscape key 124*b*, the horizontally disposed portrait key 124*c*, and the horizontally disposed landscape key 124*d*.

The vertically disposed portrait key 124*a* is a key to be selected in a case where the draft set in the ADF 31 is vertically disposed, and the direction of the image in the draft is that of the portrait. When the vertically disposed portrait key 124*a* is touched, the draft (set in the ADF 31) is set to "vertically disposed portrait". In this case, the first display area 72*a* displays the graphical image O indicating the vertically disposed draft of the portrait.

For example, in the draft direction setting screen 120*a* shown in FIG. 12, the vertically disposed portrait key 124*a* is brought into the selected state. In this draft direction setting screen 120*a*, the first display area 72*a* displays the draft graphical image O indicating "A4, vertically disposed, and portrait", and the second display area 72*b* displays the finished graphical image P indicating "A3, horizontal, and portrait" and corresponding to the draft graphical image O. Furthermore, in the finished graphical image P of the draft direction setting screen 120*a*, the printed image area image Pb protrudes from the finished state image Pa, and the guidance display section G is displayed.

The vertically disposed landscape key 124*b* is a key to be selected in a case where the draft set in the ADF 31 is vertically disposed, and the direction of the image in the draft is that of the landscape. When the vertically disposed landscape key 124*b* is touched, the draft (set in the ADF) is set to the vertically disposed landscape draft. In this case, the first display area 72*a* displays the graphical image O indicating the vertically disposed draft of the landscape.

For example, in the draft direction setting screen 120*b* shown in FIG. 12, the vertically disposed landscape key 124*b* is brought into the selected state. In this draft direction setting screen 120*b*, the first display area 72*a* displays the draft graphical image O indicating "A4, vertically disposed, and landscape", and the second display area 72*b* displays the finished graphical image P indicating "A3, horizontal, and landscape (corresponding to the draft)" and corresponding to the draft graphical image O. Furthermore, in the finished graphical image P of the draft direction setting screen 120*b*, the printed image area image Pb protrudes from the finished state image Pa, and the guidance display section G is displayed.

The horizontally disposed portrait key 124*c* is a key to be selected in a case where the draft set in the ADF is horizontally disposed and the direction of the image in the draft is that of the portrait. When the horizontally disposed portrait key 124*c* is touched, the draft (set in the ADF) is set to the horizontally disposed portrait draft. In this case, the first display area 72*a* displays the graphical image O of the horizontally disposed draft of the portrait.

The horizontally disposed portrait key 112*c* is a key to be selected in a case where the direction of the image in the draft horizontally disposed in the ADF 31 is that of the portrait. When the horizontally disposed portrait key 112*c* is touched, the draft (set in the ADF 31) is set to the horizontally disposed portrait draft. In this case, the draft graphical image displayed in the first display area 72*a* indicates "draft size, horizontally disposed, and portrait".

For example, in the draft direction setting screen 120*c* shown in FIG. 11, the horizontally disposed portrait key 124*c* is brought into the selected state. In this draft direction setting screen 120*c*, the first display area 72*a* displays the draft graphical image O indicating "A4, horizontally disposed, and portrait", and the second display area 72*b* displays the finished graphical image P indicating "A3, horizontal, and portrait (corresponding to the draft)" and corresponding to the draft graphical image O. In the finished graphical image P of the draft direction setting screen 120*c*, the printed image area image Pb is displayed in the finished state image Pa. Therefore, the guidance display section G is not displayed.

The horizontally disposed landscape key 124*d* is a key to be selected in a case where the draft set in the ADF 31 is horizontally disposed and the direction of the image in the draft is that of the landscape. When the horizontally disposed landscape key 124*d* is touched, the draft (set in the ADF) is set to "horizontally disposed and landscape". In this case, the first display area 72*a* displays the draft graphical image O indicating "draft size, horizontally disposed, and landscape".

For example, in the draft direction setting screen 120*b* shown in FIG. 12, the horizontally disposed landscape key 124*d* is brought into the selected state. In this draft direction setting screen 120*d*, the first display area 72*a* displays the draft graphical image O indicating "A4, horizontally disposed, and landscape", and the second display area 72*b* displays the finished graphical image P indicating "A3, horizontal, and landscape (corresponding to the draft)" and corresponding to the draft graphical image O. Furthermore, in the finished graphical image P of the draft direction setting screen 120*d*, the printed image area image Pb is displayed in the finished state image Pa. Therefore, the guidance display section G is not displayed.

Next, there will be described a processing example of draft set processing.

Here, as the processing example of the draft set processing, there will be described the draft set processing in a case where the ADF draft size detecting function is valid.

Figure 13:
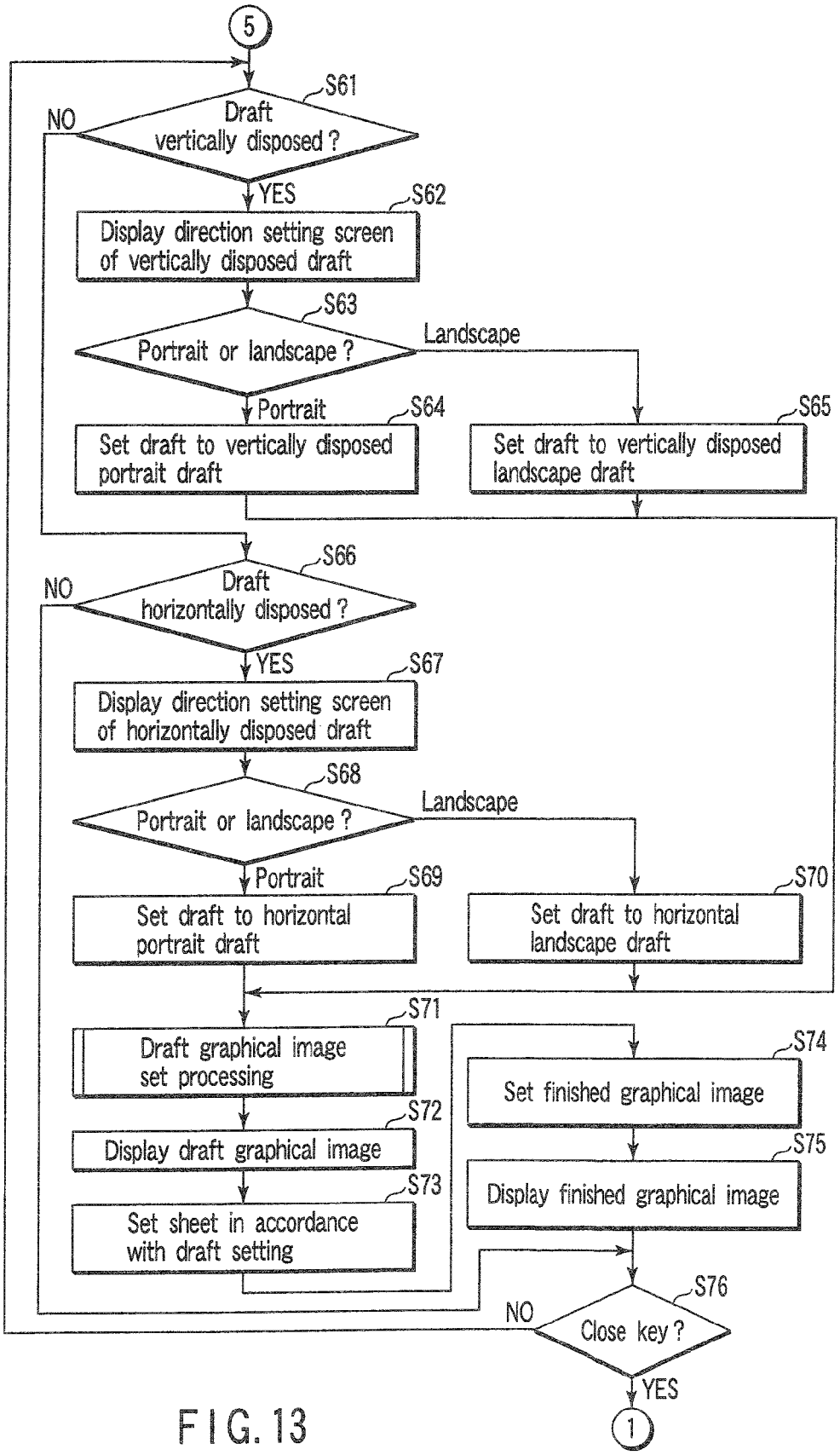
FIG. 13 is a flowchart showing a processing example of draft set processing.

FIG. 13 is a flowchart showing a processing example of the draft set processing in a state in which the draft direction setting screen 110 shown in FIG. 10 or 11 is displayed.

When the draft setting key 87 is touched in the basic screen 70, the CPU 51 of the system control unit 11 performs the draft set processing in response to user's instruction. As described above, when the ADF draft size detecting function is valid, the CPU 51 selectively displays, in the display section 22, a draft setting direction setting screen in accordance with a way to set the draft in the ADF 31, which is judged by the ADF draft size detecting function.

That is, in a case where the draft setting key 87 is touched, when the ADF draft size detecting function detects the "vertically disposed" draft (step S61, YES), the CPU 51 displays, in the display section 22, the setting screen 110 (110*a* or 110*b*) for setting the direction of the image in the vertically disposed draft (step S62).

In a case where the portrait is selected as the direction of the image in the vertically disposed draft, that is, the user touches the vertically disposed portrait key 112*a* in the draft direction setting screen 110*b* (step S63, portrait), the CPU 51 sets the direction of the image in the draft to that of the portrait (step S64).

When the direction of the image in the draft is set to that of the portrait, the CPU 51 sets the graphical image corresponding to the present draft setting (step S71). In this case, as the draft setting, at least the draft size, the vertically disposed draft, and the portrait are set. Therefore, the CPU 51 sets, as the draft graphical image, a graphical image indicating at least the draft size, the vertically disposed draft, and the portrait. In this case, the CPU 51 displays the set graphical image as the draft graphical image O in the first display area 72*a* (step S72).

Moreover, in a case where the landscape is selected as the direction of the image in the vertically disposed draft, that is, the user touches the vertically disposed landscape key 112*b* in the draft direction setting screen 110*a* (step S63, landscape), the CPU 51 sets the direction of the image in the draft to that of the landscape (step S65).

When the direction of the image in the draft is set to that of the landscape, the CPU 51 sets the graphical image corresponding to the draft setting (step S71). In this case, as the draft setting, at least the draft size, the vertically disposed draft and the landscape are set. Therefore, the CPU 51 sets, as the draft graphical image O, a graphical image indicating at least the draft size, the vertically disposed draft and the landscape. In this case, the CPU 51 displays the set graphical image as the draft graphical image O in the first display area 72*a* (step S72).

Moreover, in a case where the draft setting key 87 is touched, when the ADF draft size detecting function detects the horizontally disposed draft (step S66, YES), the CPU 51 displays, in the display section 22, the setting screen 110*c* or 110*d* for setting the direction of the image in the horizontally disposed draft as shown in FIG. 11. It is to be noted that in a case where the draft setting key 87 is touched, when the draft is horizontally disposed, the CPU 51 displays either the draft direction setting screen 110*c* or 110*d* based on default setting.

In a case where the portrait is selected as the direction of the image in the horizontally disposed draft, that is, the user touches the horizontally disposed portrait key 112*c* in the draft direction setting screen 110*d* (step S68, portrait), the CPU 51 sets the direction of the image in the draft to that of the portrait (step S69).

When the direction of the image in the draft is set to that of the portrait, the CPU 51 sets the graphical image corresponding to the present draft setting (step S71). In this case, as the draft setting, at least the draft size, the horizontally disposed draft and the portrait are set. Therefore, the CPU 51 sets, as the draft graphical image O, a graphical image indicating at least the draft size, the horizontally disposed draft and the portrait. In this case, the CPU 51 displays the set graphical image as the draft graphical image O in the first display area 72*a* (step S72).

Moreover, in a case where the landscape is selected as the direction of the image in the horizontally disposed draft, that is, the user touches the horizontally disposed landscape key 112*d* in the draft direction setting screen 110*c* (step S68, landscape), the CPU 51 sets the direction of the image in the draft to that of the landscape (step S70).

When the direction of the image in the draft is set to that of the landscape, the CPU 51 sets the graphical image corresponding to the draft setting (step S71). IN this case, as the draft setting, at least the draft size, the horizontal disposed draft and the landscape are set. Therefore, the CPU 51 sets, as the draft graphical image O, a graphical image indicating at least the draft size, the horizontally disposed draft and the landscape. When such draft graphical image O is set, the CPU 51 displays the set graphical image as the draft graphical image O in the first display area 72*a* (step S72).

Moreover, when the draft setting is changed in the step S64, S65, S69 or S70, the CPU 51 also changes the sheet setting in accordance with the change of the draft setting (step S73). For example, when the draft setting direction (vertically or horizontally disposed draft) is changed, an area of the sheet to be printed is changed as the sheet setting. This is reflected in the printed image area image of the finished graphical image P. In a case where the direction of the image in the draft (portrait or landscape) is changed, as the sheet setting, the direction of the printed image is changed to a direction corresponding to the direction of the draft image (portrait or landscape), which is set contents to be reflected in the printed image direction mark Pc of the finished graphical image P.

When the sheet setting is changed in accordance with the change of the draft setting, the CPU 51 sets the finished graphical image (step S74). When the finished graphical image P is set by this set processing, the CPU 51 displays the set finished graphical image P in the second display area 72*b* (step S75).

The processing of the steps S61 to S75 is exited until the close key 113 is touched. That is, when the user touches the close key 113 (step S76, YES), the CPU 51 closes the draft direction setting screen 110 (110*a*, 110*b*, 110*c* or 110*d*), and displays, in the display section 22, the basic screen 70*b* in which the present set contents are reflected.

Moreover, in a case where the above-described draft set processing sets the direction of the image in the draft to a setting which is different from the default setting, the CPU 51 displays, in a setting screen such as the basic screen 70, the draft setting key 87 in a specific color different from that of the default setting. For example, when the draft has a default setting state, the draft setting key 87 is displayed in white.

When the setting has a state different from that of the default setting, the draft setting key 87 is displayed in blue.

As described above, in a setting screen such as the basic screen 70, the setting key corresponding to the setting particular brought into the setting different from the default setting is displayed in the specific color. In consequence, the user can easily recognize the setting particular brought into the setting different from the default setting.

Next, there will be described a setting of the photocopy side (single-sided/double-sided).

Here, the photocopy side means the surface of the draft to be read (single-sided or double-sided) and the surface of the sheet to be printed (single-sided or double-sided). That is, photocopy side set processing sets the surface of the draft to be read (single-sided or double-sided) and the surface of the sheet to be printed (single-sided or double-sided).

Figure 14:
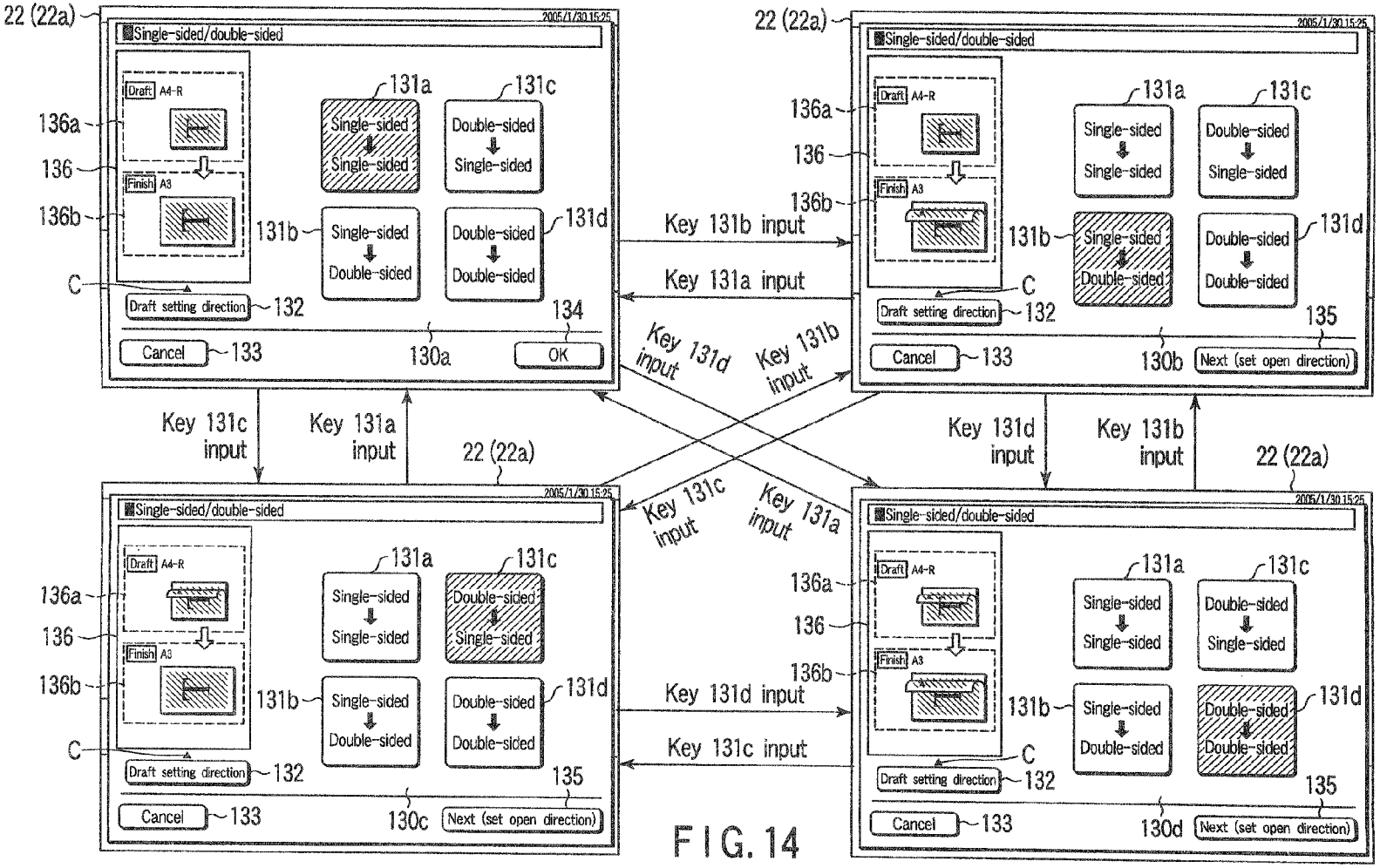
FIG. 14 is a diagram showing a display example of a photocopy side setting screen for setting a photocopy side.

FIG. 14 is a diagram showing display examples of a photocopy side setting screen 130 (130*a*, 130*b*, 130*c*, and 130*d*) for setting the photocopy side. It is to be noted that the draft setting is "A4 and horizontal" and the sheet setting is "A3 and horizontal" in the display examples of the respective photocopy side setting screens 130*a*, 130*b*, 130*c* and 130*d* shown in FIG. 14.

In the photocopy side setting screen 130, as shown in FIG. 14, there are displayed touch keys such as: a single-sided to single-sided key 131*a*; a single-sided to double-sided key 131*b*; a double-sided to single-sided key 131*c*; a double-sided to double-sided key 131*d*; a draft setting key 132; a cancel key 133; an "OK" key 134; and an "next (open direction setting)" key 135. Furthermore, the photocopy side setting screen 130 is provided with a display area 136 having a first display area 136*a* and a second display area 136*b*.

The single-sided to single-sided key 131*a* is a touch key for instructing a mode to successively photocopy an image of the single side of the draft to the single side of the sheet. The single-sided to double-sided key 131*b* is a touch key for instructing a mode to successively photocopy the image of the single side of the draft to the double sides of the sheet. The double-sided to single-sided key 131*c* is a touch key for instructing a mode to successively photocopy images of the double sides of the draft to the single side of the sheet. The double-sided to double-sided key 131*d* is a touch key for instructing a mode to successively photocopy the images of the double sides of the draft to the double sides of the sheet.

The draft setting key 132 is a key to be touched in a case where the direction of the image in the draft is set. The draft setting key 132 is disposed in the vicinity of the display area 136 in which the draft graphical image O and the finished graphical image P are displayed. Furthermore, the draft setting key 132 is associated with the display area 136 by the graphic C.

The cancel key 133 is a key to be touched in a case where the setting of the photocopy side is stopped. The "OK" key 134 is a key to be touched in a case where the setting of the photocopy side is completed. The open direction setting key 135 is constituted of an icon in which "next (open direction setting)" is displayed. The open direction setting key 135 is a key to be touched in a case where an open direction of the double-sided draft or an open direction of the double-sided sheet is set.

It is to be noted that either the "OK" key 134 or the open direction key 135 is selectively displayed. That is, in a case where both of the draft setting and the sheet setting are single-sided, in the photocopy side setting screen 130, the open direction key 135 is not displayed, and the "OK" key 134 is displayed. When either the draft setting or the sheet setting is double-sided, in the photocopy side setting screen 130, the "OK" key 134 is not displayed, and the open direction setting key 135 is displayed.

The display area 136 has a constitution similar to that of the display area 72 of the basic screen 70. A position (upper left area in a screen) of the display area 136 in the photocopy side setting screen 130 is substantially similar to that (upper left area in a screen) of the display area 72 in the basic screen 70.

In the first display area 136*a*, the draft graphical image O and the like are displayed as information indicating the present draft setting in the same manner as in the first display area 72*a*. In the second display area 136*b*, the finished graphical image P and the like are displayed as information indicating the present sheet setting in the same manner as in the second display area 72*b*.

For example, when the draft is set to be single-sided, that is, the single-sided to single-sided key 131*a* or the single-sided to double-sided key 131*b* is selected, in the first display area 136*a*, the draft graphical image O is displayed which indicates that the draft is single-sided as shown in the photocopy side setting screen 130*a* or 130*b* of FIG. 14. When the draft is set to be double-sided, that is, the double-sided to single-sided key 131*c* or the double-sided to double-sided key 131*d* is selected, in the first display area 136*a*, the draft graphical image O is displayed which indicates that the draft is double-sided as shown in the photocopy side setting screen 130*c* or 130*d* of FIG. 14.

Moreover, in a case where a sheet (finish) is set to be single-sided, that is, the single-sided to single-sided key 131*a* or the double-sided to single-sided key 131*c* is selected, in the second display area 136*b*, the finished graphical image P is displayed which indicates that the sheet is single-sided as shown in the photocopy side setting screen 130*a* or 130*c* of FIG. 14. In a case where the sheet (finish) is set to be double-sided, that is, the single-sided to double-sided key 131*b* or the double-sided to double-sided key 131*d* is selected, in the second display area 136*b*, the finished graphical image P is displayed which indicates that the draft is double-sided as shown in the photocopy side setting screen 130*b* or 130*d* of FIG. 14.

Next, there will be described a processing example of the photocopy side set processing.

Figure 15:
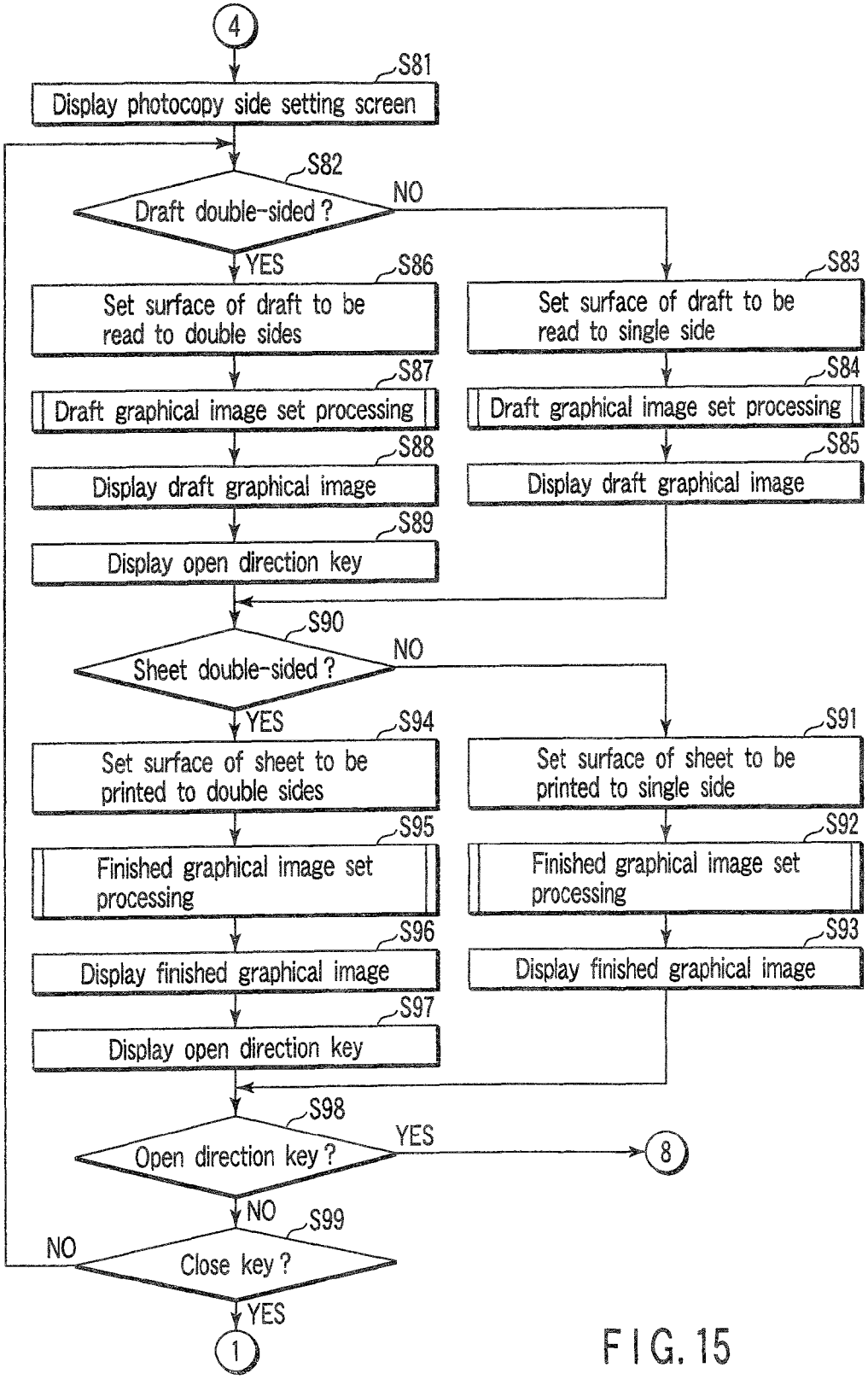
FIG. 15 is a flowchart showing a processing example of photocopy side set processing.

FIG. 15 is a flowchart showing a processing example of the photocopy side set processing in a state in which the photocopy side setting screen 130 is displayed as shown in FIG. 14.

When the single-sided/double-sided key 83 is touched in the basic screen 70, the CPU 51 of the system control unit 11 displays the photocopy side setting screen 130 in the display section 22 (step S81). For example, when the draft setting is "A4, horizontal" and the sheet setting is "A3, horizontal", the display section 22 displays the photocopy side setting screen 130 (the photocopy side setting screen 130*a*, 130*b*, 130*c* or 130*d* shown in FIG. 14 and corresponding to the present photocopy side setting) corresponding to the pressure photocopy side setting. For example, in a case where the default setting is that the draft is single-sided and the sheet is single-sided, when the single-sided/double-sided key 83 is touched in the default set state, the display section 22 displays the photocopy side setting screen 130*a*. In a state in which such photocopy side setting screen 130 is displayed, the CPU 51 sets the photocopy side in response to an input into each key.

When the single-sided to single-sided key 131*a* or the single-sided to double-sided key 131*b* is brought into the selected state (the user touches the single-sided to single-sided key 131*a* or the single-sided to double-sided key 131*b*) in the photocopy side setting screen 130*c* or 130*d* shown in FIG. 14, the CPU 51 judges that the single side is selected as the surface of the draft to be read (step S82, NO). When it is judged that the single side is selected as the surface of the draft to be read, the CPU 51 sets, as the draft setting, the surface of the draft to be read to the single side (step S83).

When the surface of the draft to be read is set to the single side, that is, the draft setting is changed, the CPU 51 sets the draft graphical image O in accordance with the present draft setting (step S84). In this case, the CPU 51 sets the single-sided graphical image as the draft graphical image O. When the draft graphical image O is set, the CPU 51 displays the set draft graphical image O in the first display area 136*a* (step S85).

Moreover, when the double-sided to single-sided key 131*c* or the double-sided to double-sided key 131*d* is brought into the selected state (the user touches the double-sided to single-sided key 131*c* or the double-sided to double-sided key 131*d*) in the photocopy side setting screen 130*c* or 130*d* shown in FIG. 14, the CPU 51 judges that double sides are selected as the surfaces of the draft to be read (step S82, YES). When it is judged that the double sides are selected as the surfaces of the draft to be read, the CPU 51 sets, as the draft setting, the surfaces of the draft to be read to the double sides (step S83).

When the surface of the draft to be read is set to the double sides, that is, the draft setting is changed, the CPU 51 sets the draft graphical image O in accordance with the present draft setting (step S84). In this case, the CPU 51 sets the double-sided graphical image as the draft graphical image O. When the draft graphical image O is set, the CPU 51 displays the set graphical image O in the first display area 136*a* (step S85).

Furthermore, when the surface of the draft to be read is set to the double sides, the CPU 51 displays the open direction setting key 135 as shown in the photocopy side setting screen 130*c* or 130*d* of FIG. 14 (step S86).

When the single-sided to single-sided key 131*a* or the double-sided to single-sided key 131*c* is brought into the selected state (the user touches the single-sided to single-sided key 131*a* or the double-sided to single-sided key 131*c*) in the photocopy side setting screen 130*a* or 130*c* shown in FIG. 14, the CPU 51 judges that the single side is selected as the surface of the sheet to be printed (step S90, NO). When it is judged that the single side is selected as the surface of the sheet to be printed, the CPU 51 sets, as the sheet setting, the surface of the sheet to be printed to the single side (step S91).

When the surface of the sheet to be printed is set to the single side, the CPU 51 sets the finished graphical image P in accordance with the present sheet setting (step S92). In this case, the CPU 51 sets the single-sided graphical image as the finished graphical image P by the set processing of the finished graphical image P. When the finished graphical image P is set, the CPU 51 displays the set finished sheet graphical image in the second display area 136*b* (step S93).

In addition, when the single-sided to double-sided key 131*b* or the double-sided to double-sided key 131*d* is brought into the selected state (the user touches the single-sided to double-sided key 131*b* or the double-sided to double-sided key 131*d*) in the photocopy side setting screen 130*b* or 130*d* shown in FIG. 14, the CPU 51 judges that the double sides are selected as the surfaces of the sheet to be printed (step S90, YES). When it is judged that the double sides are selected as the surfaces of the sheet to be printed, the CPU 51 sets, as the sheet setting, the surfaces of the sheet to be printed to the double sides (step S94).

When the surface of the sheet to be printed is set to the double sides, that is, the sheet setting is changed, the CPU 51 sets the finished graphical image P in accordance with the present sheet setting. In this case, the CPU 51 sets the double-sided graphical image as the finished sheet graphical image P by the set processing of the finished graphical image P (step S95). When the finished graphical image P is set, the CPU 51 displays the set finished graphical image P in the second display area 136*b* (step S96).

Furthermore, when the surface of the sheet to be printed is set to the double sides, the CPU 51 displays the open direction setting key 135 in the screen as shown by the photocopy side setting screen 130*b* or 130*d* of FIG. 14 (step S97).

Moreover, when the open direction key 135 is touched in the photocopy side setting screen 130 in the step S89 or S97 (step S98, YES), the CPU 51 performs the open direction set processing as described later. When the cancel key 133 is touched, the CPU 51 closes the photocopy side setting screen 130 to end the photocopy side set processing, and displays the basic screen 70 in the display section 22.

Next, open direction set processing will be described.

Figure 16:
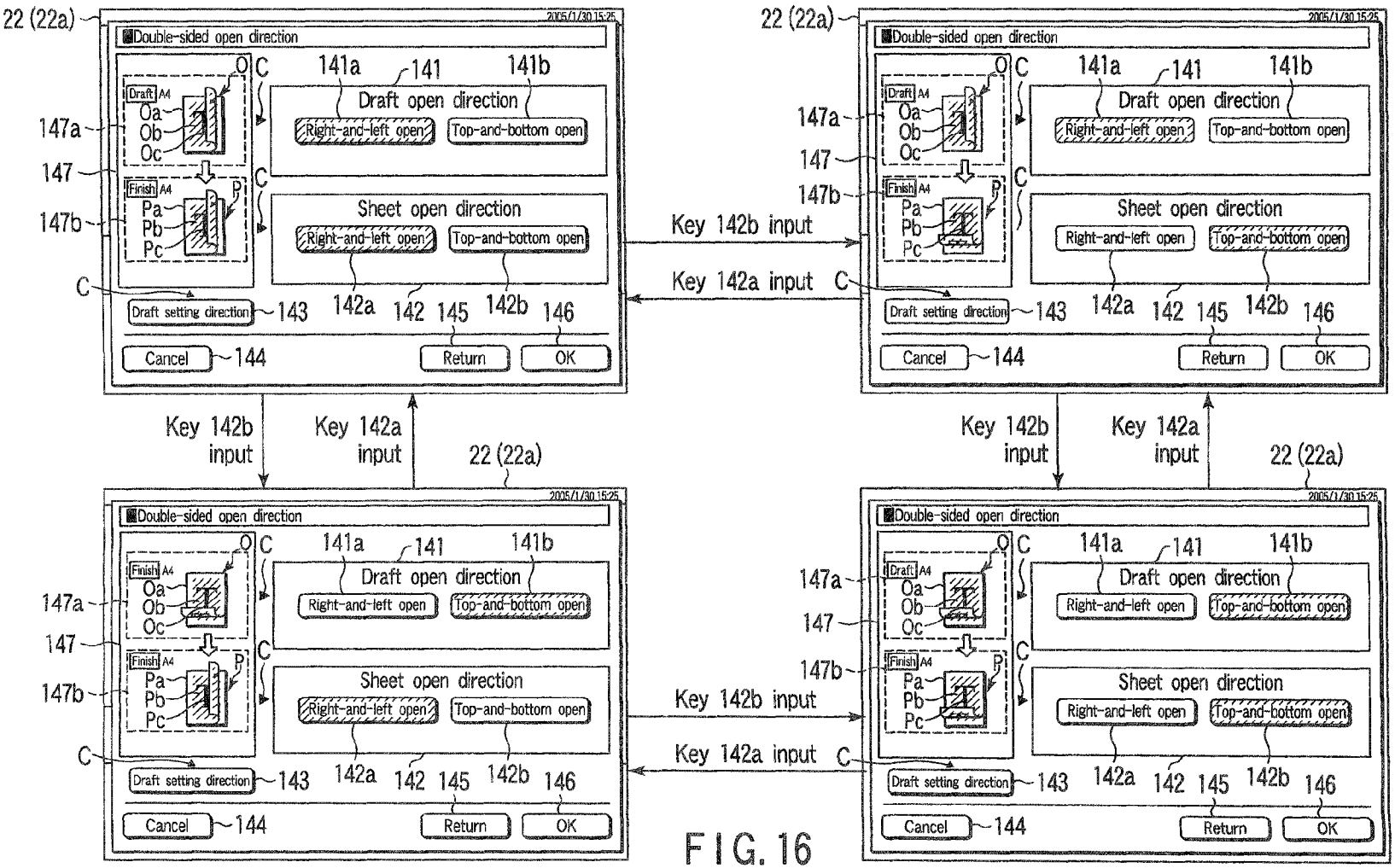
FIG. 16 is a diagram showing a display example of an open direction setting screen for setting an open direction.

FIG. 16 is a diagram showing display examples of an open direction setting screen 140 (140*a*, 140*b*, 140*c*, and 140*d*) for setting an open direction. It is assumed that in FIG. 16, the draft setting is "A4, horizontal and single-sided", and the sheet setting is "A3, horizontal and double-sided".

In the display example shown in FIG. 16, the open direction setting screen 140 displays: a draft open direction setting portion 141; a sheet open direction setting portion 142; a draft setting key 143; a cancel key 144; a "return" key 145; an "OK" key 146; a display area 147 and the like.

The draft open direction setting portion 141 is a display area for setting the open direction of the draft which is set to be double-sided. The draft open direction setting portion 141 is displayed only in a case where the draft is set to be double-sided. That is, when the draft is set to be single-sided and the sheet is set to be double-sided, the draft open direction setting portion 141 is not displayed in the open direction setting screen 140. The draft open direction setting portion 141 displays a right-and-left open key 141*a* and a top-and-bottom open key 141*b* together with a guidance "draft open direction".

Furthermore, the open direction setting screen 140 displays the draft open direction setting portion 141 which is associated with a first display area 147*a* where the draft graphical image O is displayed. In the example shown in FIG. 16, the draft open direction setting portion 141 is disposed in the vicinity of the first display area 147*a* where the draft graphical image O is displayed. Furthermore, the draft open direction setting portion 141 is associated and displayed with the first display area 147*a* (or the draft graphical image O displayed in the first display area 147*a*) by the triangular graphic C. In consequence, the user can intuitively and visually recognize that the draft open direction setting portion 141 indicates a setting concerning the draft.

The sheet open direction setting portion 142 is a display area for setting the open direction of the sheet which is set to be double-sided. The sheet open direction setting portion 142 is displayed only in a case where the sheet is set to be double-sided. That is, when the draft is set to be double-sided and the sheet is set to be single-sided, the sheet open direction setting portion 142 is not displayed in the open direction setting screen. The sheet open direction setting portion 142 displays a right-and-left open key 142*a* and a top-and-bottom open key 142*b* together with a guidance "sheet open direction".

Furthermore, the open direction setting screen 140 displays the sheet open direction setting portion 142 which is associated with a second display area 147*b* where the finished graphical image P is displayed. In the example shown in FIG. 16, the sheet open direction setting portion 142 is disposed in the vicinity of the second display area 147*b* where the finished graphical image P is displayed. Furthermore, the sheet open direction setting portion 142 is associated and displayed with the second display area 147*b* (or the finished graphical image P displayed in the second display area 147*b*) by the triangular graphic C. In consequence, the user can intuitively and visually recognize that the sheet open direction setting portion 142 indicates a setting concerning the finish (sheet).

The draft setting key 143 is a key to be touched in a case where the direction of the image in the draft is set in the same manner as in the draft setting key 87. The draft setting key 143 is disposed in the vicinity of the display area 147 where the draft graphical image O and the finished graphical image P are displayed. Furthermore, the draft setting key 143 is associated with the display area 147 by the graphic C.

The cancel key 144 is a key to be touched in a case where the setting of the photocopy side is stopped. The "return" key 145 is a key to be touched in returning to the photocopy side setting screen 130. The "OK" key 146 is a key to be touched in completing the setting of the photocopy side.

The display area 147 has a constitution similar to that of the display area 136 (or the first display area 72*a*). The first display area 147*a* displays the draft graphical image O and the like as information indicating the present draft setting in the same manner as in the first display area 136*a* (or the first display area 72*a*). The second display area 147*b* displays the finished graphical image P and the like as information indicating the present sheet setting in the same manner as in the second display area 136*b* (or the second display area 72*b*).

In a case where the sheet (finish) open direction is set to a right-and-left open direction, that is, the right-and-left open key 142*a* is selected, the second display area 147*b* displays the finished graphical image P indicating that the sheet is right-and-left open and double-sided as shown in the open direction setting screen 140*a* of FIG. 16. When the sheet (finish) open direction is set to a top-and-bottom open direction, that is, the top-and-bottom open key 142*b* is selected, the second display area 147*b* displays the finished graphical image P indicating that the sheet is top-and-bottom open and double-sided as shown in the open direction setting screen 140*b* of FIG. 16.

It is to be noted that when the draft is set to be single-sided and the sheet is set to be double-sided, the draft open direction setting portion 141 is not displayed, and the sheet open direction setting portion 142 is displayed in the open direction setting screen 140. When the draft is set to be double-sided and the sheet is set to be single-sided, the sheet open direction setting portion 142 is not displayed and the draft open direction setting portion 141 is displayed in the open direction setting screen 140. When the draft is set to be double-sided and the sheet is set to be double-sided, both of the draft open direction setting portion 141 and the sheet open direction setting portion 142 are displayed in the open direction setting screen 140.

Next, there will be described a processing example of open direction set processing.

Figure 17:
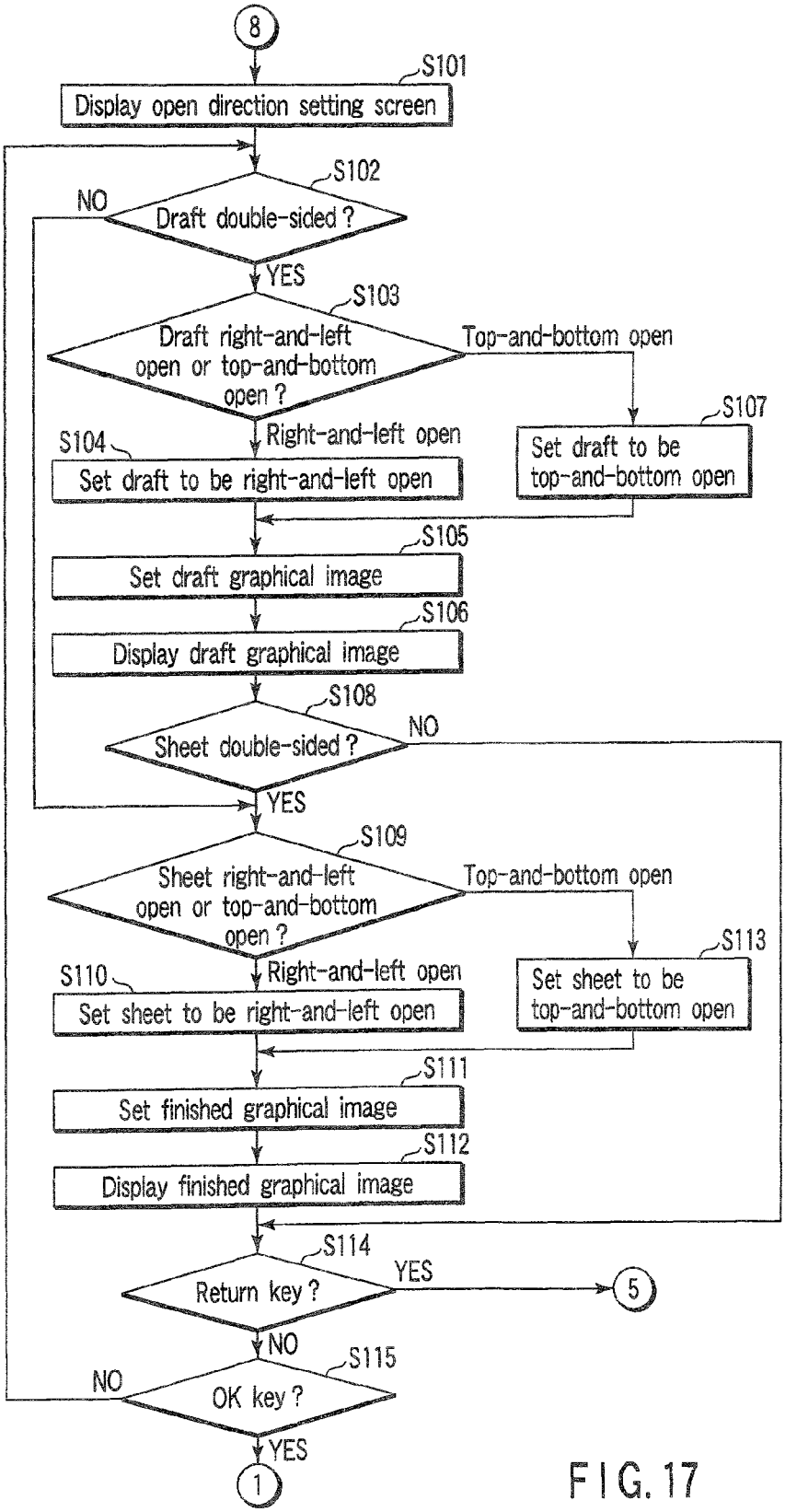
FIG. 17 is a flowchart showing a processing example of open direction set processing.

FIG. 17 is a flowchart showing a processing example of the open direction set processing in a state in which the open direction setting screen 140 is displayed as shown in FIG. 16.

In the open direction set processing, there are presumed: a case where the draft only is set to be double-sided; a case where the sheet only is set to be double-sided; and a case where both of the draft and the sheet are set to be double-sided. In the following open direction set processing, it is assumed that the user selects the draft open direction by use of the right-and-left open key 141*a* of the draft open direction setting portion 141 for setting the draft to be right-and-left open or the top-and-bottom open key 141*b* of the draft open direction setting portion 141 for setting the draft to be top-and-bottom open. It is also assumed that the user selects the sheet open direction by the right-and-left open key 142*a* or the top-and-bottom open key 142*b* of the sheet open direction setting portion 142.

When the open direction setting key 135 is touched in the photocopy side setting screen 130, the CPU 51 of the system control unit 11 displays the open direction setting screen 140 in the display section 22 (step S101). In this open direction setting screen 140, the draft open direction setting processing 141 is displayed in the case where the draft only is double-sided, the sheet open direction setting portion 142 is displayed in the case where the sheet only is double-sided, and both of the draft open direction setting portion 141 and the sheet open direction setting portion 142 are displayed in the case where both of the draft and the sheet are double-sided.

Here, in a case where the draft is set to be double-sided (step S102, YES), when the right-and-left open key 141*a* is brought into a selected state in the draft open direction setting portion 141 of the open direction setting screen 140, the CPU 51 judges that the right-and-left open direction is selected as the draft open direction (step S103, right-and-left open). When it is judged that the right-and-left open direction is selected as the draft open direction, the CPU 51 sets the draft open direction to the right-and-left open direction as the draft setting (step S104).

When the draft open direction is set to the right-and-left open direction, that is, the draft setting is changed, the CPU 51 sets the draft graphical image O in accordance with the present draft setting (step S105). In this case, the CPU 51 sets, as the draft graphical image O, a graphical image indicating the right-and-left open and double-sided draft. When the draft graphical image O is set, the CPU 51 displays the set draft graphical image O in the first display area 147*a* (step S106).

Moreover, in a case where the draft is set to be double-sided (step S102, YES), when the top-and-bottom open key 141*b* is brought into the selected state in the draft open direction setting portion 141 of the open direction setting screen 140, the CPU 51 judges that the top-and-bottom open direction is selected as the draft open direction (step S103, top-and-bottom open). When it is judged that the top-and-bottom open direction is selected as the draft open direction, the CPU 51 sets the draft open direction to the top-and-bottom open direction as the draft setting (step S107).

When the draft open direction is set to the top-and-bottom open direction, that is, the draft setting is changed, the CPU 51 sets the draft graphical image O in accordance with the present draft setting (step S105). In this case, the CPU 51 sets, as the draft graphical image O, a graphical image indicating a top-and-bottom open and double-sided draft. When the draft graphical image O is set, the CPU 51 displays the set draft graphical image O in the first display area 147*a* (step S106).

Moreover, in a case where the sheet is set to be double-sided (NO in step S102 or YES in step S108), when the right-and-left open key 142*a* is brought into the selected state in the sheet open direction setting portion 142 of the open direction setting screen 140, the CPU 51 judges that the right-and-left open direction is selected as the sheet open direction (step S109, right-and-left open). When it is judged that the right-and-left open direction is selected as the sheet open direction, the CPU 51 sets the sheet open direction to the right-and-left open direction as the sheet setting (step S110).

When the sheet open direction is set to the right-and-left open direction, that is, the sheet setting is changed, the CPU 51 sets the finished graphical image P in accordance with the present sheet setting (step S111). In this case, the CPU 51 sets, as the finished graphical image P, a graphical image indicating a right-and-left open and double-sided sheet.

When the finished graphical image P is set, the CPU 51 displays the set finished graphical image P in the second display area 147*b* (step S112).

Moreover, in a case where the sheet is set to be double-sided (NO in step S102 or YES in step S108), when the top-and-bottom open key 142*b* is brought into the selected state in the sheet open direction setting portion 142 of the open direction setting screen 140, the CPU 51 judges that the top-and-bottom open direction is selected as the sheet open direction (step S109, top-and-bottom open). When it is judged that the top-and-bottom open direction is selected as the sheet open direction, the CPU 51 sets the sheet open direction to the top-and-bottom open direction as the sheet setting (step S113).

When the sheet open direction is set to the top-and-bottom open direction, that is, the sheet setting is changed, the CPU 51 sets the finished graphical image P in accordance with the present sheet setting (step S111). In this case, the CPU 51 sets, as the finished graphical image P, a graphical image indicating a top-and-bottom open and double-sided sheet. When the finished graphical image P is set, the CPU 51 displays the set finished graphical image P in the second display area 147*b* (step S112).

Furthermore, when the user touches the return key 145 (step S114, YES), the CPU 51 closes the open direction setting screen 140, and returns to the step S81. In this case, the display section 22 displays the photocopy side setting screen 130 in which the set open direction is reflected. When the user touches the cancel key 133 (step S115, YES), the CPU 51 closes the open direction setting screen, and completes the open direction set processing and the photocopy side set processing. In this case, the display section 22 displays the basic screen 70 in which the photocopy side setting and the open direction setting are reflected.

Moreover, in a case where the above-described photocopy side set processing sets the photocopy side (single-sided/double-sided) to a setting which is different from the default setting, the CPU 51 displays, in the basic screen 70, the photocopy side key 83 in a specific color different from that of the default setting state. For example, in the default setting state, the photocopy side key 83 is displayed in white. In a state different from that of the default setting, the photocopy side key 83 is displayed in blue.

As described above, in a case where the setting of the photocopy side becomes different from the default setting in the basic screen 70, the photocopy side key is displayed in a specific color. Therefore, the user can easily recognize the setting particular in which the photocopy side setting is brought into the setting different from the default setting. Furthermore, when the user refers to the photocopy side setting information in the setting information display area 71 associated by the graphic C, the user can easily recognize the present set contents of the photocopy side.

It is to be noted that the above-described various types of set processing can be performed in an arbitrary order. The contents set by the set processing are reflected in the draft graphical image O and the sheet graphical image P displayed in various setting screens displayed in the display section 22, every time the contents are set. In other words, every time the draft setting or the sheet setting is changed, the draft graphical image O or the sheet graphical image P are set and updated. In consequence, the user can perform various settings while referring to the present set contents.

Next, there will be described set processing of the draft graphical image O and set processing of the finished graphical image P.

First, there will be described the set processing of the draft graphical image.

Figure 18:
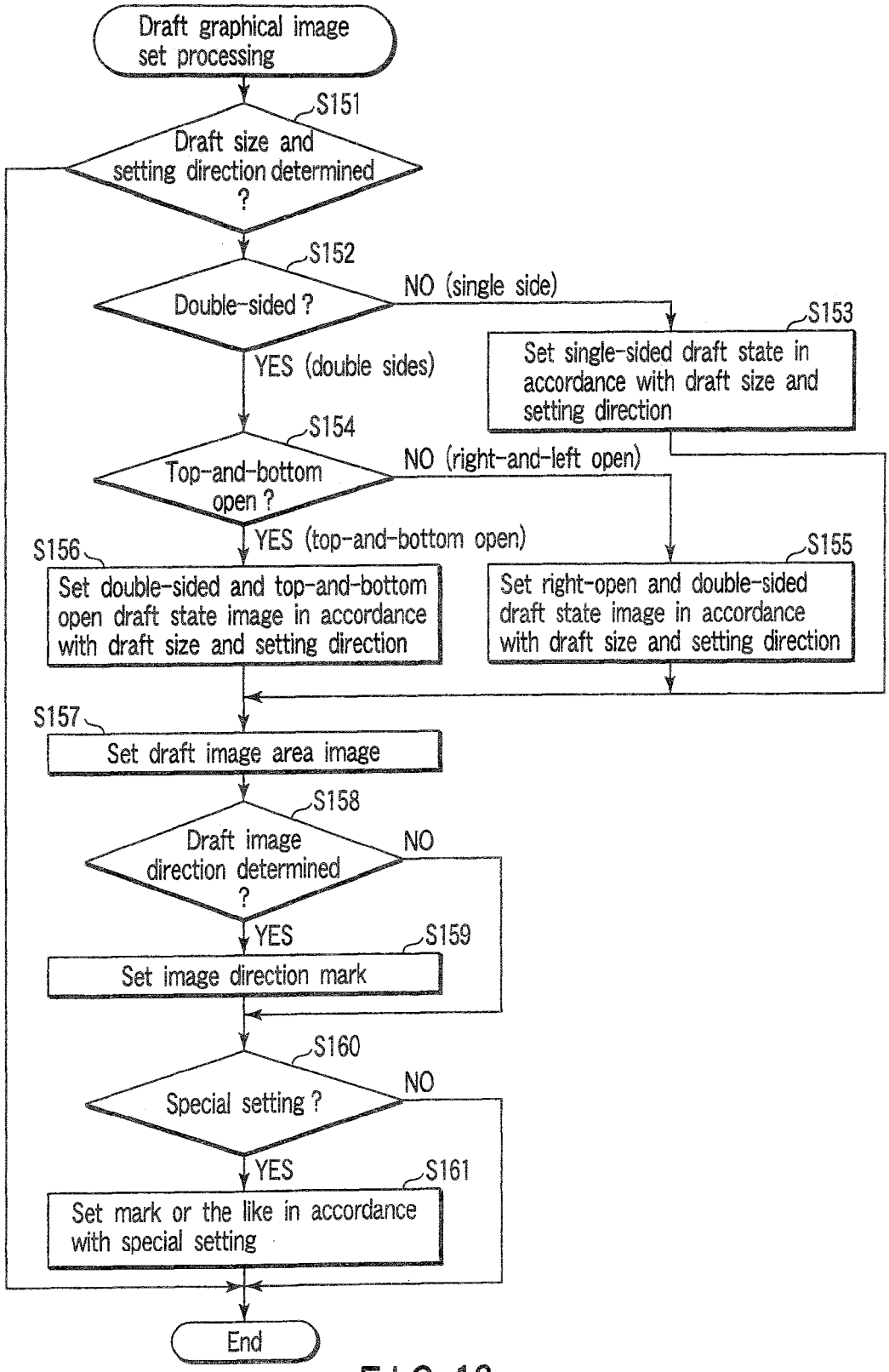
FIG. 18 is a flowchart showing a processing example of draft graphical image set processing.

FIG. 18 is a flowchart showing a processing example of the set processing of the draft graphical image O.

When the draft setting is changed by the various types of set processing as described above, the CPU 51 judges whether or not the draft size and the draft direction (setting direction) are determined (step S151). In a case where this judgment results in judgment that the draft size and the draft setting direction are not determined (step S151, NO), the CPU 51 assumes that the draft graphical image is displayed in the whiteout state (thinly displayed state) in the first display area 72*a*. For example, since the draft size and the draft setting direction are not determined in a standby state, as shown in the basic screen 70*a* of FIG. 4, the CPU 51 sets the draft graphical image O so that the draft state image Oa of the default setting is displayed in the whiteout state.

In a case where it is judged that the draft size and the draft setting direction are determined (step S151, YES), the CPU 51 sets the draft state image Oa (steps S151 to S155).

That is, in a case where it is judged that the draft size and the draft setting direction are determined (step S151, YES), the CPU 51 judges whether or not the draft is set to be double-sided (step S152). In a case where it is judged that the draft is not set to be double-sided, that is, it is judged that the draft is set to be single-sided (step S152, NO), the CPU 51 sets the single-sided graphical image as the draft state image Oa in accordance with the draft size and the setting direction (step S153).

Moreover, in a case where it is judged that the draft is set to be double-sided (step S152, YES), the CPU 51 judges whether the open direction of the double-sided draft is set to be right-and-left open or top-and-bottom open (step S154). When the open direction of the double-sided draft is set to be right-and-left open (step S154, NO (right-and-left open)), the CPU 51 sets a right-and-left open and double-sided graphical image as the draft state image Oa in accordance with the draft size and the setting direction (step S155). When the open direction of the double-sided draft is set to the top-and-bottom open direction (step S154, YES (top-and-bottom open)), the CPU 51 sets the top-and-bottom open and double-sided graphical image as the draft state image Oa in accordance with the draft size and setting direction (step S156).

Here, it is assumed that various graphical images settable (displayable) as the finished state image Pa are stored beforehand in a storage section such as the HDD 55, the nonvolatile memory 54 or the ROM 53. For example, a storage section such as the HDD 55, the nonvolatile memory 54 or the ROM 53 may store beforehand: single-sided graphical images having various sizes and directions; right-and-left open and double-sided graphical images having various sizes and directions; top-and-bottom open and double-sided graphical images having various sizes and directions and the like.

Therefore, in the step S153, the CPU 51 selects, from various single-sided graphical images, the single-sided graphical image having the size and direction matched with the draft size and setting direction. In the step S155, the CPU 51 selects, from various right-and-left open and double-sided graphical images, the right-and-left open and double-sided graphical image having the size and direction matched with the draft size and setting direction. In the step S156, the CPU 51 selects, from various top-and-bottom open and double-sided graphical images, the top-and-bottom open and double-sided graphical image having the size and direction matched with the draft size and setting direction.

Moreover, the CPU 51 may select, as the draft state image Oa, the graphical image having the size associated with a certain draft size (e.g., A3, A4, B4, . . . ). The CPU 51 may determine the size of the graphical image selected as the draft state image Oa based on a relative draft size (photocopy magnification) with respect to the sheet size. The CPU 51 may select the graphical image matched with the draft size, and rotate the selected graphical image in accordance with the draft setting direction to thereby set the image as the draft state image Oa.

On setting the draft state image Oa, the CPU 51 sets the draft image area image Ob (step S157). Here, it is assumed that the CPU 51 superimposes (synthesizes) the draft image area image Ob on the set draft state image Oa. A draft area which is valid as the image of the draft to be printed is usually a predetermined area of the whole draft. Therefore, the draft image area image Ob is set to the predetermined area with respect to the draft state image Oa.

Moreover, the draft image area image Ob may be synthesized with the draft state image Oa beforehand. In this case, a storage section such as the HDD 55, the nonvolatile memory 54 or the ROM 53 may store beforehand a graphical image in which the draft image area image Ob is synthesized with the draft state image Oa. In this case, it is assumed that the CPU 51 sets the graphical image from the graphical image in which the draft state image Oa is synthesized with the draft image area image Ob in accordance with the draft setting.

On setting the draft image area image Ob, the CPU 51 sets the draft image direction mark Oc indicating the direction of the image in the draft (steps S158, S159). That is, the CPU 51 judges whether or not the direction of the image in the draft (portrait or landscape is set (step S158). When this judgment results in judgment that the direction of the image in the draft is set, the CPU 51 sets the draft image area image Ob (step S159). Here, it is assumed that the CPU 51 superimposes (synthesizes) the image direction mark Oc in accordance with the set draft image direction on the draft image area image Ob.

Moreover, the draft image area image Ob and the image direction mark Oc may be synthesized beforehand. In this case, a storage section such as the HDD 55, the nonvolatile memory 54 or the ROM 53 may store beforehand various graphical images in which the draft image area images Ob are synthesized with the image direction marks Oc, respectively. In this case, the CPU 51 sets the graphical image in accordance with the draft setting (draft size, draft setting direction and image direction) from various graphical images in which the draft image area images Ob are synthesized with the image direction marks Oc.

The processing of the steps S151 to 5159 sets the draft graphical image O in which the draft state image Oa, the draft image area image Ob and the image direction mark Oc are set. On setting such draft graphical image O, the CPU 51 judges whether or not there is set a function (hereinafter referred to as the special setting) of adding a mark to the draft graphical image O to be stapled or finished otherwise (step S160).

In a case where this judgment results in judgment that the special setting is set (step S160, YES), the CPU 51 sets the mark or the like in accordance with the set contents on the draft graphical image O (step S161). For example, when the staple is set, the CPU 51 adds the mark showing a staple region corresponding to the set position to be stapled in the draft graphical image O.

The above-described processing sets the draft graphical image O in which the present set contents have been reflected every time the set contents are changed. In other words, every time the set contents of the photocopy processing are changed, the draft graphical image O set by such set processing is displayed in the first display area 72*a*, 105*a*, 136*a*, 147*a* or 152*a*.

Next, there will be described set processing of the finished graphical image P.

Figure 19:
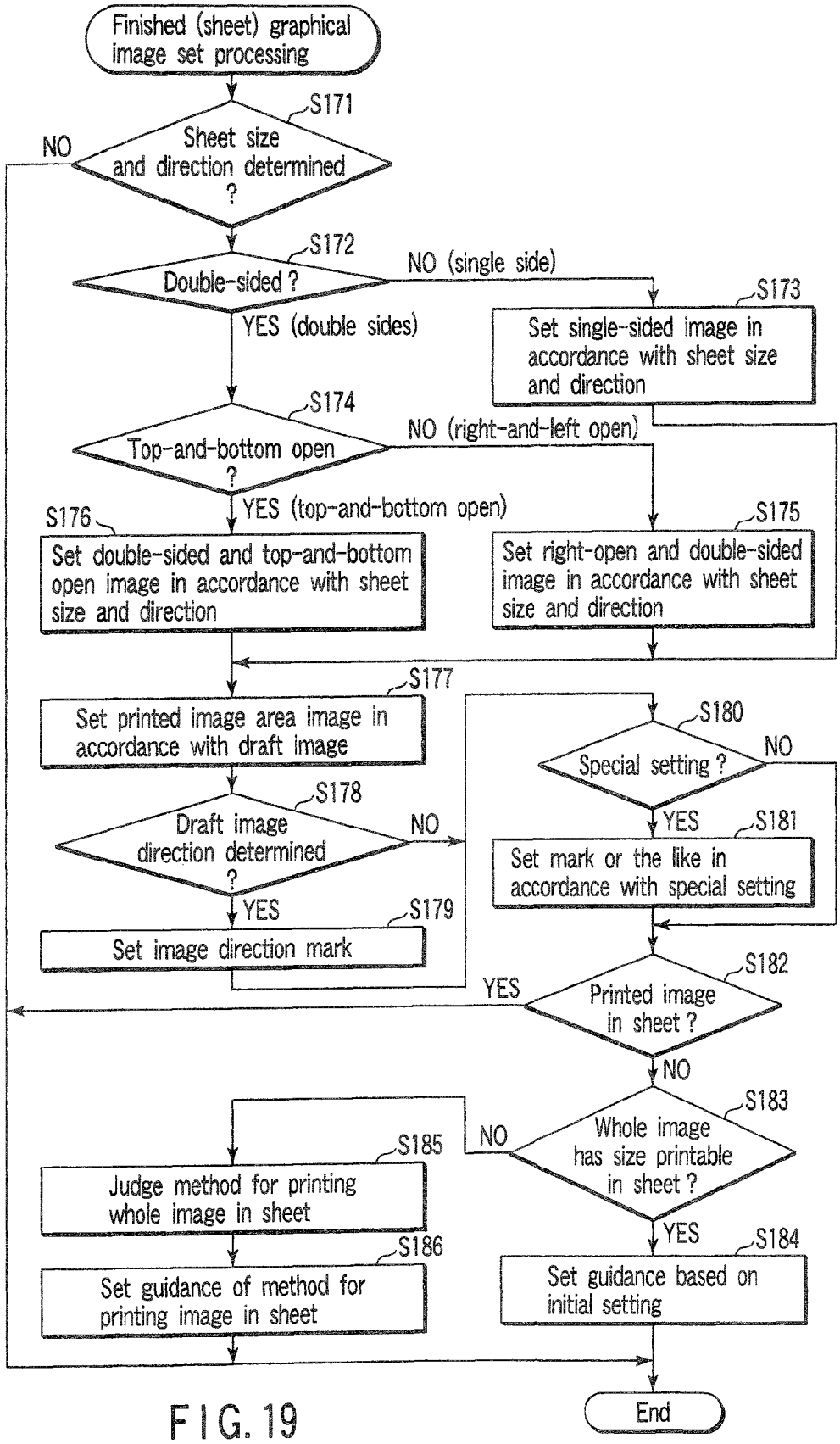
FIG. 19 is a flowchart showing a processing example of finished graphical image set processing.

FIG. 19 is a flowchart showing a processing example of the set processing of the finished graphical image P.

When the sheet setting is changed by the various types of set processing as described above, the CPU 51 judges whether or not the sheet size and the sheet direction are determined (step S171). In a case where this judgment results in judgment that the sheet size and the sheet setting direction are not determined (step S171, NO), the CPU 51 assumes that the finished graphical image is displayed in the whiteout state (thinly displayed state) in the second display area 72*b* in the same manner as in the draft graphical image. For example, since the sheet size and the sheet direction are not determined in a standby state as shown in the basic screen 70*a* of FIG. 4, the CPU 51 sets the finished graphical image P so that the only finished state image Pa of the default setting is displayed in the whiteout state.

In a case where it is judged that the sheet size and the sheet direction are determined (step S171, YES), the CPU 51 sets the finished state image Pa indicating a sheet state such as the sheet size, the sheet direction or the surface to be printed (single-sided or double-sided) (steps S171 to S175).

That is, in a case where it is judged that the sheet size and the sheet direction are determined (step S171, YES), the CPU 51 judges whether or not the sheet is set to be double-sided (step S172). In a case where it is judged that the sheet is not set to be double-sided, that is, it is judged that the sheet is set to be single-sided (step S172, NO), the CPU 51 sets the single-sided graphical image as the sheet state image Pa in accordance with the sheet size and the sheet direction (step S173).

Moreover, in a case where it is judged that the sheet is set to be double-sided (step S172, YES), the CPU 51 judges whether the open direction of the double-sided sheet is set to be right-and-left open or top-and-bottom open (step S174). When the open direction of the double-sided sheet is set to be right-and-left open (step S174, NO (right-and-left open)), the CPU 51 sets a right-and-left open and double-sided graphical image as the sheet state image Pa in accordance with the sheet size and the sheet direction (step S175). When the open direction of the double-sided sheet is set to the top-and-bottom open direction (step S174, YES (top-and-bottom open)), the CPU 51 sets the top-and-bottom open and double-sided graphical image as the sheet state image Pa in accordance with the sheet size and sheet direction (step S176).

Here, it is assumed that various graphical images settable (displayable) as the sheet state image Pa are stored beforehand in a storage section such as the HDD 55, the nonvolatile memory 54 or the ROM 53. For example, a storage section such as the HDD 55, the nonvolatile memory 54 or the ROM 53 may store beforehand: single-sided graphical images having various sizes and directions; right-and-left open and double-sided graphical images having various sizes and directions; top-and-bottom open and double-sided graphical images having various sizes and directions and the like.

Therefore, in the step S173, the CPU 51 selects, from various single-sided graphical images, the single-sided graphical image having the size matched with the sheet size and direction. In the step S175, the CPU 51 selects, from right-and-left open and double-sided graphical images having various sizes, the right-and-left open and double-sided graphical image having the size matched with the sheet size and direction. In the step S176, the CPU 51 selects, from top-and-bottom open and double-sided graphical images having various sizes, the top-and-bottom open and double-sided graphical image having the size matched with the sheet size and direction.

Moreover, the CPU 51 may select, as the sheet state image Pa, the graphical image having the size associated with a sheet size (e.g., A3, A4, B4, . . . ). The CPU 51 may determine the size of the graphical image selected as the sheet state image Pa based on a relative draft size (photocopy magnification) with respect to the draft size. The CPU 51 may select the graphical image matched with the sheet size, and rotate the selected graphical image in accordance with the sheet direction to thereby set the image as the sheet state image Pa.

On setting the sheet state image Pa, the CPU 51 sets the printed image area image Pb (step S177). It is assumed that in this step S177, the CPU 51 superimposes (synthesizes) the printed image area image Pb on the set sheet state image Pa. That is, the CPU 51 sets, as the printed image area image Pb, an image showing a printed image generated based on set contents such as the draft image and photocopy magnification. The CPU 51 superimposes the printed image area image on the sheet state image Pa in accordance with a position of the sheet to be printed. For example, in a case where a printing start position is the upper left of the sheet, the CPU 51 aligns an upper left position of the printed image area image with the upper left position of the sheet state image Pa which is a reference, and superimposes the printed image area image Pb on the sheet state image Pa.

On setting the printed image area image Pb, the CPU 51 sets the image direction mark Pc indicating the direction of the image to be printed on the sheet (steps S178, S179). That is, the CPU 51 judges whether or not the direction of the image to be printed on the sheet (portrait or landscape is set (step S178). When this judgment results in judgment that the direction of the image to be printed on the sheet is set (step S178, YES), the CPU 51 sets the printed image area image Pb (step S179). It is assumed that in this step S179, the CPU 51 superimposes (synthesizes), on the printed image area image Pb, the image direction mark Pc in accordance with the set direction of the image to be printed. That is, the CPU 51 superimposes the image direction mark Pc in a direction corresponding to the direction of the image to be printed on the basis of the central position of the printed image area image Pb.

Moreover, the printed image area image Pb may be synthesized beforehand with the image direction mark Pc. In this case, a storage section such as the HDD 55, the nonvolatile memory 54 or the ROM 53 may store beforehand various graphical images in which the printed image area images OP are synthesized with the image direction marks Pc, respectively. In this case, the CPU 51 sets the graphical image in accordance with the sheet setting (sheet size, sheet direction and image direction) from various graphical images in which the printed image area images Pb are synthesized with the image direction marks Pc.

The processing of the steps S171 to 5179 sets the finished graphical image P in which the sheet state image Pa, the printed image area image Pb and the image direction mark Pc are set. On setting such finished graphical image, the CPU 51 judges whether or not there is set a function (hereinafter referred to as the special setting) of adding a mark such as the staple to the graphical image P stapled or finished otherwise (step S180).

In a case where this judgment results in judgment that the special setting is set (step S180, YES), the CPU 51 sets the mark or the like in accordance with the set contents on the finished graphical image P (step S181). For example, when the staple is set, the CPU 51 adds the mark showing the staple position to a position corresponding to the set position to be stapled in the finished graphical image P.

The above-described processing of the steps S171 to S181 sets the sheet graphical image P in which the present set contents have been reflected every time the set contents are changed. In other words, every time the set contents of the photocopy processing are changed, the sheet graphical image P set by such set processing is displayed in the second display area 72*b*, 105*b*, 136*b*, 147*b* or 152*b*.

Moreover, on setting the finished graphical image P as described above, the CPU 51 further judges whether or not the whole printed image (the image of the draft) falls in the sheet (step S182). This judges whether or not the printed image area image Pb protrudes from the sheet state image Pa.

In a case where this judgment results in judgment that the whole printed image does not fall in the sheet (step S182, NO), the CPU 51 judges whether or not the whole printed image has a size printable on the sheet (step S183). This is judged based on the draft size and direction as the draft setting and the sheet size and direction as the sheet setting. In the judgment, for example, when the draft image to be printed on the sheet is rotated, it is judged whether or not the whole printed image falls in the sheet (step S183).

In a case where the judgment results in judgment that the whole printed image has a size printable on the sheet (step S183, YES), the CPU 51 sets a message to be displayed in the guidance display section G based on initial setting (step S184).

Here, the nonvolatile memory 54 stores a plurality of types of messages that can be displayed in the guidance display section G. Among the messages stored in the nonvolatile memory 54, the message to be displayed in the guidance display section G is judged in accordance with the set contents. Furthermore, in a case where a plurality of types of messages are stored, in the nonvolatile memory 54, as messages which can be displayed on the same conditions (with the same set contents), the message to be displayed in the guidance display section G is determined based on the initial setting stored in the initial setting storage section 54*a*.

Here, it is assumed that a plurality of types of messages are stored, in the nonvolatile memory 54, as messages to be displayed in a case where the set contents indicate that the whole image to be printed has a size printable on the sheet but that a part of the image to be printed protrudes from the sheet (i.e., YES in the step S183). Examples of the message to be displayed in such case include: a message which urges the user to change the way to set the draft; and a message which urges the user to rotate the draft image and change the setting so that the image is printed on the sheet.

As the message which urges the user to change the way to set the draft, as shown in, for example, FIG. 10, the message has contents indicating "when the way to set the draft (vertically or horizontally) is changed, a printed finish region will change". As the message which urges the user to rotate the draft image and change the setting so that the image is printed on the sheet, the message has contents indicating, for example, "when the draft image is rotated, the printed finish region will change". In this case, it is to be noted that an icon for instructing the rotation of the image to be printed (the draft image) may be displayed together with the message.

Moreover, in a case where a plurality of types of messages are stored, in the nonvolatile memory 54, as the messages which can be displayed on the same conditions (with the same set contents), the message to be displayed (set) is determined based on the initial setting. It is assumed that this initial setting is set in accordance with an operation situation of the digital multifunction peripherals 1, user's idea or the like. It is assumed that the initial setting is stored in the initial setting storage section 54*a* of the nonvolatile memory 54.

For example, it is assumed that as the messages to be displayed in a case where the set contents indicate that the whole image to be printed has the size printable on the sheet but that a part of the image to be printed protrudes from the sheet (i.e., YES in the step S183), there are stored, in the nonvolatile memory 54, the message which urges the user to change the way to set the draft and the message which urges the user to rotate the draft image and change the setting so that the image is printed on the sheet. In this case, the message to be displayed is determined based on the initial setting stored in the initial setting storage section 54*a*.

Moreover, in the above-described example, when the digital multifunction peripherals performs a complicated setting during the photocopying in many cases, a preferable initial setting is a setting that the message be displayed which urges the user to change the way to set the draft. On the other hand, when the digital multifunction peripherals only performs simple photocopying in many cases, the preferable initial setting is a setting that the message be displayed which urges the user to rotate the draft image and change the setting for printing the image on the sheet. As described above, in the digital multifunction peripherals, it is possible to display the message in accordance with the operation situation of the digital multifunction peripherals or the user's idea.

Furthermore, when the above judgment results in judgment that the whole image to be printed does not have a printable size with respect to the sheet (step S183, NO), the CPU 51 judges a method for printing the whole image to be printed in the sheet (step S185). Accordingly, on judging the method for printing the whole image to be printed in the sheet, the CPU 51 sets a guidance of the judged method for printing the whole image to be printed in the sheet as the guidance to be displayed in the guidance display section G (step S186).

Next, there will be described display examples of the basic screen and the setting check screen.

The basic screen in the photocopy mode is a setting screen (uppermost setting screen) which is a base for the user to perform various settings as described above. In the basic screen, the operation guidance and the present set contents are displayed together with keys (icons) for setting basic setting particulars.

Moreover, the setting check screen is a screen for the user to confirm the present set contents. The present set contents are displayed in detail in the setting check screen. The setting check screen is a screen displayed in the display section 22, in a case where a setting check key (described later) is input in the basic screen.

Figure 20:
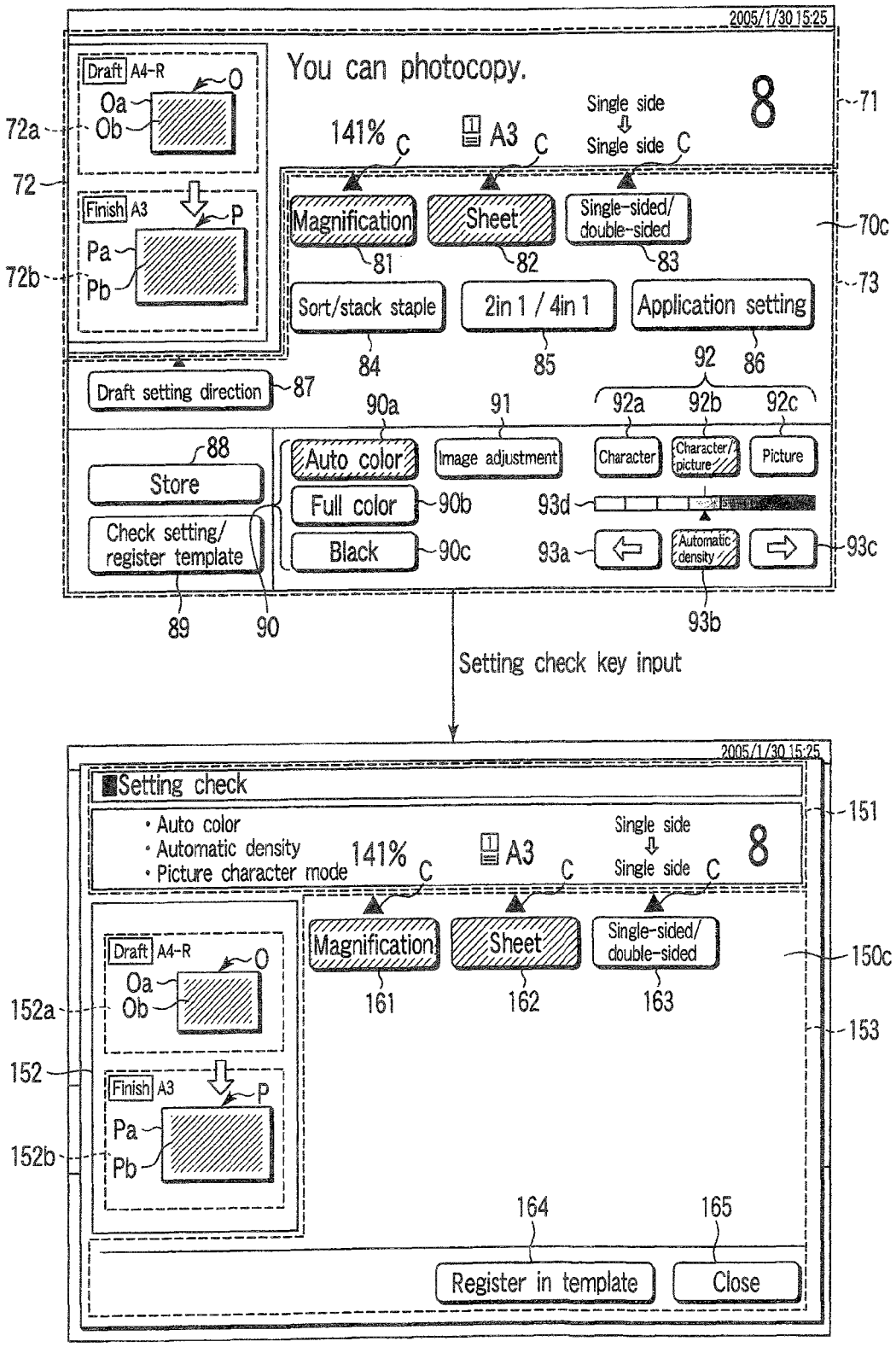
FIG. 20 is a diagram showing a display example of a basic screen and a setting check screen in a photocopy mode.

FIG. 20 shows display examples of a basic screen 70*c* and the setting check screen in a case where the draft is set to "A4, horizontal, single-sided, and portrait", and the sheet is set to "A3, horizontal, single-sided, and portrait". Here, it is assumed that there is not set a finishing setting, an Nin1 (a function of printing a plurality of draft images (N original images) on one sheet) setting or an application setting.

In the setting information display area 71 of the basic screen 70*c*, together with a guidance "you can photocopy", there are displayed "141%" as a magnification setting, "A3" as a sheet setting, "single-sided→single-sided" as a photocopy side (single-sided/double-sided) setting, "8" as the number of sheets to be photocopied and the like. Furthermore, in the display area 72 of the basic screen 70*c*, the first display area 72*a* displays the draft graphical image O indicating "A4, horizontal, single-sided, and portrait", and the second display area 72*b* displays the finished graphical image P indicating "A3, horizontal, single-sided, and portrait".

Moreover, in the button display area 73 of the basic screen 70*c*, the magnification key 81 and the sheet key 82 are displayed in a specific color (e.g., blue) which is different from a color of a key brought into a default setting state. Here, it is assumed that the default setting includes a magnification of "100%", a sheet setting of "automatic sheet", and a photocopy side of "single-sided→single-sided". Therefore, in the display example shown in FIG. 20, the magnification and the sheet setting are different from those of the default setting. Therefore, in the button display area 73 of the basic screen 70*c*, the magnification key 81 and the sheet key 82 are displayed in the specific color (e.g., blue).

Furthermore, the magnification key, the sheet key and the photocopy side key described in the button display area 73 are associated with the magnification, the sheet and the photocopy side (single-sided/double-sided) displayed in the setting information display area 71 by the triangular graphics C, respectively.

Such basic screen 70*c* can allow the user to intuitively and visually recognize various set contents and various keys corresponding to the setting particulars. Furthermore, the key corresponding to the setting particular brought into the setting different from the default setting is displayed in the color different from that of the key brought into the default setting state. Therefore, the user can intuitively and visually recognize the setting particulars which are different from the default settings (e.g., the setting particular whose setting has been changed in a lower-layer setting screen), and the keys corresponding to the setting particulars.

Moreover, when the user touches the setting check key 89 in the basic screen 70, the display section 22 displays a setting check screen 150 (100*c*, 100*d*, 100*e*, or 100*f*). The setting check screen 150 (100*c*, 100*d*, 100*e*, or 100*f*) is constituted of display areas 151, 152, 153 and the like.

The setting check screen 150 is constituted of a layout similar to that of the basic screen 70. That is, the display area 151 is disposed in an upper area of the screen in the same manner as in the display area 71. The display area 152 is disposed in an upper left area of the screen in the same manner as in the display area 72. The display area 153 is disposed to range from the center to a right part of the screen in the same manner as in the button display area 73.

In the display area 151, there are displayed setting information on the photocopy magnification, the sheet, the photocopy side (single-sided/double-sided), the number of sheets to be photocopied and the like in the same manner as in the display area 71 of the basic screen 70. Furthermore, the display area 151 displays a color mode, a density setting mode, a draft image mode and the like.

The display area 152 is constituted of a first display area 152*a* and a second display area 152*b*. The first display area 152*a* and the second display area 152*b* display contents similar to those of the first display area 72*a* and the second display area 72*b*. That is, in the first display area 152*a*, there are displayed the draft graphical image O indicating the present draft setting together with the character information indicating the draft size. In the second display area 152*b*, there are displayed the finished graphical image P indicating the present sheet setting together with the character information indicating the sheet size.

The display area 153 selectively displays icons having constitutions similar to those of the keys displayed in the button display area 73 of the basic screen 70 as required. It is to be noted that the display area 153 displays at least a magnification icon 161, a sheet icon 162 and a photocopy side icon 163. Furthermore, in accordance with the set contents, there is displayed a finishing setting icon 166, an Nin1 setting icon 167 or an insertion sheet icon 168. The magnification icon 161, the sheet icon 162 and the photocopy side icon 163 are associated and displayed with the photocopy magnification, the sheet and the photocopy side (single-sided/double-sided) displayed in the display area 151 by the triangular graphics C, respectively.

For example, the display area 153 of the setting check screen 150*c* shown in FIG. 20 displays the magnification icon 161 which is associated with the photocopy magnification displayed in the display area 151 by the triangular graphic C. The magnification icon 161 is an icon having display contents similar to those of the magnification key 81 displayed in the basic screen 70. A position of the magnification icon 161 displayed in the setting check screen 150 corresponds to a position of the magnification key 81 in the basic screen 70.

The display area 153 of the setting check screen 150*c* displays the sheet icon 162 which is associated with sheet set contents displayed in the display area 151 by the triangular graphic C. The sheet icon 162 is an icon having display contents similar to those of the sheet key 82 displayed in the basic screen 70. A position of the sheet icon 162 displayed in the setting check screen 150 corresponds to a position of the sheet key 82 in the basic screen 70.

The display area 153 of the setting check screen 150*c* displays the photocopy side icon 163 which is associated with photocopy side set contents displayed in the display area 151 by the triangular graphic C. The photocopy side icon 163 is an icon having display contents similar to those of the photocopy side key 83 displayed in the basic screen 70. A position of the photocopy side icon 163 displayed in the setting check screen 150 corresponds to a position of the photocopy side key 83 in the basic screen 70.

Moreover, the display area 153 further displays a template register key 164 and a close key 165. The template register key 164 is constituted of an icon in which "register in template" is displayed. The template register key 164 is a key to be touched in a case where the displayed present set contents are registered as a template. That is, in a case where the template register key 164 is touched, the CPU 51 performs template registration processing to register, as the template, the set contents displayed in the setting check screen 150. The close key 165 is a key to be touched in a case where the setting check screen 150 is closed. In a case where the user touches the close key 165, the CPU 51 closes the setting check screen 150, and displays, in the display section 22, the basic screen 70 in which the set contents displayed in the setting check screen have been reflected.

It is to be noted that in a case where the magnification icon 161, the sheet icon 162 or the photocopy side icon 163 is touched in the setting check screen 150*c*, the display section 22 displays a magnification setting screen, a sheet setting screen or a photocopy side setting screen. Accordingly, in the digital multifunction peripherals 1, it is possible to perform the set processing corresponding to each icon displayed in the setting check screen 150*c*.

Figure 21:
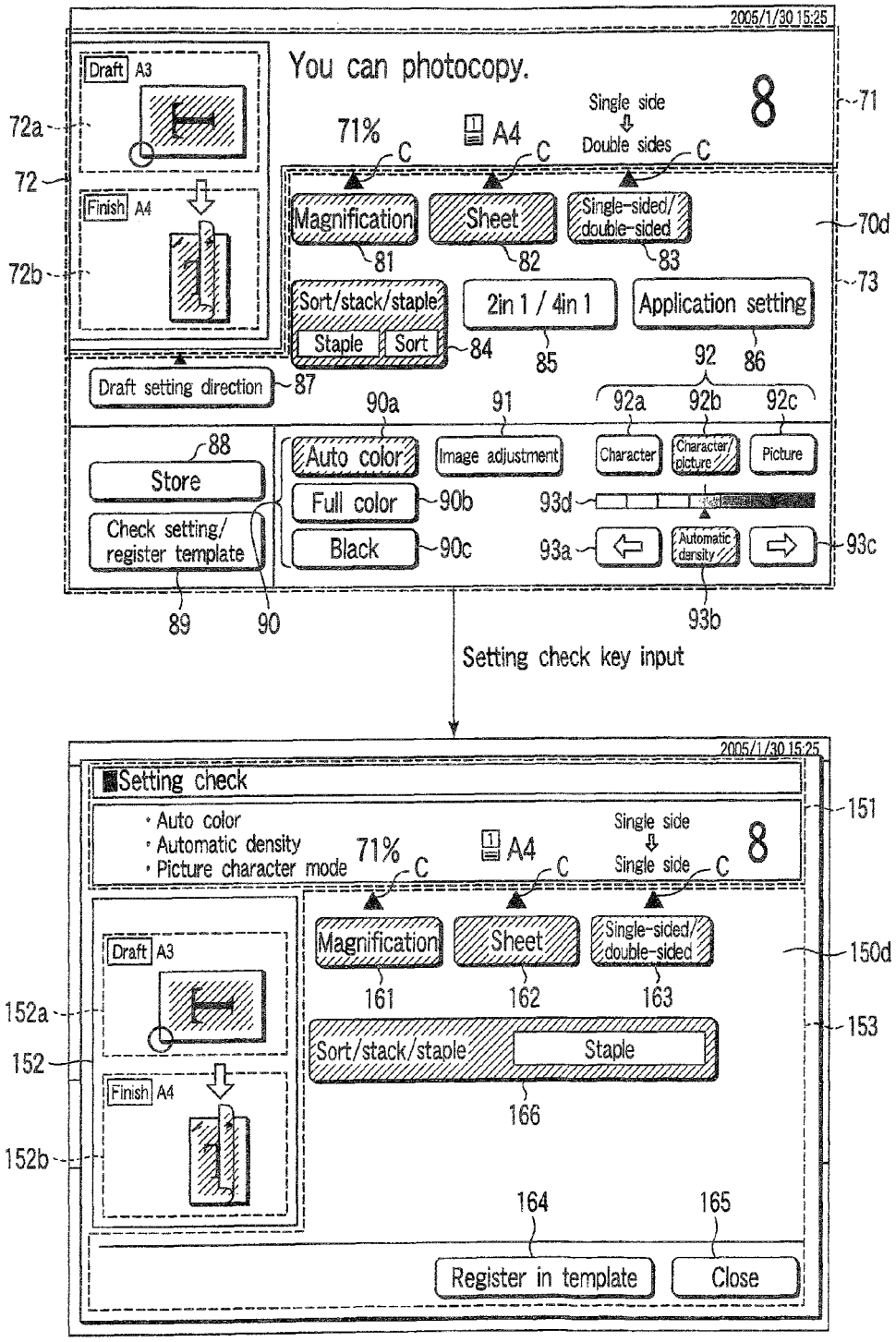
FIG. 21 is a diagram showing a display example of a basic screen and a setting check screen in a case where stapling is set.

FIG. 21 shows display examples of a basic screen 70*d* and the setting check screen 150*d* in a case where stapling is set as a finishing setting. It is assumed that in the display example of FIG. 21, there is not set the Nin1 setting or the application setting.

For example, in a case where the finishing setting key 84 is touched in the basic screen 70, the CPU 51 displays, in the display section 22, a setting screen (finishing setting screen) for setting finishing (sort/stack/staple). In a case where this finishing setting screen is displayed, the CPU 51 performs finishing set processing in accordance with information input by the user.

In a case where the finishing setting screen is closed in a state in which a finishing function is set by such finishing set processing, the basic screen 70*d* is displayed in the display section 22 as shown in FIG. 21. In this basic screen 70*d*, the finishing setting key 84 is changed to an icon in which the set contents are displayed. For example, when the stapling is set as one of finishing functions, in the basic screen 70, the finishing setting key 84 displays "sort/stack/staple", and is changed to an icon in which "staple, sort" is displayed.

When the user touches the setting check key 89 in such basic screen 70*d*, the setting check screen 150*d* is displayed in the display section 22 as shown in FIG. 21. In addition to the magnification icon 161, the sheet icon 162 and the photocopy side icon 163, the setting check screen 150*d* displays the finishing setting icon 166 indicating that the stapling is set as one of the finishing functions.

In the finishing setting icon 166 of the setting check screen 150*d*, "sort/stack/staple" is displayed in the same manner as in the finishing setting key 84 displayed in the basic screen 70. Moreover, it is emphatically indicated that "staple" is set. In the setting check screen 150*d*, the finishing setting icon 166 is displayed in a position corresponding to that of the finishing setting key 84 in the basic screen 70.

In the display example shown in FIG. 21, the photocopy magnification is "71%", the sheet is "A4", and the photocopy side is "single-sided→double-sided (to photocopy a single side of the draft onto double sides of the sheet)". Furthermore, it is shown that the stapling is brought into a set state. That is, in FIG. 21, when the magnification key 81, the sheet key 82, the photocopy side key 83 and the finishing setting key 84 correspond to a setting different from the default setting (the photocopy magnification is "100%", the sheet is "automatic sheet" and the photocopy side is "single-sided→single-sided (to photocopy the single side of the draft onto the single side of the sheet)"), the keys are displayed in a color different from that of the default setting state.

That is, in the basic screen 70*d* shown in FIG. 21, the magnification key 81, the sheet key 82, the photocopy side key 83 and the finishing setting key 84 are displayed in a color different from that of the default setting state. Further in the basic screen 70*d* shown in FIG. 21, the magnification key 81, the sheet key 82 and the photocopy side key 83 are associated with "71%", "A4" and "single-sided→double-sided" displayed in the setting information display area 71 by triangular graphics C, respectively.

Similarly, in the setting check screen 150*d* shown in FIG. 21, the magnification icon 161, the sheet icon 162, the photocopy side icon 163 and the finishing setting icon 166 are displayed in a color different from that of the default setting state. Furthermore, in the setting check screen 150*d* shown in FIG. 21, the icons are associated with "71%", "A4" and "single-sided→double-sided" displayed in the setting information display area 151 by the triangular graphics C, respectively. Further in the setting check screen 150*d* shown in FIG. 21, the magnification icon 161, the sheet icon 162 and the photocopy side icon 163 are associated with "71%", "A4" and "single-sided→double-sided" displayed in the setting information display area 151 by triangular graphics C, respectively.

It is to be noted that in a case where the magnification icon 161, the sheet icon 162, the photocopy side icon 163 and the finishing setting icon 166 are touched in the setting check screen 150*d*, the magnification setting screen, the sheet setting screen, the photocopy side setting screen and the finishing setting screen are displayed in the display section 22, respectively. In consequence, in the present digital multifunction peripherals 1, the set processing is performed in response to each icon displayed in the setting check screen 150*d*.

Figure 22:
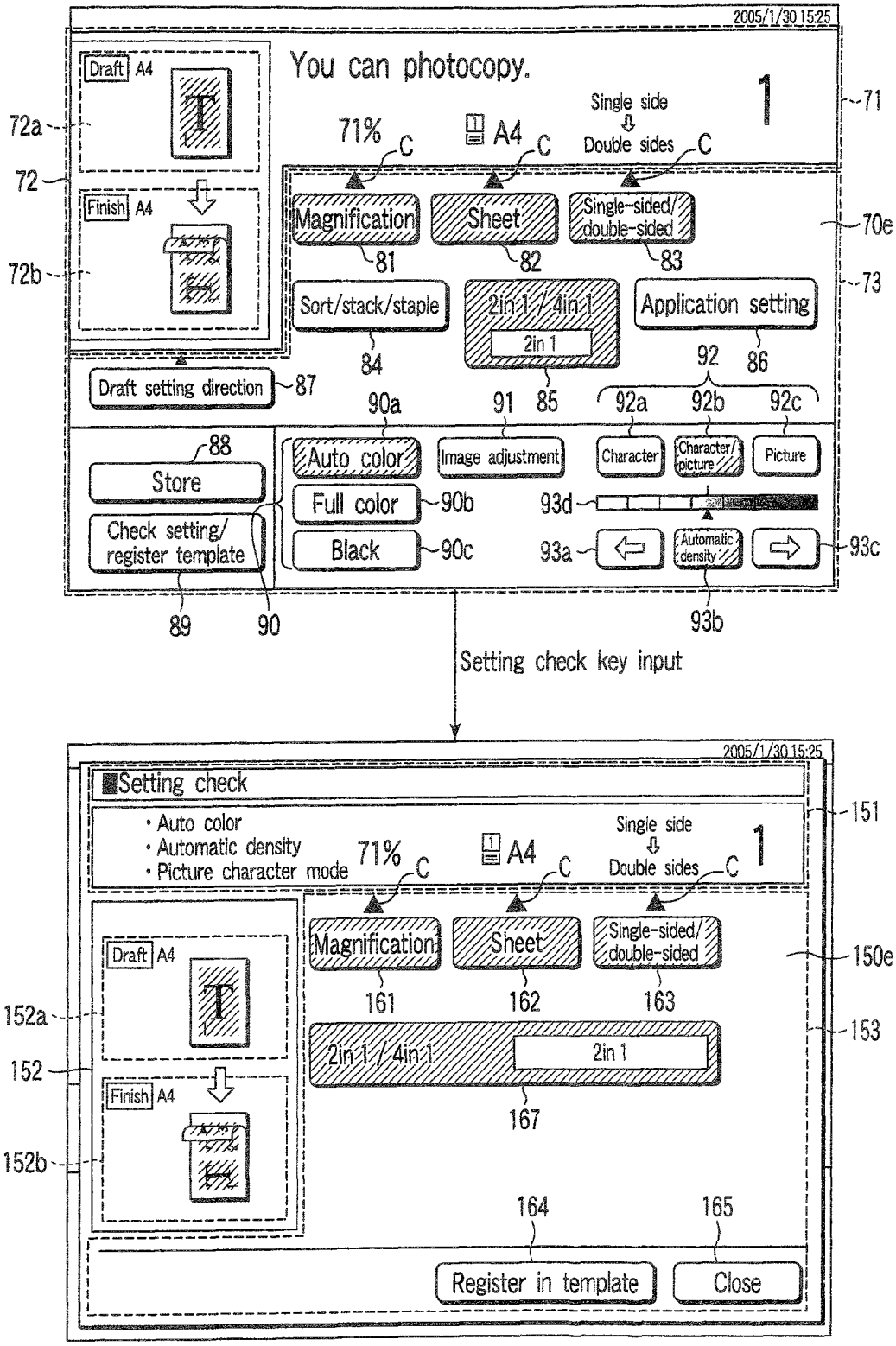
FIG. 22 is a diagram showing a display example of a basic screen and a setting check screen in a case where 2in1 is set.

FIG. 22 shows display examples of a basic screen 70*e* and the setting check screen 150*e* in a case where 2in1 is set as an Nin1 setting. It is assumed that in the display example of FIG. 22, there is not set the finishing setting or the application setting.

For example, in a case where the Nin1 key 85 is touched in the basic screen 70, the CPU 51 displays, in the display section 22, a setting screen (Nin1 setting screen) for setting Nin1 (2 in1/4in1). In a state in which this Nin1 setting screen is displayed, the CPU 51 performs Nin1 photocopy set processing in accordance with information input by the user.

In a case where the Nin1 setting screen is closed in a state in which Nin1 photocopy is set by such Nin1 set processing, the basic screen 70*e* is displayed in the display section 22 as shown in FIG. 22. In this button display area 73 of the basic screen 70*e*, the Nin1 key 85 is changed to an icon in which the set contents are displayed. For example, when 2in1 is set as one of Nin1 functions, in the basic screen 70*e*, the Nin1 key 85 displays "2 in1/4in1", and is changed to an icon in which "2in1" is displayed.

When the user touches the setting check key 89 in such basic screen 70*e*, this setting check screen 150*e* is displayed in the display section 22 as shown in FIG. 22. In addition to the magnification icon 161, the sheet icon 162 and the photocopy side icon 163, this setting check screen 150*e* displays the Nin1 setting icon 167 which indicates that 2in1 is set. In the Nin1 setting icon 167 of the setting check screen 150*e*, "2 in1/4in1" is displayed in the same manner as in the Nin1 key 85 displayed in the basic screen 70*e*. Moreover, it is emphatically indicated that "2in1" is set. In the setting check screen 150*e*, the Nin1 setting icon 167 is displayed in a position corresponding to that of the Nin1 key 85 in the basic screen 70.

In the display example shown in FIG. 22, the photocopy magnification is "71%", the sheet is "A4", and the photocopy side is "single-sided→double-sided (to photocopy the single side of the draft onto the double sides of the sheet)". Furthermore, it is shown that the 2in1 photocopy is brought into a set state. That is, in FIG. 22, when the magnification key 81, the sheet key 82, the photocopy side key 83 and the Nin1 key 85 correspond to a setting different from the default setting (the photocopy magnification is "100%", the sheet is "automatic sheet" and the photocopy side is "single-sided→single-sided (to photocopy the single side of the draft onto the single side of the sheet)"), the keys are displayed in a color different from that of the default setting state.

That is, in the basic screen 70*e* shown in FIG. 22, the magnification key 81, the sheet key 82, the photocopy side key 83 and the Nin1 key 85 are displayed in a color different from that of the default setting state. Further in the basic screen 70*e* shown in FIG. 22, the magnification key 81, the sheet key 82 and the photocopy side key 83 are associated with "71%", "A4" and "single-sided→double-sided" displayed in the setting information display area 71 by triangular graphics C, respectively.

Similarly, in the setting check screen 150*e* shown in FIG. 22, the magnification icon 161, the sheet icon 162, the photocopy side icon 163 and the Nin1 setting icon 167 are displayed in a color different from that of the default setting state. Further in the setting check screen 150*e* shown in FIG. 22, the icons are associated with "71%", "A4" and "single-sided→double-sided" displayed in the setting information display area 151 by triangular graphics C, respectively. Further in the setting check screen 150*e* shown in FIG. 22, the magnification icon 161, the sheet icon 162 and the photocopy side icon 163 are associated with "71%", "A4" and "single-sided→double-sided" displayed in the setting information display area 151 by the triangular graphics C, respectively.

It is to be noted that in a case where the magnification icon 161, the sheet icon 162, the photocopy side icon 163 and the Nin1 setting icon 167 are touched in the setting check screen 150*e*, the magnification setting screen, the sheet setting screen, the photocopy side setting screen and the Nin1 setting screen are displayed in the display section 22, respectively. In consequence, in the present digital multifunction peripherals 1, the set processing is performed in response to each icon displayed in the setting check screen 150*e*.

Figure 23:
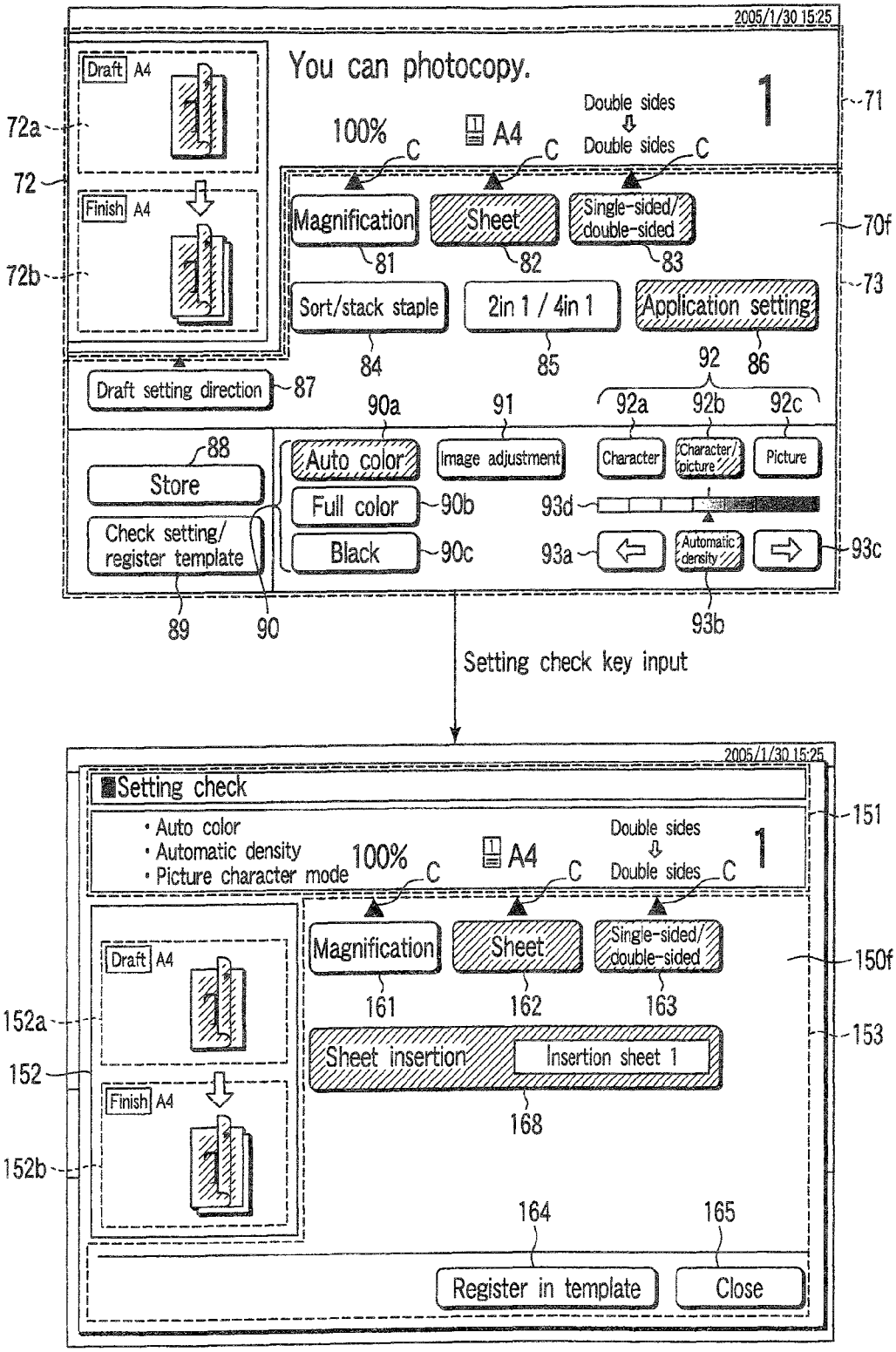
FIG. 23 is a diagram showing a display example of a basic screen and a setting check screen in a case where insertion of a sheet is set.

FIG. 23 shows display examples of a basic screen 70*f* and the setting check screen 150*f* in a case where an insertion sheet is set as an application setting. It is assumed that in the display example of FIG. 23, there is not set the finishing setting or the Nin1 setting.

For example, in a case where the application setting key 86 is touched in the basic screen 70, the CPU 51 displays an application menu screen in the display section 22. In a case where the user instructs an insertion sheet setting in this application menu, the CPU 51 displays, in the display section 22, a setting screen (insertion sheet setting screen) for setting the insertion sheet. In a state in which this insertion sheet setting screen is displayed, the CPU 51 performs insertion sheet set processing in accordance with information input by the user.

In a case where the insertion sheet setting screen is closed in a state in which the insertion sheet is set by such insertion sheet set processing, the basic screen 70*f* is displayed in the display section 22 as shown in FIG. 23. In this case, in the button display area 73 of the basic screen 70*f*, the application setting key 86 is changed to an icon in which "insertion sheet" or "sheet insertion" is displayed together with "application setting". That is, in the basic screen 70*f* displayed in a state in which the application setting is set, the key is changed to the icon in which the contents set as the application setting are displayed.

When the user touches the setting check key 89 in such basic screen 70*f*, the setting check screen 150*f* is displayed in the display section 22 as shown in FIG. 23. In addition to the magnification icon 161, the sheet icon 162 and the photocopy side icon 163, this setting check screen 150*f* displays the application setting (sheet insertion) icon 168 which indicates that the insertion sheet is set. In the application setting (sheet insertion) icon 168 of the setting check screen 150*f*, "sheet insertion" is displayed in the same manner as in the application setting key 86 displayed in the basic screen 70*f*. Moreover, it is emphatically indicated that "insertion sheet 1" is set. In the setting check screen 150*f*, the application setting (sheet insertion) icon 168 is displayed in a position corresponding to that of the application setting key 86 in the basic screen 70.

In the display example shown in FIG. 23, the photocopy magnification is "100%", the sheet is "A4", and the photocopy side is "single-sided→double-sided (to photocopy the single side of the draft onto the double sides of the sheet)". Furthermore, it is shown that the insertion sheet is brought into a set state. That is, in FIG. 23, when the sheet key 82, the photocopy side key 83 and the application setting key 86 correspond to a setting different from the default setting (the photocopy magnification is "100%", the sheet is "automatic sheet" and the photocopy side is "single-sided→single-sided (to photocopy the single side of the draft onto the single side of the sheet)"), the keys are displayed in a color different from that of the default setting state.

That is, in the basic screen 70*f* shown in FIG. 23, the sheet key 82, the photocopy side key 83 and the application setting key 86 are displayed in a color different from that of the default setting state. Further in the basic screen 70*f* shown in FIG. 23, the magnification key 81, the sheet key 82 and the photocopy side key 83 are associated with "100%", "A4" and "single-sided→double-sided" displayed in the setting information display area 71 by triangular graphics C, respectively.

Similarly, in the setting check screen 150*f* shown in FIG. 23, the sheet icon 162, the photocopy side icon 163 and the insertion sheet icon 168 are displayed in a color different from that of the default setting state. Further in the setting check screen 150*f* shown in FIG. 23, the icons are associated with "100%", "A4" and "double-sided→double-sided" displayed in the setting information display area 151 by triangular graphics C, respectively. Further in the setting check screen 150*f* shown in FIG. 23, the magnification icon 161, the sheet icon 162 and the photocopy side icon 163 are associated with "100%", "A4" and "double-sided→double-sided" displayed in the setting information display area 151 by triangular graphics C, respectively.

It is to be noted that in a case where the sheet icon 162, the photocopy side icon 163 and the insertion sheet icon 168 are touched in the setting check screen 150*f*, the sheet setting screen, the photocopy side setting screen and the insertion sheet setting screen are displayed in the display section 22, respectively. In consequence, in the present digital multifunction peripherals 1, the set processing is performed in response to each icon displayed in the setting check screen 150*f*.

As described above, in the basic screen 70 (or the setting check screen 150 having a layout similar to that of the basic screen), various setting particulars concerning the photocopy processing are displayed together in the setting information display area 71 (or the display area 151). Various icons for instructing various setting particulars are displayed together in the button display area 73 (or the display area 153). Furthermore, there are displayed the graphics which associate the setting particulars displayed in the setting information display area with the icons for setting the setting particulars displayed in the setting information display area among the icons displayed in the display area. Therefore, the respective keys and the information to be confirmed can clearly be indicated to the user. As a result, the user can intuitively and securely recognize the setting situation.

Next, there will be described a display example of the setting screen in a case where the insertion sheet is set as one example of the application setting.

Figure 24:
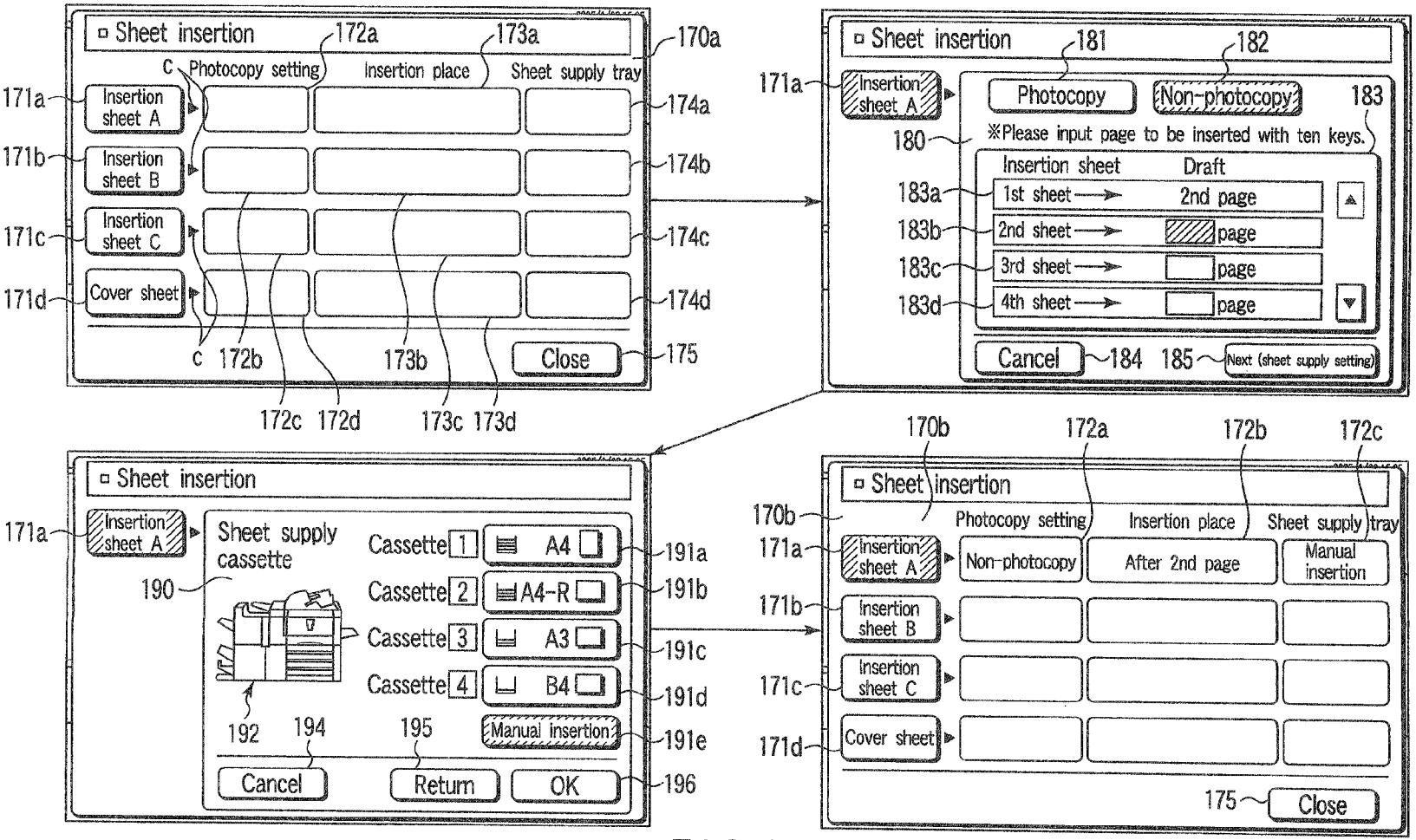
FIG. 24 is a diagram showing a display example of a certain setting screen for setting a sheet to be inserted.

FIG. 24 is a diagram showing a display example of the setting screen in a case where the insertion sheet is set.

In a case where the user touches the application setting key 86 in the basic screen 70, the CPU 51 displays the application menu screen in the display section 22.

This application menu screen displays icons for setting various functions as application settings (e.g., binder erase, sheet insertion, binding margin, continuous page photocopy, magazine sorting, independent scaling, addition of pages, addition of date and time, etc.). In a case where the user instructs the setting of the insertion sheet in such application menu screen, the CPU 51 displays, in the display section 22, a setting screen (insertion sheet setting screen) 170 for setting the insertion sheet as shown in FIG. 24.

This insertion sheet setting screen 170 displays: a plurality of insertion sheet setting keys 171 (171*a*, 171*b*, 171*c*, and 171*d*); a plurality of first display columns 172 (172*a*, 172*b*, 172*c*, and 172*d*); a plurality of second display columns 173 (173*a*, 173*b*, 173*c*, and 173*d*); a plurality of third display columns 174 (174*a*, 174*b*, 174*c*, and 174*d*); and a close key 175.

Each of the insertion sheet setting keys 171 corresponds to each first display column 172, each second display column 173 and each third display column 174. Each insertion sheet setting key 171 is associated and displayed with the first display column 172, the second display column 173 and third display column 174 by triangular graphics C, respectively. for example, the set contents displayed in the first display column 172*a*, the second display column 173*a* and the third display column 174*a* correspond to the insertion sheet setting key 171*a* for setting "insertion sheet A".

When the user touches any insertion sheet setting key 171 in such insertion sheet setting screen 170, the display section 22 displays an insertion sheet setting input screen 180. This insertion sheet setting input screen 180 is associated and displayed with the insertion sheet setting key 171 touched by the user by the triangular graphic C. For example, in the display example shown in FIG. 24, in a case where the insertion sheet setting key 171*a* is touched in the insertion sheet setting screen 170*a*, there is displayed the insertion sheet setting input screen 180 which is associated with the insertion sheet setting key 171*a* by the triangular graphic C.

Moreover, the input screen 180 is provided with photocopy setting keys 181, 182, an insertion position setting portion 183, a cancel key 184 and next (supply sheet setting) key 185. The photocopy setting key 181 is a key to be touched in a case where the insertion sheet is to be photocopied. The photocopy setting key 182 is a key to be touched in a case where the insertion sheet is not photocopied. The insertion position setting portion 183 is provided with a column for designating a position where the insertion sheet is to be inserted by a draft page unit. The cancel key 184 is a key to be touched in a case where the setting of the insertion sheet is cancelled. The next (supply sheet setting) key 185 is a key for setting a place where a sheet to be handled as the insertion sheet is supplied.

In a case where the next (supply sheet setting) key 185 is touched, an insertion sheet supply setting screen 190 is displayed in the display section 22. This insertion sheet supply setting screen 190 is associated and displayed, by the triangular graphic C, with the insertion sheet setting key 171 selected by the user. For example, in the display example shown in FIG. 24, in a case where the next (supply sheet setting) key 185 is touched in the insertion sheet setting input screen 180, there is displayed the insertion sheet supply setting screen 190 which is associated with the insertion sheet setting key 171*a* by the triangular graphic C.

Moreover, the insertion sheet supply setting screen 190 is provided with: cassette keys 191*a*, 191*b*, 191*c* and 191*d*; a manual insertion key 191*e*; a cancel key 194; a return key 195; and an OK key 196. In this insertion sheet supply setting screen 190, the user designates the place (supply sheet tray) where the insertion sheet is to be supplied with one of the respective cassette keys 191*a*, 191*b*, 191*c* and 191*d* and the manual insertion key 191*e*.

When the OK key 196 is touched, in the display section 22, there are displayed setting information input in the insertion sheet setting input screen 180 and the insertion sheet setting screen 170 in which the sheet supply place designated by the supply sheet setting screen 190 is reflected. For example, in the display example shown in FIG. 24, in a case where the OK key 196 is touched in the supply sheet setting screen 190 of the insertion sheet, the display section 22 displays the insertion sheet setting screen 170*b* in which the set contents of the insertion sheet are displayed in the first, second and third display columns associated with the insertion sheet setting key 171*a* by the triangular graphic C.

As described above, even in the setting screen other than the basic screen, each key is associated and displayed with information on each key by the triangular graphic. In consequence, information to be confirmed or the key or the like to be operated can be clearly indicated to the user in operating each key. As a result, the user can intuitively and securely recognize the setting situation.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed is:

1. An operation device of an image forming apparatus comprising:

a display unit which displays a setting screen including an information display area and a button display area, at least a portion of the button display area being adjacent to the information display area;

a touch panel which detects a touch on an icon displayed in the display unit; and a display control unit which displays a message and a plurality of setting particulars in the information display area, displays a plurality of icons for setting the setting particulars in the button display area, and displays a plurality of triangular graphics, each of the triangular graphics positioned to associate a respective one of the setting particulars displayed in the setting information display area and with a corresponding one of the icons displayed in the button display area.

2. The operation device according to claim 1, wherein the display unit displays a setting screen of photocopy processing.

3. The operation device according to claim 2, wherein the display control unit displays the triangular graphic which has the apex on a side of information displayed in the information display area and indicating a magnification setting and the bottom on a side of the icon displayed in the button display area and setting a magnification.

4. The operation device according to claim 2, wherein the display control unit displays the triangular graphic which has the apex on a side of information displayed in the information display area and indicating a sheet setting and the bottom on a side of the icon displayed in the button display area and setting a sheet.

5. The operation device according to claim 2, wherein the display control unit displays the triangular graphic which has the apex on a side of information displayed in the information display area and indicating a double-sided setting and the bottom on a side of the icon displayed in the button display area and setting double sides.

6. The operation device according to claim 2, wherein the display control unit displays, in the information display area, a draft graphical image indicating set contents of a draft and a finished graphical image indicating set contents of a sheet, and the display control unit displays a triangular graphic which has an apex on a side of the draft graphical image and the finished graphical image and a bottom on a side of the icon to set a direction of the image in the draft.

7. The operation device according to claim 6, wherein the draft graphical image indicates the draft as a whole;

the finished graphical image is obtained by superimposing a graphical image indicating an area of a draft image with reference to a printing start position on a graphical image indicating an image forming medium as a whole.

8. An image forming apparatus comprising:

a scanner which reads an image of a draft;

a printer which prints the image on an image forming medium;

a display unit which displays a setting screen of photocopy processing including an information display area and a button display area, as least a portion of the button display area being adjacent to the information display area;

a touch panel which detects a touch on an icon displayed in the display unit;

a display control unit which displays a message and a plurality of setting particulars in the information display area, displays a plurality of icons for setting the setting particulars in the button display area, and displays a plurality of triangular graphics, each of the triangular graphics positioned to associate a respective one of the setting particulars displayed in the setting information display area and with a corresponding one of the icons displayed in the button display area;

a setting unit which performs setting in accordance with an instruction to the icon displayed by the display control unit.

9. The apparatus according to claim 8, wherein the display control unit displays the triangular graphic which has the apex on a side of information displayed in the information display area and indicating a magnification setting and the bottom on a side of the icon displayed in the button display area and setting a magnification.

10. The apparatus according to claim 8, wherein the display control unit displays the triangular graphic which has the apex on a side of information displayed in the information display area and indicating a sheet setting and the bottom on a side of the icon displayed in the button display area and setting a sheet.

11. The apparatus according to claim 8, wherein the display control unit displays the triangular graphic which has the apex on a side of information displayed in the information display area and indicating a double-sided setting and the bottom on a side of the icon displayed in the button display area and setting double sides.

12. The apparatus according to claim 8, wherein the display control unit displays, in the information display area, a draft graphical image indicating set contents of the draft and a finished graphical image indicating set contents of a sheet, and the display control unit displays a triangular graphic which has an apex on a side of the draft graphical image and the finished graphical image and a bottom on a side of the icon to set a direction of the image in the draft.

13. The apparatus according to claim 12, wherein:

the draft graphical image indicates the draft as a whole;

the finished graphical image is obtained by superimposing a graphical image indicating an area of a draft image with reference to a printing start position on a graphical image indicating an image forming medium as a whole.

14. A method of displaying a setting screen of an image forming apparatus, the method comprising:

displaying, in an information display area of one setting screen, a message and a plurality of setting particulars;

displaying, in a button display area of the setting screen, a plurality of icons for setting the setting particulars, at least a portion of the button display area being adjacent to the information display area;

displaying, in the setting screen, a plurality of triangular graphics, each of the triangular graphics positioned to associate a respective one of the setting particulars displayed in the setting information display area with a corresponding one of the icons displayed in the button display area.

15. The method according to claim 14, wherein the setting screen is a setting screen of photocopy processing.

16. The method according to claim 15, wherein the displaying of the setting particulars comprises: displaying, in the information display area, information indicating a magnification setting, the displaying of the icons comprises: displaying, in the button display area, an icon which sets a magnification, and the displaying of the graphics comprises: displaying the triangular graphic which has the apex on a side of the information displayed in the setting information display area and indicating the magnification setting and the bottom on a side of the icon displayed in the button display area and setting the magnification.

17. The method according to claim 15, wherein the displaying of the setting particulars comprises: displaying, in the information display area, information indicating a sheet setting, the displaying of the icons comprises: displaying, in the button display area, an icon which sets a sheet, and the displaying of the graphics comprises: displaying the triangular graphic which has the apex on a side of the information displayed in the setting information display area and indicating the sheet setting and the bottom on a side of icon displayed in the button display area and setting the sheet.

18. The method according to claim 15, wherein the displaying of the setting particulars comprises: displaying, in the information display area, information indicating a double-sided setting, the displaying of the icons comprises: displaying, in the button display area, an icon which sets double sides, and the displaying of the graphics comprises: displaying the triangular graphic which has the apex on a side of the information displayed in the setting information display area and indicating the double-sided setting and the bottom on the side of the icon displayed in the button display area and setting the double sides.

19. The method according to claim 15, wherein the displaying of the setting particulars comprises:

displaying, in the information display area, a draft graphical image indicating set contents of the draft and a finished graphical image indicating set contents of a sheet, the displaying of the icons comprises: displaying, in the button display area, an icon which sets a direction of the image in the draft, and the displaying of the graphics comprises: displaying the triangular graphic which has an apex on a side of the draft graphical image and the finished graphical image displayed in the setting information display area and a bottom on a side of the icon displayed in the button display area and setting the direction of the image in the draft.

20. The method according to claim 19, wherein:

the draft graphical image indicates the draft as a whole;

the finished graphical image is obtained by superimposing a graphical image indicating an area of a draft image with reference to a printing start position on a graphical image indicating an image forming medium as a whole.

* * * * *

UNITED STATES PATENT AND TRADEMARK OFFICE

CERTIFICATE OF CORRECTION

PATENT NO. : 7,995,945 B2
APPLICATION NO. : 12/814402
DATED : August 9, 2011
INVENTOR(S) : Kimoto et al.

It is certified that error appears in the above-identified patent and that said Letters Patent is hereby corrected as shown below:

Column 35, line 47: replace “5159” with --S159--.

Column 37, line 52: replace “5179” with --S179--.

Column 47, line 29: delete “and”.

Column 48, line 16: delete “and”.

Signed and Sealed this
Fourth Day of October, 2011

David J. Kappos

David J. Kappos
*Director of the United States Patent and Trademark Office*